US011374360B2

(12) United States Patent
Faith et al.

(10) Patent No.: US 11,374,360 B2
(45) Date of Patent: Jun. 28, 2022

(54) ELECTRICAL CONTACTS HAVING ANCHORING REGIONS WITH IMPROVED IMPEDANCE CHARACTERISTICS

(71) Applicant: SAMTEC INC., New Albany, IN (US)

(72) Inventors: Chadrick Paul Faith, Corydon, IN (US); Gary Ellsworth Biddle, Carlisle, PA (US); Randall Eugene Musser, Enola, PA (US); Jonathan Earl Buck, Hershey, PA (US)

(73) Assignee: SAMTEC, INC., New Albany, IN (US)

( * ) Notice: Subject to any disclaimer, the term of this patent is extended or adjusted under 35 U.S.C. 154(b) by 518 days.

(21) Appl. No.: 16/327,511

(22) PCT Filed: Aug. 23, 2017

(86) PCT No.: PCT/US2017/048217

§ 371 (c)(1),
(2) Date: Feb. 22, 2019

(87) PCT Pub. No.: WO2018/039351

PCT Pub. Date: Mar. 1, 2018

(65) Prior Publication Data

US 2021/0305752 A1 Sep. 30, 2021

Related U.S. Application Data

(60) Provisional application No. 62/402,726, filed on Sep. 30, 2016, provisional application No. 62/402,482,
(Continued)

(51) Int. Cl.
*H01R 13/24* (2006.01)
*H01R 13/6471* (2011.01)
(Continued)

(52) U.S. Cl.
CPC ..... *H01R 13/6471* (2013.01); *H01R 13/24* (2013.01); *H01R 13/405* (2013.01);
(Continued)

(58) Field of Classification Search
CPC .... H01R 12/716; H01R 24/60; H01R 12/714; H01R 12/721; H01R 12/79;
(Continued)

(56) References Cited

U.S. PATENT DOCUMENTS 5,547,385 A 8/1996 Spangler
5,772,474 A 6/1998 Yagi et al.
(Continued)

FOREIGN PATENT DOCUMENTS

CN 1150341 A 5/1997
CN 2610522 Y 4/2004
(Continued)

OTHER PUBLICATIONS

Samtec, 0.8MM Edge Rate Socket Assembly, ERF8-XXX-XX.X-XXX-DV-XXXX-XX, By: Knowlden, dated Sep. 26, 2005, 7 sheets.
(Continued)

*Primary Examiner* — Truc T Nguyen
(74) *Attorney, Agent, or Firm* — BakerHostetler

(57) ABSTRACT

An electrical contact for an electrical connector includes a body having a mounting end and a mating end, a contact beam, and an anchoring region. The contact beam includes first and second edges that are laterally spaced from one another, and first and second broadsides that extend between the first and second edges. The anchoring region includes first, second, and intermediate portions. The first portion extends from the contact beam towards the mounting end, and has a first side that is spaced laterally outwards from the first edge. The second portion extends from the mounting
(Continued)

end towards the first portion, and has a first side that is spaced laterally outwards from the first edge. The intermediate portion extends between the first portion and the second portion, and has a first side that is recessed laterally inwards from the first sides of the first and second portions.

24 Claims, 26 Drawing Sheets

Related U.S. Application Data filed on Sep. 30, 2016, provisional application No. 62/378,313, filed on Aug. 23, 2016.

(51) Int. Cl.
*H01R 13/405* (2006.01)
*H01R 13/6473* (2011.01)
*H01R 12/57* (2011.01)
*H01R 12/71* (2011.01)

(52) U.S. Cl.
CPC ..... *H01R 13/6473* (2013.01); *H01R 12/57* (2013.01); *H01R 12/716* (2013.01)

(58) Field of Classification Search
CPC H01R 13/6471; H01R 2107/00; H01R 12/73; H01R 13/405; H01R 13/514; H01R 13/6275; H01R 13/6585; H01R 25/006; H01R 43/20; H01R 12/57; H01R 12/737; H01R 12/75; H01R 12/88; H01R 13/6594; H01R 12/58; H01R 12/585; H01R 12/596; H01R 12/7005; H01R 12/707; H01R 12/7076; H01R 12/774; H01R 13/05; H01R 13/2407; H01R 13/428; H01R 13/642; H01R 13/646; H01R 13/6461; H01R 13/6582; H01R 13/6583; H01R 13/6587; H01R 13/6597; H01R 13/6598; H01R 13/6599; H01R 13/6658; H01R 13/7175; H01R 24/62; H01R 24/64; H01R 27/00; H01R 29/00; H01R 31/08; H01R 43/24; H01R 4/023; H01R 4/028; H01R 11/03; H01R 12/00; H01R 12/52; H01R 12/526; H01R 12/53; H01R 12/62; H01R 12/7011; H01R 12/7082; H01R 12/71; H01R 12/724; H01R 12/727; H01R 12/732; H01R 12/77; H01R 12/775; H01R 12/78; H01R 13/03; H01R 13/113; H01R 13/20; H01R 13/22; H01R 13/24; H01R 13/2421; H01R 13/2442; H01R 13/26; H01R 13/28; H01R 13/4223; H01R 13/424; H01R 13/4367; H01R 13/506; H01R 13/508; H01R 13/516; H01R 13/518; H01R 13/5216; H01R 13/5219; H01R 13/567; H01R 13/5833; H01R 13/6205; H01R 13/6273; H01R 13/6278; H01R 13/629; H01R 13/631; H01R 13/6335; H01R 13/635; H01R 13/639; H01R 13/6469; H01R 13/6473; H01R 13/6474; H01R 13/6477; H01R 13/6485; H01R 13/652; H01R 13/6584; H01R 13/6586; H01R 13/6588; H01R 13/659; H01R 13/665; H01R 13/6675; H01R 13/6683; H01R 13/703; H01R 13/7039; H01R 13/7135; H01R 13/72; H01R 13/74; H01R 2201/16; H01R 24/22; H01R 24/58; H01R 24/68; H01R 24/78; H01R 25/003; H01R 27/02; H01R 31/005; H01R 31/06; H01R 33/94; H01R 33/945; H01R 33/955; H01R 35/04; H01R 39/00; H01R 39/12; H01R 39/383; H01R 39/643; H01R 43/02; H01R 43/0207; H01R 43/0256; H01R 43/16; H01R 43/205; H01R 43/26; H01R 9/05; H01R 9/0515; H01R 9/2416
See application file for complete search history.

(56) References Cited

U.S. PATENT DOCUMENTS

D451,884 S 12/2001 Hisatomi et al.
6,361,373 B1 3/2002 Horchler
6,554,637 B1 4/2003 Yu
6,589,077 B1 7/2003 Wu
D485,532 S 1/2004 Lai
6,699,049 B1 * 3/2004 Wu ..... H01R 12/725 439/924.1
6,827,605 B2 12/2004 Wu
D506,442 S 6/2005 Obikane et al.
D506,730 S 6/2005 Ura
6,969,286 B1 11/2005 Mongold et al.
D512,379 S 12/2005 Shimizu et al.
D512,380 S 12/2005 Shimizu et al.
6,979,238 B1 12/2005 Mongold et al.
7,029,330 B1 4/2006 Ro
7,052,337 B2 5/2006 Mongold et al.
7,270,570 B1 9/2007 Hamner et al.
7,452,238 B1 * 11/2008 Wu ..... H01R 12/592 439/942
D582,859 S 12/2008 Sasaki
D582,860 S 12/2008 Sasaki
7,473,133 B1 * 1/2009 Zhang ..... H01R 13/6473 439/79
D598,861 S 8/2009 Hoshino et al.
D617,282 S 6/2010 Tung et al.
7,794,240 B2 9/2010 Cohen et al.
7,837,522 B1 11/2010 Hoover et al.
D635,516 S 4/2011 Faith
D635,517 S 4/2011 Faith
D642,530 S 8/2011 Sato et al.
D659,646 S 5/2012 Kajiura et al.
D678,843 S 3/2013 Faith
8,727,815 B1 5/2014 Mongold et al.
D708,580 S 7/2014 McCartin et al.
8,784,116 B2 7/2014 Buck et al.
D710,310 S 8/2014 McCartin et al.
8,814,602 B2 8/2014 Mongold
D718,245 S 11/2014 Sato
D733,659 S 7/2015 Zhu
9,300,103 B2 3/2016 Buck et al.
D790,471 S 6/2017 Buck et al.
2004/0097128 A1 5/2004 Wu
2005/0032400 A1 2/2005 Zhang et al.
2006/0019538 A1 * 1/2006 Davis ..... H01R 13/6471 439/607.11
2007/0202729 A1 8/2007 Uesaka
2008/0182459 A1 7/2008 Fedder et al.
2008/0305690 A1 * 12/2008 Zhang ..... H01R 12/716 439/638
2009/0239421 A1 9/2009 Fukazawa et al.
2009/0264019 A1 10/2009 Sakamoto
2010/0048067 A1 2/2010 Johnescu
2010/0173507 A1 7/2010 Vicich et al.
2012/0003875 A1 1/2012 Akai et al.
2012/0077389 A1 3/2012 Zhang et al.
2012/0108109 A1 * 5/2012 Zhang ..... H01R 12/721 439/629
2012/0225588 A1 * 9/2012 Westman ..... H05K 1/117 439/636
2012/0238145 A1 9/2012 Zhang et al.
2012/0252232 A1 * 10/2012 Buck ..... H01R 13/6461 439/55
2013/0005192 A1 1/2013 Lim

(56) References Cited

U.S. PATENT DOCUMENTS

| | | | |
|---|---|---|---|
| 2014/0310957 | A1 | 10/2014 | Buck et al. |
| 2014/0315442 | A1 | 10/2014 | Liu et al. |
| 2015/0038018 | A1 | 2/2015 | Matsuzawa |
| 2015/0044914 | A1 | 2/2015 | Kimura |
| 2015/0200503 | A1 | 7/2015 | Hsiao et al. |
| 2016/0248190 | A1 | 8/2016 | Matsuyama |
| 2016/0254619 | A1 | 9/2016 | Toda |
| 2018/0013240 | A1* | 1/2018 | Takeuchi ..... H01R 13/6594 |
| 2018/0034175 | A1* | 2/2018 | Lloyd ..... H01R 24/60 |
| 2018/0198220 | A1 | 7/2018 | Sasame et al. |
| 2020/0083642 | A1 | 3/2020 | Chen |
| 2020/0112113 | A1 | 4/2020 | Aoki et al. |
| 2021/0036452 | A1 | 2/2021 | Phillips et al. |

FOREIGN PATENT DOCUMENTS

| | | | |
|---|---|---|---|
| CN | 2624456 | Y | 7/2004 |
| CN | 101567496 | A | 10/2009 |
| CN | 101622914 | A | 1/2010 |
| CN | 201570632 | U | 9/2010 |
| CN | 101926052 | A | 12/2010 |
| CN | 201956472 | U | 8/2011 |
| CN | 102195177 | A | 9/2011 |
| CN | 301794291 | S | 1/2012 |
| CN | 202840016 | U | 3/2013 |
| CN | 203367548 | U | 12/2013 |
| CN | 203747161 | U | 7/2014 |
| CN | 304482508 | S | 1/2018 |
| CN | 304493773 | | 2/2018 |
| DE | 3014875 | A1 | 10/1981 |
| GB | 1418031 | A | 12/1975 |
| KR | 10-1185502 | B1 | 9/2012 |
| KR | 30-0748546 | | 6/2014 |
| KR | 30-0775444 | | 12/2014 |
| KR | 30-0856264 | | 5/2016 |
| TW | D149636 | | 10/2012 |
| TW | D151642 | | 2/2013 |
| TW | D151999 | | 2/2013 |
| TW | D157156 | | 11/2013 |
| TW | D159829 | | 4/2014 |
| TW | D167749 | | 5/2015 |
| TW | D171256 | | 10/2015 |
| TW | D172199 | | 12/2015 |
| TW | D172409 | | 12/2015 |
| WO | 2008/017717 | A1 | 2/2008 |
| WO | 2012/138519 | A2 | 10/2012 |
| WO | 2015/068467 | A1 | 5/2015 |

OTHER PUBLICATIONS

Samtec, 0.8MM Edge Rate Terminal Assembly, ERM8-XXX-XXX-XXX-DV-XXXX-XX, By: Knowlden, dated Sep. 27, 2005, 7 sheets.

Samtec, .050 Pitch Socket Array Assembly, Seaf-XX-XX.X-XX-XX-X-A-XX-K-TR, By: Bratcher, May 27, 2004, 5 sheets.

Samtec, .050 Pitch Terminal Array Assembly, SEAM-XX-XX.X-XX-XX-X-A-XX-K-TR, By: Bratcher, Aug. 9, 2010, 7 sheets.

Taiwanese Patent Application No. 107303227: Notice of Allowance dated Oct. 30, 2018, 4 pages.

* cited by examiner

ELECTRICAL CONTACTS HAVING ANCHORING REGIONS WITH IMPROVED IMPEDANCE CHARACTERISTICS

CROSS-REFERENCE TO RELATED APPLICATIONS

This application is the National Stage Application of International Patent Application No. PCT/US2017/048217, filed Aug. 23, 2017, which claims priority to U.S. Provisional Patent Application No. 62/378,313, filed Aug. 23, 2016, U.S. Provisional Patent Application Ser. No. 62/402,482, filed Sep. 30, 2016, and U.S. Provisional Patent Application Ser. No. 62/402,726, filed Sep. 30, 2016, the contents of all of which are hereby incorporated by reference as if set forth in their entirety herein.

BACKGROUND

Electrical connector systems generally include circuits and components on one or more interconnected circuit boards. Examples of circuit boards in an electrical connector system can include daughter boards, motherboards, backplane boards, midplane boards, or the like. Electrical assemblies can further include one or more electrical connectors that provide an interface between electrical components, and provides electrically conductive paths for electrical communications data signals and/or electrical power so as to place the electrical components in electrical communication with each other.

For instance, a conventional electrical connector system can include an electrical card-edge connector that is electrically connected between a printed circuit board (PCB) and an edge card. The card-edge connector has a mating end that defines a slot that receives an edge of the edge card and a mounting end that mounts onto the PCB. The card-edge connector provides an electrically conductive path between traces proximate to the edge of the edge card and traces on the PCB. Such a configuration may be well suited for an electrical connector system in an enclosure, such as a rack-mount server.

As another example, a conventional electrical connector system can include mezzanine connectors that place a first substrate that can be a printed circuit board (PCB) into electrical communication with a second substrate that can also be a PCB. The electrical connector system can include first and second electrical connectors that mate with one another. The first electrical connector includes a first dielectric connector housing and a first plurality of contacts supported by the first connector housing. The first electrical connector defines a first mounting interface that mounts onto the first substrate, and a first mating interface that mates the second electrical connector. The second electrical connector includes a second dielectric connector housing and a second plurality of contacts supported by the second connector housing. The second electrical connector defines a second mounting interface that mounts onto the second substrate, and a second mating interface that mates the first electrical connector at the first mating interface. When mated, the connectors provide an electrically conductive path between traces carried by the first substrate and traces carried by the second substrate.

SUMMARY

In one example embodiment, an electrical contact for an electrical connector comprises a body having a mounting end and a mating end, an elongate contact beam, and an anchoring region. The contact beam defines the mating end and is configured to contact a complementary electrical component when the complementary electrical component is mated with the electrical connector at the mating end. The contact beam includes first and second edges that are spaced opposite from one another along a lateral direction, and that extend between the mounting and mating ends. The contact beam further includes first and second broadsides that are spaced opposite from one another, and that extend between the mounting and mating ends and between the first and second edges. Each broadside has a width along the lateral direction, the width being greater than a thickness of each of the first and second edges along a transverse direction, perpendicular to the lateral direction. The anchoring region is configured to retain the electrical contact in a housing of an electrical connector. The anchoring region includes a first portion, a second portion, an intermediate portion, and at least one retention feature. The first portion extends from the contact beam towards the mounting end, and has a first side that is spaced outwards from the first edge with respect to the lateral direction. The second portion extends from the mounting end towards the first portion, and has a first side that is spaced outwards from the first edge with respect to the lateral direction. The intermediate portion extends between the first portion and the second portion, and has a first side that is recessed inwards from the first sides of the first and second portions with respect to the lateral direction. The at least one retention feature is configured to extend outward from the body along a perpendicular direction that is perpendicular to the lateral direction.

In another example embodiment, an electrical contact for an electrical connector comprises a body having a mounting end and a mating end, an elongate contact beam, and an anchoring region. The contact beam defines the mating end and is configured to contact a complementary electrical component when the complementary electrical component is mated with the electrical connector at the mating end. The contact beam includes first and second edges that are spaced opposite from one another along a lateral direction, and that extend between the mounting and mating ends. The contact beam further includes first and second broadsides that are spaced opposite from one another, and that extend between the mounting and mating ends and between the first and second edges. Each broadside has a width along the lateral direction, the width being greater than a thickness of each of the first and second edges along a transverse direction, perpendicular to the lateral direction. The contact beam further includes a first beam portion that extends along a central axis, and a second beam portion that extends from the first beam portion to a free end of the contact beam along a direction that is angularly offset from the central axis with respect to the lateral direction. The anchoring region is configured to retain the electrical contact in a housing of an electrical connector. The anchoring region includes a first portion, a second portion, and an intermediate portion. The first portion extends from the contact beam towards the mounting end, and has a first side that is spaced outwards from the first edge with respect to the lateral direction. The second portion extends from the mounting end towards the first portion, and has a first side that is spaced outwards from the first edge with respect to the lateral direction. The intermediate portion extends between the first portion and the second portion, and has a first side that is recessed inwards from the first sides of the first and second portions with respect to the lateral direction.

In another example embodiment, an electrical contact for an electrical connector comprises a body having a mounting end and a mating end, an elongate contact beam, and an anchoring region. The contact beam defines the mating end and is configured to contact a complementary electrical component when the complementary electrical component is mated with the electrical connector at the mating end. The contact beam includes first and second edges that are spaced opposite from one another along a lateral direction, and that extend between the mounting and mating ends. The contact beam further includes first and second broadsides that are spaced opposite from one another, and that extend between the mounting and mating ends and between the first and second edges. Each broadside has a width along the lateral direction, the width being greater than a thickness of each of the first and second edges along a transverse direction, perpendicular to the lateral direction. The anchoring region is configured to retain the electrical contact in a housing of an electrical connector. The anchoring region includes a first portion, a second portion, and an intermediate portion. The first portion extends from the contact beam towards the mounting end, has a first side that is spaced outwards from the first edge with respect to the lateral direction, and has a second side that is aligned with or recessed inwards from the second edge with respect to the lateral direction. The second portion extends from the mounting end towards the first portion, has a first side that is spaced outwards from the first edge with respect to the lateral direction, and has a second side that is aligned with or recessed inwards from the second edge with respect to the lateral direction. The intermediate portion extends between the first portion and the second portion, has a first side that is recessed inwards from the first sides of the first and second portions with respect to the lateral direction, and has a second side that is aligned with or recessed inwards from the second edge with respect to the lateral direction.

In another example embodiment, an electrical connector comprises a connector housing and first, second, third, and fourth electrical contacts. Each contact comprises a body, an elongate contact beam, and an anchoring region. The body has a mounting end and a mating end. The contact beam defines the mating end and is configured to contact a complementary electrical component when the complementary electrical component is mated with the electrical connector at the mating end. The contact beam includes first and second edges that are spaced opposite from one another along a lateral direction, and that extend between the mounting and mating ends. The contact beam further includes first and second broadsides that are spaced opposite from one another, and that extend between the mounting and mating ends and between the first and second edges. Each broadside has a width along the lateral direction, the width being greater than a thickness of each of the first and second edges along a transverse direction, perpendicular to the lateral direction. The anchoring region is configured to retain the electrical contact in the connector housing. The anchoring region includes a first portion, a second portion, and an intermediate portion. The first portion extends from the contact beam towards the mounting end, and has a first side that is spaced outwards from the first edge with respect to the lateral direction. The first portion has a first center. The second portion extends from the mounting end towards the first portion, and has a first side that is spaced outwards from the first edge with respect to the lateral direction. The second portion has a second center. The intermediate portion extends between the first portion and the second portion, and has a first side that is recessed inwards from the first sides of the first and second portions with respect to the lateral direction. The first to fourth electrical contacts are supported by the connector housing such that the first and third electrical contacts are between the second and fourth electrical contacts. The centers of the first portions of the first and third electrical contacts are aligned along a first line that extends substantially along the lateral direction, and the centers of the first portions of the second and fourth electrical contacts are aligned along a second line that extends substantially along the lateral direction. The second line is offset from the first line along the longitudinal direction.

BRIEF DESCRIPTION OF THE DRAWINGS

The foregoing summary, as well as the following detailed description of embodiments of the application, will be better understood when read in conjunction with the appended drawings. For the purposes of illustrating the methods and devices of the present application, there is shown in the drawings representative embodiments. It should be understood, however, that the application is not limited to the precise methods and devices shown. In the drawings.

DETAILED DESCRIPTION

Figure 2:
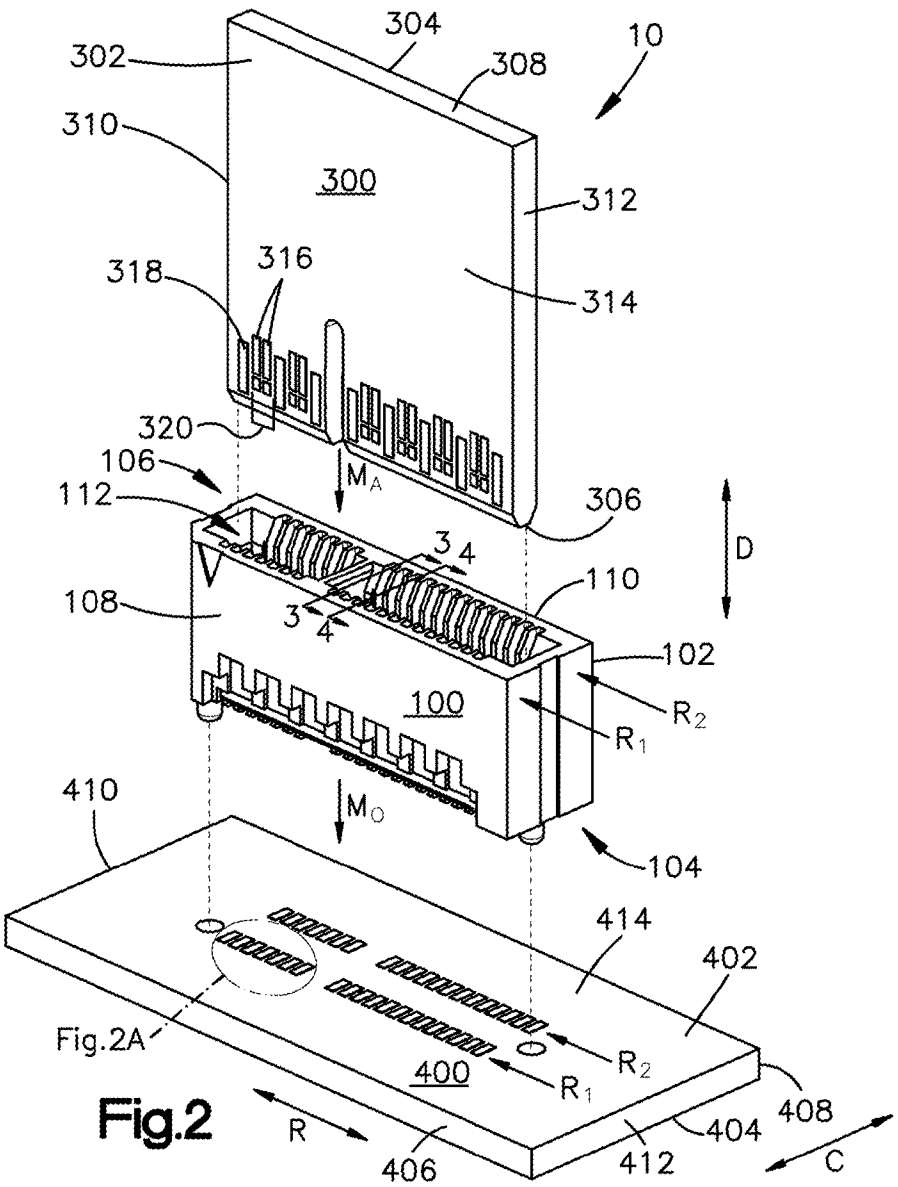
FIG. 2 shows an exploded perspective view of the electrical connector system of FIG. 1.
Figure 1:
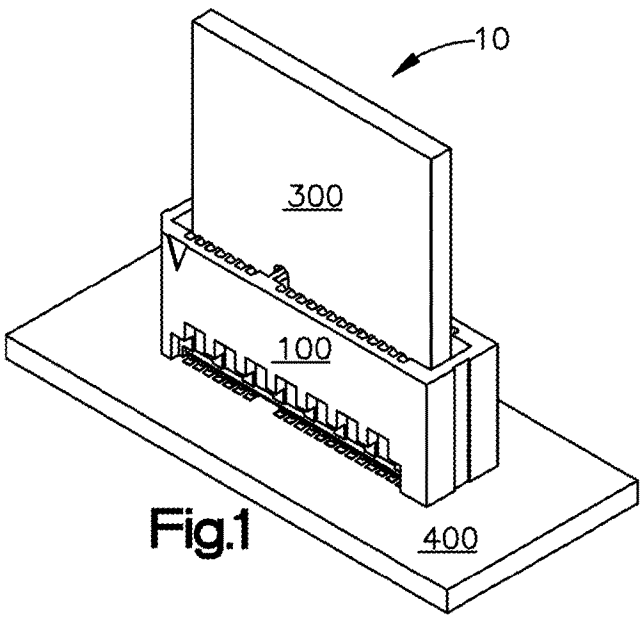
FIG. 1 shows a perspective view of an electrical connector system according to one embodiment having a first complementary electrical component, an electrical connector mounted onto the first complementary electrical component, and a second complementary electrical component mated with the electrical connector.
Figure 2A:
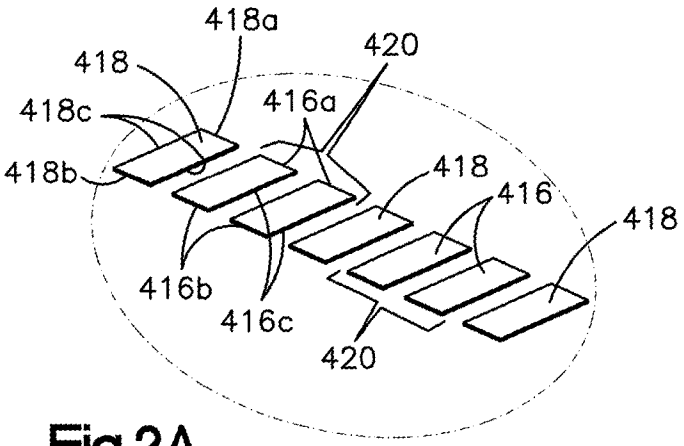
FIG. 2A shows an enlarged view of some of the contacts of the second complementary connector 400 of FIG. 1.
Figure 3:
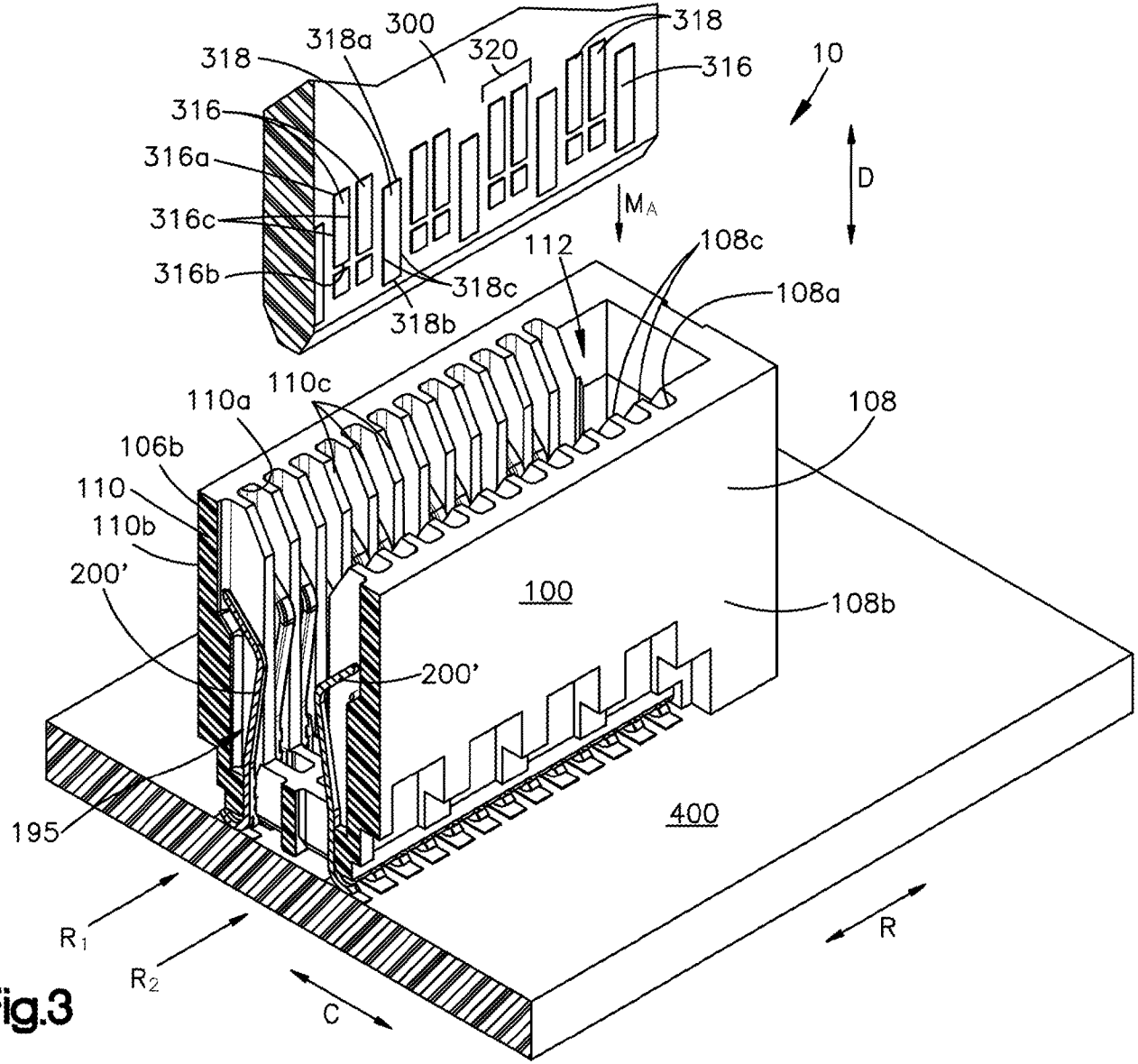
FIG. 3 shows a perspective section view of the electrical connector system of FIG. 1 taken at line 3-3.
Figure 4:
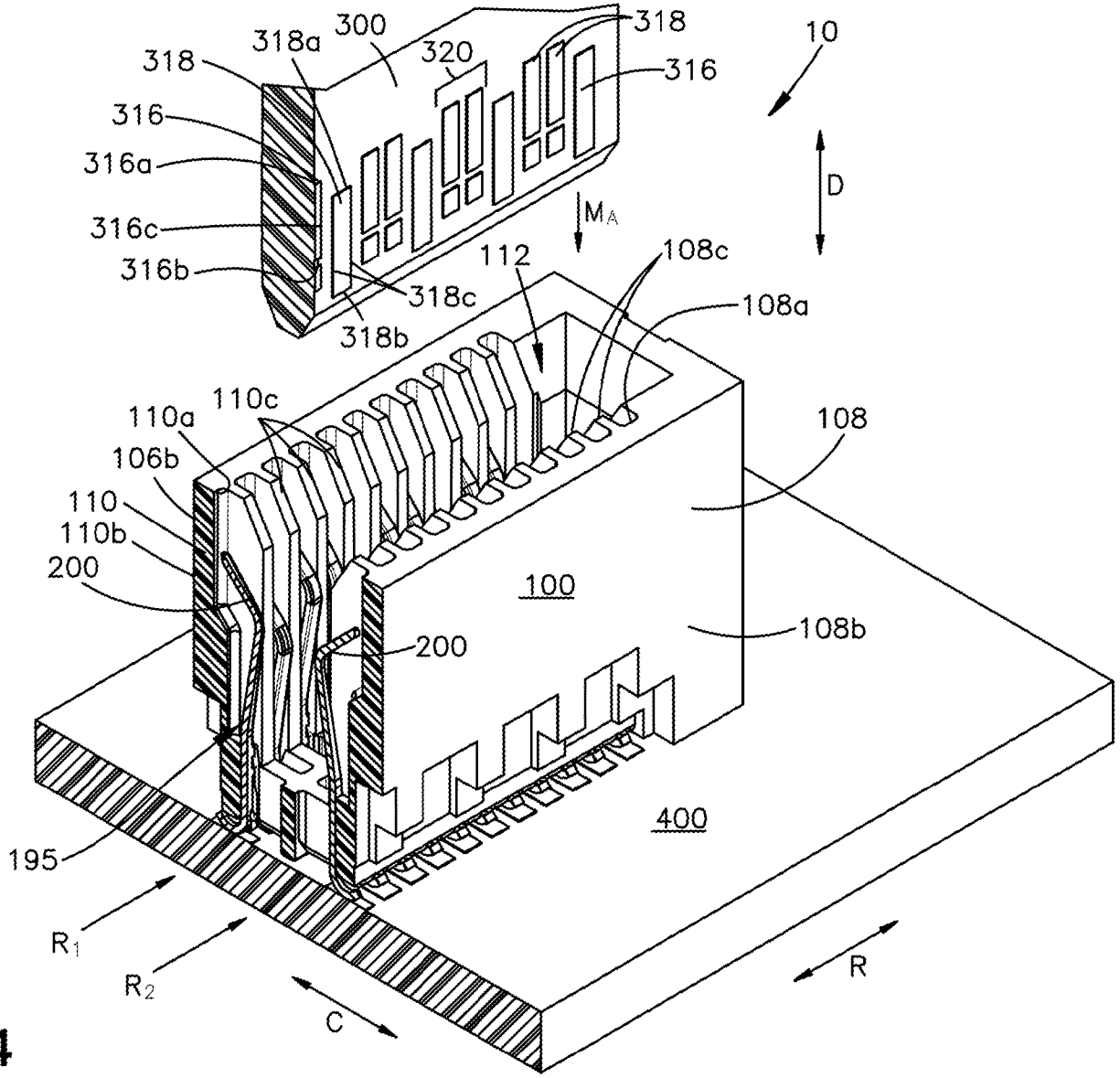
FIG. 4 shows a perspective section view of the electrical connector system of FIG. 1 taken at line 4-4.
Figure 5:
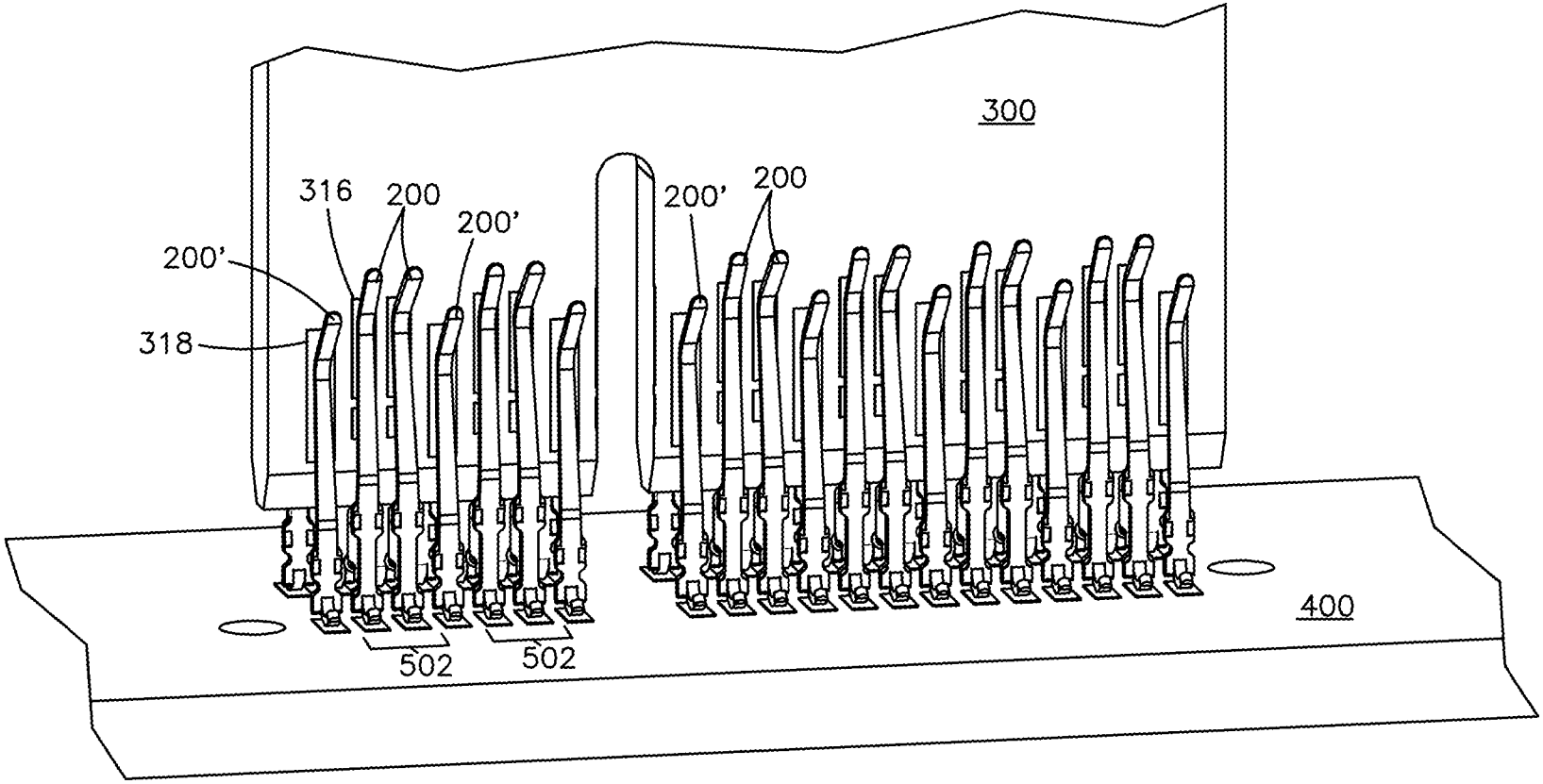
FIG. 5 shows a perspective view of the system of FIG. 1 with the body of the electrical connector removed.

In electrical connector systems, impedance mismatch between an electrical connector and a complementary electrical component coupled to the electrical connector can lead to signal reflections that adversely affect the performance of the system. Therefore, one consideration when designing an electrical connector is to match the impedance of the electrical connector with the complementary component. This disclosure relates to electrical contact configurations and arrangements that can be used to improve impedance matching in electrical connectors.

Referring to FIGS. 1 to 5, an electrical connector system 10 includes an electrical connector 100, a first complementary electrical component 300, and a second complementary electrical component 400. The first complementary electrical component 300 can be configured as a first substrate, such as a first printed circuit board (PCB). Similarly, the second electrical component 400 can be a second substrate, such as a second printed circuit board. The electrical connector 100 is configured to be placed in electrical communication with each of the first and second electrical components 300 and 400. For instance, the first electrical component 300 can define an edge card that is configured to be received by the electrical connector 100 along a longitudinal direction L so as to mate the electrical connector 100 with the first electrical component. The electrical connector 100 can be mounted to the second electrical component 400. It is thus appreciated that the electrical connector can be configured to electrically couple the first and second complementary electrical components 300 and 400 to one another. Accordingly, the electrical connector 100 provides an electrically conductive path between the first and second electrical components 300 and 400, such as from at least one of the first and second complementary electrical components 300 and 400 to the other of the first and second complementary electrical components 300 and 400.

The electrical connector 100 includes a dielectric or electrically insulative connector housing 102 and a plurality of electrical contacts 195 that are supported by the connector housing 102. For instance, the electrical contacts 195 can be arranged in at least one row that is oriented along a row direction R. In one example, the electrical contacts 195 can be supported by the connector housing 102 in at least first and second rows $R_1$ and $R_2$ that are spaced apart from one another along a column direction C so as to define an insertion slot 112 between the first and second rows $R_1$ and $R_2$. The rows can be oriented along a lateral direction A that is substantially perpendicular to the longitudinal direction L. The column direction C can be oriented along a direction that is perpendicular to each of the lateral direction A and the longitudinal direction L. For instance, the column direction C can be oriented along a transverse direction T. Each of the at least one row of electrical contacts can include a first plurality of electrical contacts 200 supported by the housing 102, and a second plurality of electrical contacts 200' supported by the housing 102.

Figure 6:
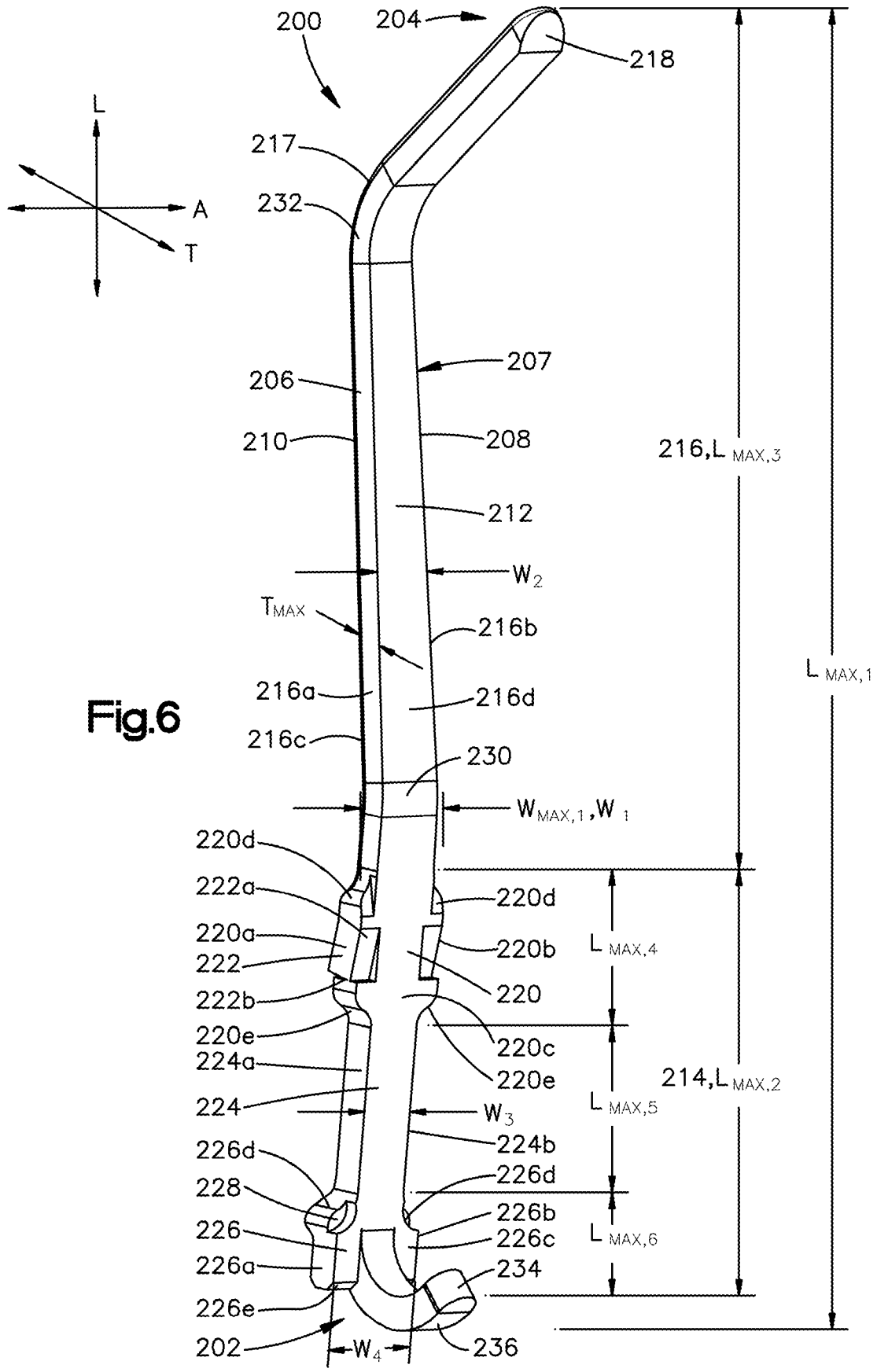
FIG. 6 shows a perspective view of an embodiment of a first electrical contact.
Figure 7:
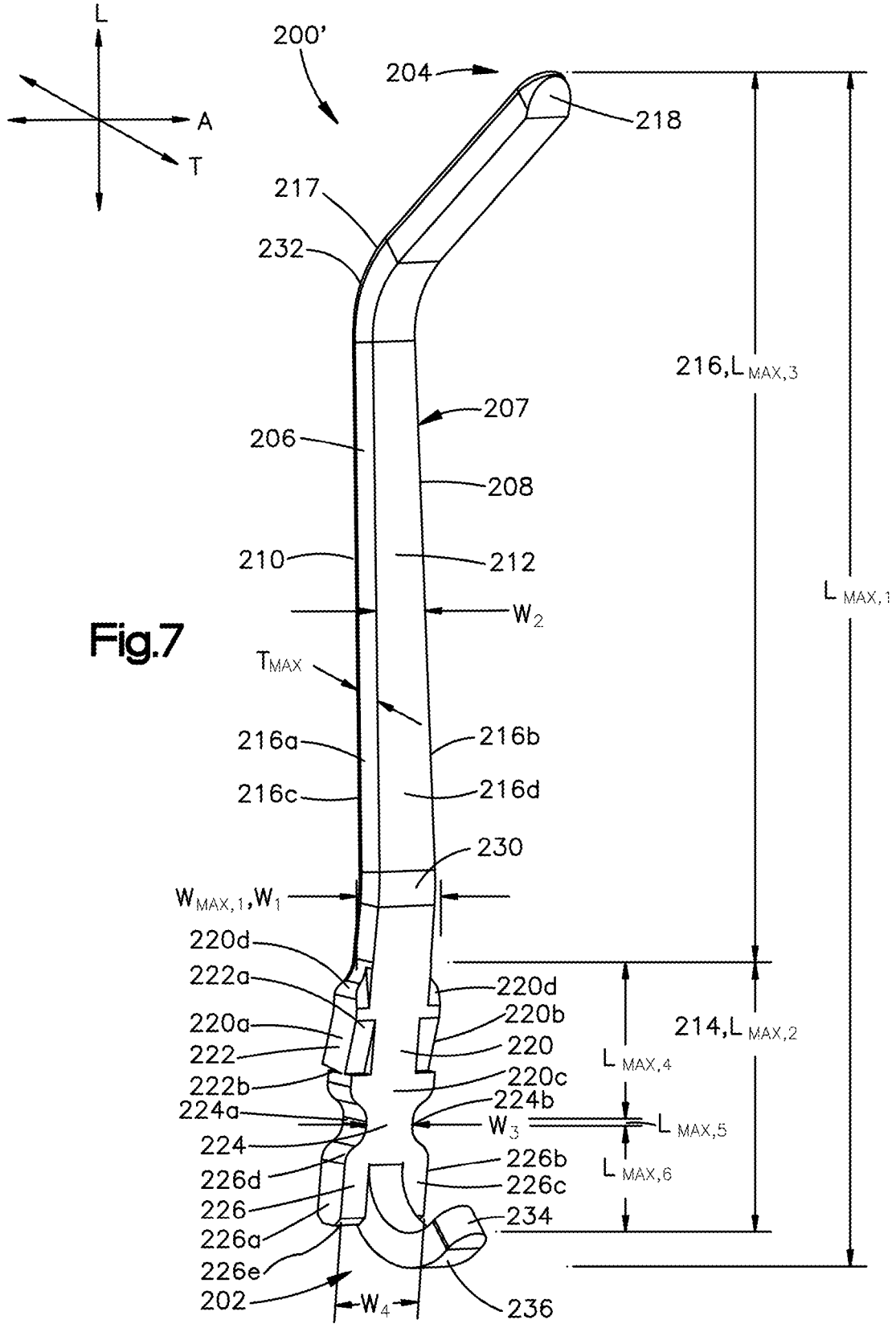
FIG. 7 shows a perspective view of an embodiment of a second electrical contact.

Turning now to FIGS. 6 and 7, and as will be described in more detail below, the first and second electrical contacts 200 and 200' each have respective mating ends that are configured to mate with the first complementary electrical component 300, and mounting ends that are configured to be mounted to the second complementary electrical component 400. However, the first and second electrical contacts 200 and 200' can have at least one or both of a different shape and a different size with respect to each other. Unless otherwise indicated, the following description of the first electrical contacts 200 will apply equally to the second electrical contact 200'.

The first electrical contacts 200 can each include a mounting end 202, and a mating end 204 opposite the mounting end 202 along the longitudinal direction L. The mounting end 202 is configured to be mounted onto, for example, the second complementary electrical component 400 along a mounting direction. The mating end 204 is configured to mate with, for example, the first complementary electrical component 300 along a mating direction. In one example, the mating direction and mounting direction can be oriented along the same direction. For instance, the mating direction and mounting direction can be oriented along the longitudinal direction L. Thus, the electrical contact 200 is considered to be a vertical electrical contact. Alternatively, the electrical contact 200 can be configured as a right-angle contact, whereby the mating direction and the mounting direction are oriented substantially perpendicular to each other. For instance, when the electrical contact 200 is configured as a right-angle contact the mating end 204 can be oriented along the longitudinal direction L, and the mounting end 202 can be oriented along the transverse direction T.

The electrical contact 200 includes a contact body 207 that defines first and second edges 206 and 208, and first and second broadsides 210 and 212. The first and second edges 206 and 208 are spaced opposite from one another along the lateral direction A. Thus, the first and second edges 206 and 208 can face away from one another. At least respective portions of the first and second broadsides can be spaced opposite each other along the transverse direction T. Thus, the first and second broadsides 210 and 212 can face away from one another. It should therefore be appreciated that each of the first and second edges 206 and 208 are connected between the first and second broadsides 210 and 212. Similarly, each of the first and second broadsides 210 and 212 are connected between the first and second edges 206 and 208. The edges 206 and 208 and broadsides 210 and 212 can define respective distances along a plane that is oriented normal to the contact body 207. For instance, the edges 206 and 208 can each extend along a first distance from one of the first and second broadsides 210 and 212 to the other of the first and second broadsides 210 and 212 along the plane. The broadsides 210 and 212 can each extend along a second distance from one of the first and second edges 206 and 208 to the other of the first and second edges 206 and 208 along the plane. The second distance can be greater than the first distance. In one example, the first distance can define a thickness of the contact body 207, and the second distance can define a width of the contact body 207. The thickness along at least a portion of the contact body 207 can be oriented along the transverse direction T, and the width along at least a portion of the contact body 207 can be oriented along the lateral direction A.

The electrical contact 200 includes an anchoring region 214 that is configured to secure the electrical contact 200 to the connector housing 102 of the electrical connector 100. The electrical contact 200 further includes a contact beam 216 that extends out with respect to the anchoring region 214. For instance, the contact beam 216 can extend out with respect to the anchoring region 214 along the longitudinal direction L. In one example, the contact beam 216 can extend from the anchoring region 214.

The contact beam 216 has first and second sides 216*a* and 216*b*, and first and second faces 216*c* and 216*d*. The first and second sides 216*a* and 216*b* of the contact beam 216 are defined by the first and second edges 206 and 208, respectively, of the contact body 207. Similarly, the first and second faces 216*c* and 216*d* of the contact beam 216 are defined by the first and second broadsides 210 and 212, respectively, of the contact body 207. The contact beam 216 can define a mating portion 217 that is configured to mate with the first complementary electrical component 300, and a stub 219 that extends from the mating portion 217 to the free end 218. The contact beam has a first beam portion that extends along a central axis CA, and a second beam portion that extends from the first beam portion towards the free end 218 of the contact beam 216 along a direction that is angularly offset from the central axis with respect to the lateral direction A.

The anchoring region 214 extends between the mounting end 202 and the contact beam 216. For instance, the anchoring region 214 can extend from the mounting end 202 to the contact beam 216. The anchoring region 214 can define a maximum length $L_{max,2}$. Further, the anchoring region 214 can be disposed partially or fully below a midpoint of the electrical contact 200 along the longitudinal direction L. The contact beam 216 extends between a free end 218 of the electrical contact 218 and the anchoring region 214, such as from the free end 218 to the anchoring region 214, and has a maximum length $L_{max,3}$. One or more up to all of the maximum lengths of the first electrical contact 200' can be different than the corresponding one or more up to all of the maximum lengths of the second electrical contact 200' (FIG. 7) as described in further detail below.

The anchoring region 214 can be substantially planar as it extends from the mounting end 202 to the contact beam 216 along the longitudinal direction L. For instance, the broadsides 210 and 212 can be substantially planar along respective planes that are defined by the longitudinal direction L and the lateral direction A at the anchoring region 214 from the mounting end 212 to the contact beam 216. Similarly, the edges 206 and 208 can be substantially planar along respective planes that are defined by the longitudinal direction L and the transverse direction at the anchoring region 214 from the mounting end 212 to the contact beam 216. Alternatively, the anchoring region 214 can have a bent, such as a curved, shape between the mounting end 202 and the contact beam 216.

The anchoring region 214 can include at least one of first portion, a second portion, and a third portion. The third portion can disposed between the first and second portions, and thus can be considered to be an intermediate portion. The intermediate portion can define a width along the lateral direction A that is less than the width of at least one or both of the first and second portions along the lateral direction A. Thus, the intermediate portion can also be considered a narrowed portion, and one or both of the first and second portions can be considered enlarged portions. In one example, one or both of the first and second portions can extend out from the contact body 207. For instance, at least one of the first and second portions can extend out from one or both of the edges 206 and 208 along the lateral direction A. In one example, the anchoring region 214 can include a first portion 220, an intermediate portion 224, and a second portion 226. The intermediate portion 224 can be disposed between the first and second portions 220 and 226. In one example, the intermediate portion 224 can be defined by one or both of the edges 206 and 208 of the contact body 207.

The first portion 200 can define opposed outermost sides 220*a* and 220*b*. The outermost sides 220*a* and 220*b* can be spaced from each other along the lateral direction A. The outermost sides 220*a* and 220*b* can be outwardly spaced from the respective first and second edges 206 and 208 along the lateral direction A. The first portion 220 can have a width $W_1$ along the lateral direction A from the first outermost side 220*a* to the second outermost side 220*b*, the width $W_1$ being greater than the width $W_2$ of the broadsides 210 and 212 from the first edge 206 to the second edge 208. The first portion 220 can extend between the contact beam 216 and the mounting end 202, such as from the contact beam 216 towards the mounting end 202. The first portion 220 can have a substantially rectangular shape in a plane defined by the longitudinal and lateral directions as shown, or can have any other suitable shape in the plane such as a circle, square, or other polygon. Further, the first portion 220 has a maximum length $L_{max,4}$. While the outermost sides 220*a* and 220*b* of the first portion 220 be spaced outwardly from the respective edges 206 and 208 with respect to the lateral direction A as described above, it should be appreciated that one or both of the outermost sides 220*a* and 220*b* can be continuous or in-line with the respective first and second edges 206 and 208 as desired.

The first portion 220 can extend out from at least one of the edges 206 and 208 along the lateral direction A. For instance, the first portion 220 can extend out from both edges 206 and 208 of the contact beam 216. Further portion 220 can be coplanar with the broadsides 210 and 212. In alternative embodiments, the portion 220 can extend out from only one of the first and second edges 206 and 208 along the lateral direction A. For example, one of the outermost sides 220*a* and 220*b* of the first portion 220 can be spaced outward from a corresponding one of the first and second edges 206 and 208 with respect to the lateral direction A, and the other of the sides 220*a* and 220*b* of the first portion 220 can be flush or aligned with a corresponding one of the first and second edges 206 and 208 of the contact beam 216.

The first portion 220 can define a body 220*c* and at least one shoulder, such as a first upper shoulder 220*d* that extends from the body 220*c* to the contact body 207, and in particular to one of the first and second edges 206 and 208. The first portion 220 can also define a second upper shoulder 220*d* that extends from the body 220*c* to the contact body 207 and in particular to the other one of the first and second edges 206 and 208. It should be appreciated that one or both of the first and second upper shoulders 220*d* can be omitted in some embodiments. Each upper shoulder 220*d* can extend from the portion 220 to the contact body 207 along a direction having a directional component along the lateral direction A.

The first portion 220 can include at least one retention feature, such as two retention features 222 that are configured to engage the connector housing 102 so as to secure the electrical contact 200 to the connector housing 102. For example, each retention feature 222 can define a barb having a first barb end 222*a* that is attached to the body 207, such as the body 220*c* of the first portion 220, in a hinged manner. As will be described below, in alternative embodiments, the retention feature can be included in a portion of the anchoring region, other than the first portion 220. Each retention feature 222 can further include a second, or free, barb end 222*b* that is opposite the first barb end 222*a* and is free from attachment to the body 220*c* of the first portion 220. As shown, the second barb end 222*b* can be spaced from the first barb end 222*a* along the longitudinal direction L, and the hinge can be configured to bend about an axis that extends along the lateral direction A so as to offset the second barb end 222*b* from the first barb end 222*a* along the transverse direction. Alternatively, the second barb end 222*b* can be spaced from the first barb end 222*a* along the lateral direction A, and the hinge can be configured to bend about an axis that extends along the longitudinal direction L so as to offset the second barb end 222*b* from the first barb end 222*a* along the transverse direction. Note that, in alternative embodiments, the at least one retention feature 222 can define a feature other than a barb, such as (without limitation) a fixed protrusion, or a recess that receives a protrusion on the connector housing 102, or the at least one retention feature 222 can be omitted altogether.

The intermediate portion 224 can define opposed outermost sides 224*a* and 224*b*. The outermost sides 224*a* and 224*b* can be spaced from each other along the lateral direction A. In one example, the intermediate portion defines a width $W_3$ from one of the outermost sides 224*a* and 224*b* to the other of the outermost sides 224*a* and 224*b*. The width $W_3$ of the intermediate portion 224 can be less than the corresponding width of one or both of the portions 220 and 226. For instance, the width $W_3$ of the intermediate portion 224 can be less than the width of the broadsides 210 and 212 from one of the edges 206 and 208 to the other of the edges 206 and 208. Alternatively, the width $W_3$ of the intermediate portion 224 can be greater than the width of the broadsides 210 and 212. Alternatively still, the outermost sides 224*a* and 224*b* can be defined by the first and second edges 206 and 208, respectively. Thus, the width $W_3$ of the intermediate portion 224 can be substantially equal to the width of the broadsides 210 and 212.

The intermediate portion 224 can extend between the first portion 220 and the mounting end 202 along the longitudinal direction L. For instance, the intermediate portion 224 can extend from the first portion 220 toward the mounting end 202. The intermediate portion 224 can define a maximum length $L_{max,5}$ along the longitudinal direction L. The intermediate portion 224 can have a substantially rectangular shape in a plane defined by the longitudinal and lateral directions as shown, or can have any other suitable shape in the plane such as a circle, square, or other polygon. Further, the first outermost side 224*a* can be linear as it extends from the first portion 220 towards the mounting end 202. Similarly, the second outermost side 224*b* can be linear as it extends from the first portion 220 towards the mounting end 202. As shown, the intermediate portion 224 of the electrical connector 200 in FIG. 6 can be elongate along the longitudinal direction L as it extends between the first portion 220 and the mounting end 202, such that the maximum length $L_{max,5}$ of the intermediate portion 224 is greater than each of the width $W_3$ of the intermediate portion 224 along the lateral direction and the thickness of the intermediate portion 224 along the transverse direction T. Further, the intermediate portion 224 of the electrical connector 200' in FIG. 7 can be shortened, such that the maximum length $L_{max,5}$ of the intermediate portion 224 is less than or equal to one or more of the width $W_3$ of the intermediate portion 224 and the thickness of the intermediate portion 224, or can be eliminated altogether.

The first portion 220 can define at least one lower shoulder, such as a first lower shoulder 220*e* that extends from the body 220*c* of the first portion 220 to the intermediate portion 224. For instance, the first lower shoulder 220*e* can extend from one of the outermost sides 220*a* and 220*b* to a corresponding one of the outermost sides 224*a* and 224*b*. The first portion 220 can also define a second lower shoulder 220*e* that extends from the body 220*c* to the intermediate portion 224. For instance, the second lower shoulder 220*e* can extend the other of the outermost sides 220*a* and 220*b* to the corresponding other of the outermost sides 224*a* and 224*b*. It should be appreciated that one or both of the first and second lower shoulders 220*e* can be omitted in some embodiments. Each lower shoulder 220*e* can extend from the portion 220 to the intermediate portion 224 along a direction having a directional component along the lateral direction A. Further, each lower shoulder 220*e* can face away from a corresponding upper shoulder 220*d*.

The second portion 226 can define opposed outermost sides 226*a* and 226*b*. The outermost sides 226*a* and 226*b* can be spaced from each other along the lateral direction A. The outermost sides 226*a* and 226*b* can be outwardly spaced from the respective first and second sides 224*a* and 224*b* of the intermediate portion 224 along the lateral direction A. The outermost sides 226*a* and 226*b* can also be outwardly spaced from the respective first and second edges 206 and 208 along the lateral direction A. The second portion 226 can have a width $W_4$ along the lateral direction A from the first outermost side 226*a* to the second outermost side 226*b*, the width $W_4$ being greater than the width $W_2$ of the broadsides 210 and 212 from the first edge 206 to the second edge 208. The second portion 226 can extend between the contact beam 216 and the mounting end 202, such as from the mounting end 202 towards the contact beam 216. The second portion 226 can have a substantially rectangular shape in a plane defined by the longitudinal and lateral directions as shown, or can have any other suitable shape in the plane such as a circle, square, or other polygon. Further, the second portion 226 has a maximum length $L_{max,6}$. While the outermost sides 226*a* and 226*b* of the second portion 226 can be spaced outwardly from the respective first and second sides 224*a* and 224*b* as described above, it should be appreciated that one or both of the outermost sides 226*a* and 226*b* can be continuous or in-line with the respective first and second sides 224*a* and 224*b* as desired.

The second portion 226 can extend outward from at least one of the sides 224*a* and 224*b* of the intermediate portion 224 along the lateral direction A. For instance, the second portion 226 can extend outward from both of the sides 224*a* and 224*b* of the intermediate portion 224. Further, the second portion 226 can be coplanar with the broadsides 210 and 212. In alternative embodiments, the second portion 226 can extend out from only one of the first and second sides 224*a* and 224*b* along the lateral direction A. For example, one of the outermost sides 226*a* and 226*b* of the second portion 226 can be spaced outward from a corresponding one of the first and second sides 224*a* and 224*b* with respect to the lateral direction A, and the other of the sides 226*a* and 226*b* of the second portion 226 can be flush or aligned with a corresponding one of the first and second sides 224*a* and 224*b* of the intermediate portion.

The second portion 226 can define a body 226*c* and at least one shoulder, such as a first upper shoulder 226*d* that extends from the body 226*c* to the intermediate portion 224, and in particular to one of the first and second sides 224*a* and 224*b* of the intermediate portion 224. The second portion 226 can also define a second upper shoulder 226*d* that extends from the body 226*c* to the intermediate portion 224, and in particular to the other one of the first and second sides 224*a* and 224*b* of the intermediate portion 224. It should be appreciated that one or both of the first and second upper shoulders 226*d* can be omitted in some embodiments. Each upper shoulder 220*d* can extend from the portion 226 to the contact body intermediate portion 224 along a direction having a directional component along the lateral direction A. Further, each upper shoulder 226*c* can face a corresponding lower shoulder 220*c* of the first portion 220.

The second portion 226 can define at least one lower shoulder, such as a first lower shoulder 226*e* that extends from the body 226*c* of the second portion 226 to the mounting tail 234. For instance, the first lower shoulder 226*e* can extend from one of the outermost sides 226*a* and 226*b* to a corresponding side of the mounting tail 234. The second portion 226 can also define a second lower shoulder 226*e* that extends from the body 226*c* of the second portion 226 to the mounting tail 234. For instance, the second lower shoulder 226*e* can extend from the other one of the outermost sides 226*a* and 226*b* to a corresponding side of the mounting tail 234. It should be appreciated that one or both of the first and second lower shoulders 226*e* can be omitted in some embodiments. Each lower shoulder 226*e* can extend from the portion 226 to the mounting tail 234 along a direction having a directional component along the lateral direction A. Further, each lower shoulder 226*e* can face away from a corresponding upper shoulder 226*d*.

The first and second upper shoulders 220*b* of the first portion 220 and the first and second lower shoulders 226*c* of the second portion 226 together can provide four locations of mechanical support that retains the electrical contact in the connector housing. Further, the first and second portion 220 and 226 can be spaced from each other along the longitudinal direction L a distance greater than that of conventional electrical contacts. The distance can be measured from the first and second upper shoulders 220*b* of the first electrical contact 200 of FIG. 6 to the first and second lower shoulders 226*c* of the first electrical contact 200 of FIG. 6 along the longitudinal direction L. Thus, as will become appreciated from the description below, at least one of the first and second portions of the second electrical contact 200' (FIG. 7) is configured to reside at a location aligned with the intermediate portion 224 along the lateral direction A. Additionally, the impedance of the electrical contact 200 at the anchoring region 224 is better matched with the impedance at the contact 200 at 90 Ohms with a 20 picosecond rise time, with respect to conventional electrical connectors. Further, as a result of the greater spacing between the first and second portions 220 and 226, the mechanical support provided by the electrical contact 200 of FIG. 6 can be greater than that of the conventional electrical contact.

The second portion 226 can include at least one retention feature, such as two retention features 228 that are configured to engage the housing 102 of the electrical connector 100. For example, each retention feature 228 can define a recess such as a dimple that extends into the body 226*a* to receive a protrusion of the connector housing 102. Note that, in alternative embodiments, the retention features 228 can define features other than recesses, such as (without limitation) barbs as described above or fixed protrusions, or the retention features 228 can be omitted altogether.

The contact beam 216 can be constructed as a flexible beam having a bent, such as curved, shape that extends from the anchoring region 214 to a free end 218 of the electrical contact 200. Bent structures as described herein refer to bent shapes that can be fabricated, for instance, by bending the end or by stamping a bent shape, or by any other suitable manufacturing process. The first broadside 210 at the contact beam 216 is configured to wipe against the first complementary electrical component 300 as the component is mated with the contact beam 216 along the longitudinal direction L. Further, the contact beam 216 is configured to contact the first complementary electrical component 300 so as to apply a force to a surface of the complementary electrical component 300 along the transverse direction T.

The contact beam 216 can include at least a first bend region 230 between the anchoring region 214 and the mating end 204. The first bend region 230 can curve towards a first direction that extends from the second broadside 212 toward the first broadside 210 as the contact beam 216 extends away from the anchoring region 214 along the longitudinal direction L. The contact beam 216 can further include at least a second bend region 232 that is between the first bend region 230 and the mating end 204. The second bend region 232 can curve towards a second direction, opposite the first direction, that extends from the first broadside 210 toward the second broadside 212 as the contact beam 216 extends away from the first bend region 230 along the longitudinal direction L. In alternative embodiments, the curvature of the contact beam 216 can vary from that shown. For example, the contact beam 216 can include as few as one bend region, or greater than two bend regions.

Referring again to FIG. 6, at the contact beam 216, at least one of the first and second edges 206 and 208 can taper toward the other of the first and second edges 206 and 208 as the contact body extends along a direction from the anchoring region 214 toward the mating portion 217. For example, the first edge 206 can taper towards the second edge 208 as the first edge 206 extends from the anchoring region 214 to at least the second bend region 232 or the free end 218. Similarly, the second edge 208 can taper toward the first edge 206 as the second edge 206 extends from the anchoring region 214 to at least the second bend region 232 or the free end 218. Alternatively, one or both of the first and second edges can extend along the longitudinal direction L as the contact body 207 extends from the anchoring region 214 to at least the second bend region 232 or the free end 218. For instance, the first and second edges 206 and 208 can be parallel with each other as the contact body 207 extends from the anchoring region 214 to at least the second bend region 232 or the free end 218. As another example, the second edge 208 can taper towards the first edge 206 as the second edge 208 extends from the anchoring region 214 to at least the second bend region 232 or the free end 218, while the first edge 206 can extend along the longitudinal direction L as the first edge 206 extends from the anchoring region 214 to at least the second bend region 232 or the free end 218. As yet another example, the first and second edges 206 and 208 can taper towards each other as they extend from the anchoring region 214 to at least the second bend region 232 or the free end 218. Alternatively, the first and second edges 206 and 208 can be parallel to one another along at least a portion up to an entirety of the length of the contact beam 216.

Figure 9:
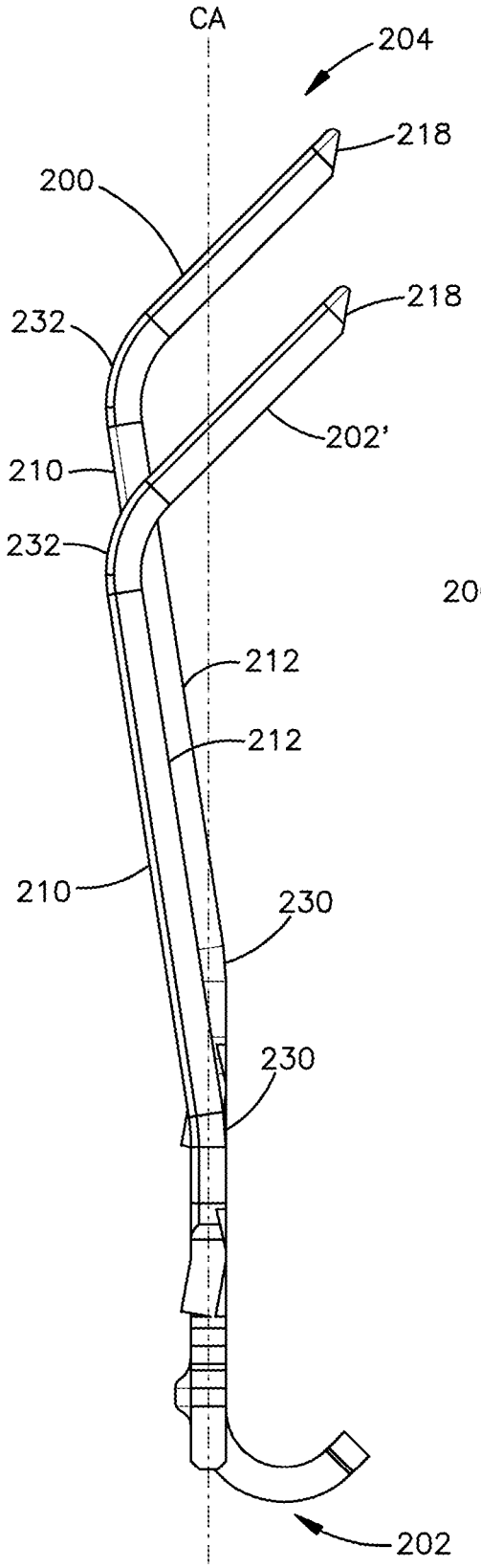
FIG. 9 shows a side plan view of the row of FIG. 8.

Referring to FIG. 9, the anchoring region 214 can define a central axis CA that extends in the longitudinal direction between the first and second broadsides 210 and 212. The second bend region 232 can extend at least partially on a first side of the central axis CA with respect to the transverse direction T, the first side being spaced from the central axis CA along a direction that is opposite the second broadside 212. Further, the free end 218 can be positioned on a second side of the central axis CA with respect to the transverse direction T, the second side being spaced from the central axis CA along a direction that is opposite the first broadside 210.

Figure 10:
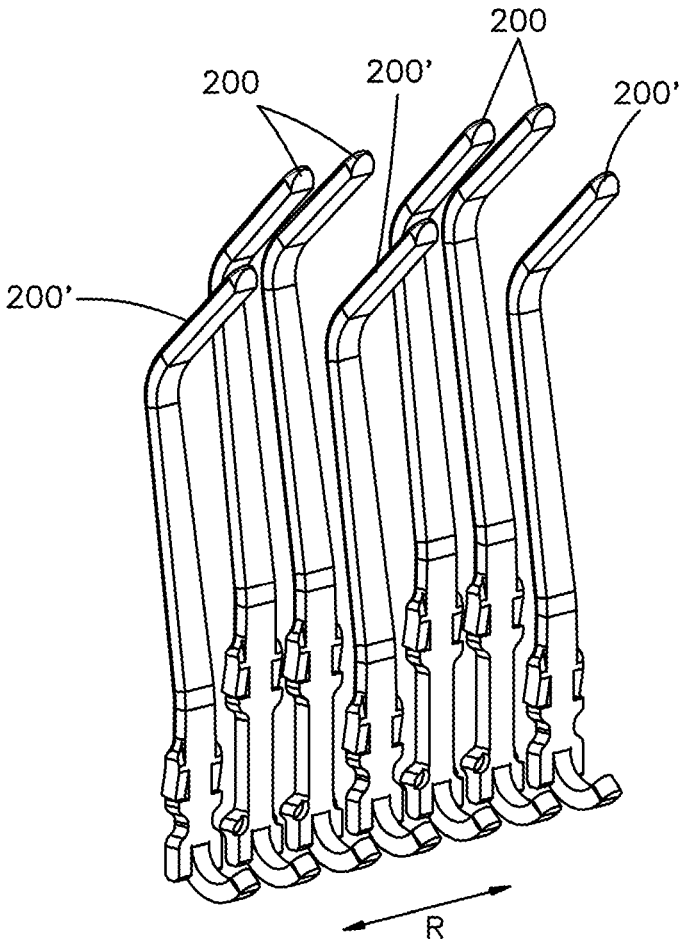
FIG. 10 shows a perspective view of the row of FIG. 8.

Referring back to FIGS. 6 and 7, the mounting end 202 can include a mounting tail 234 that extends away from the anchoring region 214. For example, the mounting tail 234 can define a surface-mount tail as shown that is bent, or otherwise curved, outward from the anchoring region 214 along the transverse direction T, such as along a direction that extends from the first broadside 210 towards the second broadside 212. Thus, the mounting tail 234 can be disposed on the same side of the central axis CA as the free end 218 with respect to the transverse direction T as shown in FIG. 10. Alternatively, the mounting tail 234 can extend on the opposite side of the central axis CA as the free end 218. The mounting tail 234 defines a terminal end 236 of the electrical contact 200. The terminal end 236 can be configured as a mounting surface that mounts onto, such as abuts, an electrical contact of the second complementary electrical component 400. The mounting surface can substantially face the longitudinal direction L, such as in a direction away from the free end 218 of the electrical contact. Thus, the mounting surface can be configured to mount onto a complementary electrical component that lies in a plane that is substantially perpendicular to the longitudinal direction L. In alternative embodiments, the mounting tail 234 can be configured as a differently-configured surface-mount tail, as a press-fit tail, as a fusible element such as a solder ball, or combinations thereof.

The electrical contact 200 defines maximum length $L_{max,1}$ along the longitudinal direction L from the free end 218 to the terminal end 236. The electrical contact 200 further defines a maximum width $W_{max,1}$ along the lateral direction A. The maximum width $W_{max,1}$ can be equal to at least one of the width $W_1$ of the first portion 220 and the width $W_4$ of the second portion 226, such as a larger of the widths $W_1$ and $W_4$. Alternatively, the maximum width $W_{max,1}$ can be equal to both the width $W_1$ of the first portion 220 and the width $W_4$ of the second portion 226 when the widths $W_1$ and $W_4$ are equal. The contact body 207 yet further defines a maximum thickness $T_{max}$ along the transverse direction T from one of the opposed broadsides 210 and 212 to the other. The maximum length $L_{max,1}$ of the electrical contact 200 is greater than both the maximum width $W_{max,1}$ and the maximum thickness $T_{max}$. Further, the maximum width $W_{max,1}$ of the electrical contact 200 can be greater than the maximum thickness $T_{max}$. Thus, the electrical contact 200 can be said to be elongate along the longitudinal direction L.

Now the dimensions of the first and second electrical contacts 200 and 200' will be compared. The first electrical contact 200 has a maximum length $L_{max,1}$ from the mounting tail 234 to the free end 218 that is greater than a maximum length $L_{max,1}$ of the second electrical contact 200' from the mounting tail 234 to the free end 218. The difference in the maximum lengths $L_{max,1}$ can be attributed at least in part to a difference in the lengths $L_{max,2}$ of the anchoring regions 214 of the first and second electrical contacts 200 and 200'. As shown, the maximum length $L_{max,2}$ of the anchoring region 214 of the first electrical contact 200 can be greater than the maximum length $L_{max,2}$ of the anchoring region 214 of the first electrical contact 200'. Further, the maximum length $L_{max,5}$ of the intermediate portion 224 of the first electrical contact 200 can be greater than the maximum length $L_{max,5}$ of the intermediate portion 224 of the second electrical contact 200'. Yet further, the maximum lengths $L_{max,4}$ of the first portions 220 of the first and second electrical contacts 200 and 200' can be equal, the maximum lengths $L_{max,6}$ of the second portions 226 of the first and second electrical contacts 200 and 200' can be equal, the maximum lengths of the mounting tails 234 of the first and second electrical contacts 200 and 200' can be equal, and the maximum lengths $L_{max,3}$ of the contact beams 216 of the first and second electrical contacts 200' can be equal. It is noted that, in alternative embodiments, one or more of these lengths may vary from the first electrical contact 200 to the second electrical contact 200'.

Figure 8:
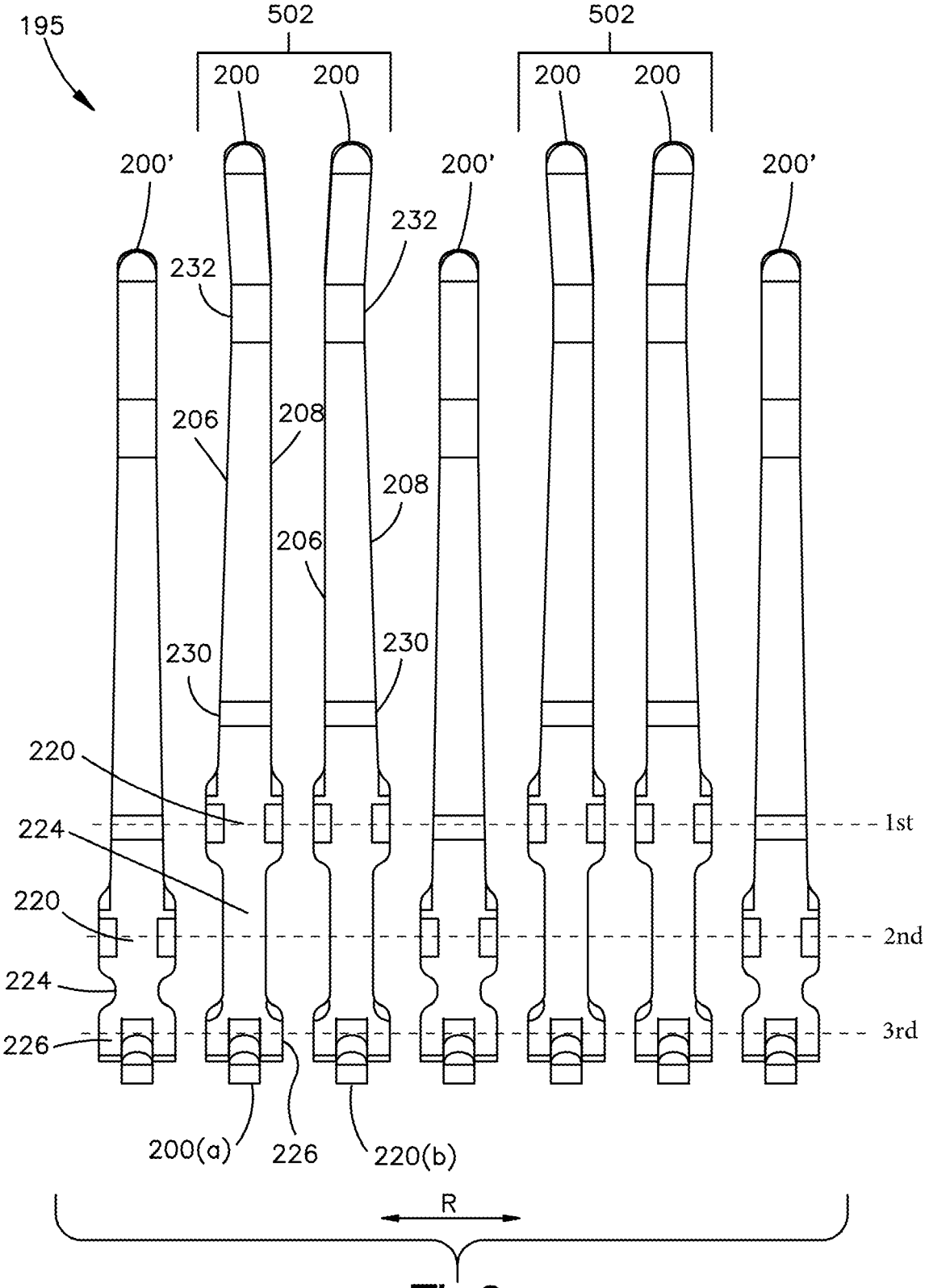
FIG. 8 shows a front plan view of a row of the electrical contacts of FIGS. 6 and 7 according to one embodiment that can be supported by a connector housing.

The combined maximum lengths $L_{max,6}$ and $L_{max,5}$ of the second portion 226 and the intermediate portion 224 of the first electrical contact 200 can be greater than the maximum length $L_{max,2}$ of the anchoring region 214 of the second electrical contact 200'. Consequently, as shown in FIG. 8, when the first and second electrical contacts 200 and 200' are aligned next to one another such that the mounting ends 202 are aligned along the lateral direction A, the first portion 220 of the second electrical contact 200' can be aligned between the first and second portions 220 and 226 of the first electrical contact 200 with respect to the longitudinal direction L.

The maximum width $W_{max}$ of the first electrical contact 200 can be greater than, less than, or equal to the maximum width $W_{max}$ of the second electrical contact 200', and the maximum thickness $T_{max}$ of the first electrical contact 200 can be greater than, less than, or equal to the maximum thickness $T_{max}$ of the second electrical contact 200'. Moreover, in alternative embodiments, one or more of the maximum length $L_{max,4}$ of the first portion 220 of the first electrical contact 200, the maximum length $L_{max,6}$ of the second portion 226 of the first electrical contact 200, and the maximum length $L_{max,3}$ of the contact beam 216 of the first electrical contact 200 can be different from the corresponding lengths of the second electrical contact 200'.

Without being bound by theory, it is believed that anchoring regions of electrical contacts having larger surface areas can suffer from greater drops in impedance than anchoring regions with smaller surfaces areas. However, retention of electrical contacts within connector housings can be weaker for electrical contacts having smaller anchoring regions than for electrical contacts having larger anchoring regions. Contact 200 of FIG. 6 balances these competing concerns (i.e., impedance vs. retention) by (i) reducing the surface area of the anchoring region 214 at the intermediate portion 224 to reduce the impedance drop at the anchoring region 214 and (ii) elongating the anchoring region 214 so as to space the corners 220*d* further from the corners 220*e* to increase contact retention. As a result, contact 200 can have an improved impedance profile over a comparable contact having an anchoring region with larger surface area, where the impedance of the contact 200 at the anchoring region 214 does not drop as significantly as the impedance of the comparable contact at its anchoring region.

In at least some embodiments, the dimensions of the electrical contact 200 of FIG. 6 can be as follows: the length $L_{max,1}$ can be between approximately 4 mm and approximately 15 mm, the length $L_{max,2}$ can be between approximately 1 mm and approximately 6 mm, the length $L_{max,3}$ can be between approximately 2 mm and approximately 10 mm, the length $L_{max,4}$ can be between approximately 0.3 mm and approximately 2 mm, the length $L_{max,5}$ can be between approximately 0.4 mm and 4 mm, the length $L_{max,6}$ can be between approximately 0.2 mm and approximately 2 mm, the width $W_{max,1}$ can be between approximately 0.3 mm and approximately 0.9 mm, the width $W_1$ can be between approximately 0.3 mm and approximately 0.9 mm, the width $W_2$ can be between approximately 0.2 mm and approximately 0.5 mm, the width $W_3$ can be between approximately 0.2 mm and approximately 0.5 mm, and the thickness $T_{max}$ can be between approximately 0.125 mm and approximately 0.225 mm.

In at least some embodiments of the electrical contact 200 of FIG. 6, the ratio of length $L_{max,2}$ to $L_{max,1}$ can be between approximately 1:5 and approximately 2:5, the ratio of $L_{max,3}$ to $L_{max,1}$ can be between approximately 3:5 and approximately 4:5, and the ratio of $L_{max,5}$ to $L_{max,1}$ can be between approximately 1:15 and 1:5.

In at least some embodiments, the dimensions of the electrical contact 200' of FIG. 7 can be as follows: the length $L_{max,1}$ can be between approximately 4 mm and approximately 12 mm, the length $L_{max,2}$ can be between approximately 1 mm and approximately 4.5 mm, the length $L_{max,3}$ can be between approximately 2 mm and approximately 10 mm, the length $L_{max,4}$ can be between approximately 0.3 mm and approximately 2 mm, the length $L_{max,5}$ can be between approximately 0 mm and 2 mm, the length $L_{max,6}$ can be between approximately 0.2 mm and approximately 2 mm, the width $W_{max,1}$ can be between approximately 0.3 mm and approximately 0.9 mm, the width $W_1$ can be between approximately 0.3 mm and approximately 0.9 mm, the width $W_2$ can be between approximately 0.2 mm and approximately 0.5 mm, the width $W_3$ can be between approximately 0.2 mm and approximately 0.5 mm, and the thickness $T_{max}$ can be between approximately 0.125 mm and approximately 0.225 mm.

In at least some embodiments of the electrical contact 200' of FIG. 7, the ratio of length $L_{max,2}$ to $L_{max,1}$ can be between approximately 1:10 and approximately 3:10, the ratio of $L_{max,3}$ to $L_{max,1}$ can be between approximately 3:5 and approximately 4:5, and the ratio of $L_{max,5}$ to $L_{max,1}$ can be between approximately 0 and 1:4.

Turning now to FIGS. 6 to 8, embodiments of the present disclosure can include a kit having at least a first electrical contact 200(*a*), which is configured as discussed above in relation to FIG. 6, and at least a second electrical contact 200', which is configured as discussed above in relation to FIG. 7. As shown, the first and second electrical contacts 200(*a*) and 200' can be arranged edge-to-edge such that one of the first and second edges 206 and 208 of the first electrical contact 200(*a*) faces the other of the first and second edges 206 and 208 of the second electrical contact 200'. Further, the first and second electrical contacts 200(*a*) and 200' can be arranged such that the mounting ends 202 of the first and second electrical contacts 200(*a*) and 200' are aligned along the lateral direction A. Thus, the second portions 226 of the first and second electrical contacts 200(*a*) and 200' can be aligned along the lateral direction A. In other words, the second portions 226 of each of the first and second electrical contacts 200(*a*) and 200' can have a center, and the centers can be aligned along a third line that extends substantially along the lateral direction A.

In this arrangement, the first portion 220 of the second electrical contact 200' is aligned with the anchoring region 214 of the first electrical contact 200(*a*) along the lateral direction A at a location between the first portion 220 of the first electrical contact 200(*a*) and the mounting end 202 of the first electrical contact 200(*a*). For example, the first portions 220 of the first and second electrical contacts 200(*a*) and 200' can have a center, and the centers can be offset from one another with respect to the longitudinal direction A. In other words, the location can be between the first and second portions 220 and 226 such that the first portion 220 of the second electrical contact 200' is aligned with the intermediate portion 224 of the first electrical contact 200(*a*) along the lateral direction A. In at least some embodiments, the first portion 220 of the second electrical contact 200' can be fully aligned with the intermediate portions 224 of the first electrical contact 200(*a*) along the lateral direction A. For example, the outer-most ends of the first portion 220 of the second electrical contact 200' can be fully contained within an area that is aligned fully between the inner-most ends of the first and second portions 220 and 226 of the first electrical contact 200(*a*) along the lateral direction A. Additionally, the free end 218 of the first electrical contact 200(*a*) can extend beyond the free end 218 of the second electrical contact 200' along the longitudinal direction L.

The first electrical contact 200(*a*) can have a maximum length $L_{max,1}$ along the longitudinal direction L from the mounting end 202 of the first electrical contact 200(*a*) to the mating end 204 of the first electrical contact 200(*a*) that is greater than a maximum length $L_{max,1}$ of the second electrical contact 200' along the longitudinal direction L from the mounting end 202 of the second electrical contact 200' to the mating end 204 of the second electrical contact 200'. Further, the anchoring region 214 of the first electrical contact 200(*a*) can have a maximum length $L_{max,2}$ that is greater than a maximum length $L_{max,2}$ of the anchoring region 214 of the second electrical contact 200'. Yet further, the intermediate portion 224 of the first electrical contact 200(*a*) can have a maximum length $L_{max,5}$ that is greater than a maximum length $L_{max,5}$ of the intermediate portion 224 of the second electrical contact 200'. Yet still further, the contact beam 216 of the first electrical contact 200(*a*) can have a maximum length $L_{max,3}$ that is substantially equal to a maximum length $L_{max,3}$ of the contact beam 216 of the second electrical contact 200'.

The kit can further include a third electrical contact 200(*b*), which is configured as discussed above in relation to FIG. 6. The second portions 226 of the first and third electrical contacts 200(*a*) and 200(*b*) can be aligned along the lateral direction A. In other words, the second portions 226 of each of the first and third electrical contacts 200(*a*) and 200(*b*) can have a center, and the centers can be aligned along a first line that extends substantially along the lateral direction A. The first portion 220 of the second electrical contact 200' can be aligned with the anchoring region 214 of the third electrical contact 200(*b*) along the lateral direction A at a location between the first portion 220 of the third electrical contact 200(*b*) and the mounting end 202 of the third electrical contact 200(*b*), when the mounting ends 202 of the second and third electrical contacts 200' and 200(*b*) are aligned along the lateral direction A. For example, the first portions 220 of the second and third electrical contacts 200' and 200(*b*) can have a center, and the centers can be offset from one another with respect to the longitudinal direction A. In other words, the location can be between the first and second portions 220 and 226 of the third electrical contact 200(*b*) such that the first portion 220 of the second electrical contact 200' is aligned with the intermediate portion 224 of the third electrical contact 220(*b*) along the lateral direction A. In at least some embodiments, the first portion 220 of the second electrical contact 200' can be fully aligned with the intermediate portions 224 of the third electrical contact 200(*b*) along the lateral direction A. For example, the outer-most ends of the first portion 220 of the second electrical contact 200' can be fully contained within an area that is aligned fully between the inner-most ends of the first and second portions 220 and 226 of the third electrical contact 200(*b*) along the lateral direction A. Additionally, the free end 218 of the third electrical contact 220(*b*) can extend beyond the free end 218 of the second electrical contact 200' along the longitudinal direction L.

The third electrical contact 200(*b*) can have a maximum length $L_{max,1}$ along the longitudinal direction L from the mounting end 202 of the third electrical contact 200(*b*) to the mating end 204 of the third electrical contact 200(*b*) that is greater than a maximum length $L_{max,1}$ of the second electrical contact 200' along the longitudinal direction L from the mounting end 202 of the second electrical contact 200' to the mating end 204 of the second electrical contact 200'. Further, the anchoring region 214 of the third electrical contact 200(*b*) can have a maximum length $L_{max,2}$ that is greater than a maximum length $L_{max,2}$ of the anchoring region 214 of the second electrical contact 200'. Yet further, the intermediate portion 224 of the third electrical contact 200(*b*) can have a maximum length $L_{max,5}$ that is greater than a maximum length $L_{max,5}$ of the intermediate portion 224 of the second electrical contact 200'. Yet still further, the contact beam 216 of the third electrical contact 200(*b*) can have a maximum length $L_{max,3}$ that is substantially equal to a maximum length $L_{max,3}$ of the contact beam 216 of the second electrical contact 200'. It is noted that kits of the present disclosure can have more than three electrical contacts, such as more than two instances of the electrical contact 200 in FIG. 7, and/or more than one instance of the electrical contact 200' of FIG. 7.

The kit can yet further have a fourth electrical contact 200', which is configured as discussed above in relation to FIG. 7. The first and third electrical contacts 200(*a*) and 200(*b*) can be between the second and fourth electrical contacts 200'. When supported by a connector housing, the center points of the first portions 220 of the first and third electrical contacts 200(*a*) and 200(*b*) can be aligned along a first line that extends substantially along the lateral direction A. Further, the center points of the first portions 220 of the second and fourth electrical contacts 200' can be aligned along a second line that extends substantially along the lateral direction A. The second line can be offset from the first line along the longitudinal direction L. For example, the second line can be spaced close to the mounting ends than the first line. Further, the second line can be substantially parallel to the first line. Similarly, the second portions 226 of the first to fourth electrical contacts can each have a center, and the centers of the second portions 226 of the first to fourth electrical contacts can be aligned along a third line that extends along the lateral direction A. The third line can be offset from one or both of the first and second lines along the longitudinal direction L. For example, the second line can be spaced between the first and third lines with respect to the longitudinal direction L. Further, the third line can be substantially parallel to one or both of the first and second lines.

The second portion 226 of each one of the first, second, third, and fourth contacts 200(*a*), 200', 200(*b*), and 200' can be considered the outer-most enlarged portion of the contact with respect to its mounting end 202. Thus, the anchoring region of the first contact 200(*a*) has an outer-most enlarged portion 226 that is closest to the mounting end 202 of the first contact 200(*a*), the anchoring region of the second contact 200' has an outer-most enlarged portion 226 that is closest to the mounting end 202 of the second contact 200', the anchoring region of the third contact 200(*b*) has an outer-most enlarged portion 226 that is closest to the mounting end 202 of the third contact 200(*b*), and the anchoring region of the fourth contact 200' has an outer-most enlarged portion 226 that is closest to the mounting end 202 of the fourth contact 200'. The outer-most enlarged portions 226 of the first to fourth contacts can be aligned with one another along the lateral direction A. All other enlarged portions of the anchoring region of the first and third contact 200(*a*) and 200(*b*) can be out of alignment with all other enlarged portions of the anchoring region of the second and fourth contacts 200'. In other words, no other enlarged portion of the first and third contact 200(*a*) 200(*b*) is aligned with an enlarged portion of the second or fourth contact 200'.

Referring now to the arrangement of contacts of the electrical connector 100, and with reference to FIG. 5 and FIGS. 8 to 10, the connector housing 102 supports a first plurality of electrical contacts 200 and a second plurality of electrical contacts 200' in each row of the at least one row of contacts. The electrical contacts 200 of the first plurality are each configured as discussed above in relation to FIG. 6, and the electrical contacts 200' of the second plurality are each configured as discussed above in relation to FIG. 7. The first and second pluralities of the contacts can be spaced along the row direction R such that the edges 206 and 208 of adjacent contacts along the row direction R face one another. Thus, the contacts can be arranged edge-to-edge along the row direction R. Four instances of the electrical contact 200 and three instances of the electrical contacts 200' are shown. However, embodiments of the present disclosure can include as few as one instance of each of the first and second electrical contact 200 and 200', or more than four instances of the electrical contact 200 and more than three instances of the electrical contacts 200'.

The electrical contacts 200 of the first plurality can be arranged in pairs 502 such that the individual contacts 200 of each of the pairs 502 are adjacent one another and spaced from one another along a row direction R, which in this embodiment is aligned with the lateral direction A and is perpendicular to both the longitudinal direction L and transverse direction T. The individual contacts 200 of each of the pairs 502 can be immediately adjacent one another without any other electrical contact therebetween. The pairs 502 of the electrical contacts 200 can be arranged such that at least one of the electrical contacts 200' of the second plurality is disposed between adjacent pairs 502 of the electrical contacts 200 along the row direction R. The adjacent pairs 502 of the electrical contacts 200 can be immediately adjacent one another without any other pair 502 of the electrical contacts 200 therebetween. Further, two electrical contacts 200' can be spaced from one another along the lateral direction A with only a single pair of electrical contacts 200 therebetween. Thus, the electrical contacts can be arranged along the row direction in the following pattern: electrical contact 200' of the second plurality-electrical contact 200 of the first plurality-electrical contact 200 of the first plurality-electrical contact 200' of the second plurality-electrical contact 200 of the first plurality-electrical contact 200 of the first plurality, and so on.

The first portion 220 of each electrical contact 200 and 200' can have a center point. When supported by the connector housing 102, the center points of the first portions 220 of the electrical contacts 200 can be aligned along a first line that extends substantially along the lateral direction A. Further, the center points of the first portions 220 of the electrical contacts 200' can be aligned along a second line that extends substantially along the lateral direction A. The second line can be offset from the first line along the longitudinal direction L. For example, the second line can be spaced closer to the mounting ends than the first line with respect to the longitudinal direction L. Further, the second line can be substantially parallel to the first line. Similarly, the second portions 226 of the first to fourth electrical contacts can each have a center, and the centers of the second portions 226 of the first to fourth electrical contacts can be aligned along a third line that extends along the lateral direction A. The third line can be offset from one or both of the first and second lines along the longitudinal direction L. For example, the second line can be spaced between the first and third lines with respect to the longitudinal direction L. Further, the third line can be substantially parallel to one or both of the first and second lines.

When supported by the connector housing 102, the first portion 220 of each of the electrical contacts 200' of the second plurality can be aligned with the anchoring region 214 of each adjacent one of the electrical contacts 200 of the first plurality along the lateral direction A at a location between the first portion 220 of the adjacent electrical contact 200 and the mounting end 202 of the adjacent electrical contact 200. For example, the location can be between the first and second portions 220 and 226 of the adjacent electrical contact 200 such that the first portion 220 of the electrical contact 200 is aligned with the intermediate portion 224 of the adjacent electrical contact 200 along the lateral direction A. In at least some embodiments, the first portions 220 of the electrical contacts 200' can be fully aligned with the intermediate portions 224 of the electrical contacts 200 along the lateral direction A. For example, the outer-most ends of the first portions 220 of the electrical contacts 200' can be fully contained within an area that is aligned fully between the inner-most ends of the first and second portions 220 and 226 of each of the electrical contacts 200 along the lateral direction A. Additionally, the free end 218 of each electrical contact 200 extends beyond the free end 218 of each adjacent one of the electrical contacts 200' along the longitudinal direction L.

With continuing reference to FIG. 8, the second portion 226 of each one of contacts 200 and 200' of the first and second pluralities can be considered the outer-most enlarged portion of the contact with respect to its mounting end 202. Thus, the anchoring region of each contact 200 of the first plurality has an outer-most enlarged portion 226 that is closest to the mounting end 202 of the contact 200, and the anchoring region of each contact 200' of the second plurality has an outer-most enlarged portion 226 that is closest to the mounting end 202 of the contact 200'. The outer-most enlarged portions 226 of the contacts 200 and 200' of the first and second pluralities can be aligned with one another along the lateral direction A. For example, each enlarged portion 226 can have a center, and the centers of the enlarged portions 226 of the electrical contacts 200 and 200' can be aligned along a third line that extends along the lateral direction A. The third line can be offset from the first and second lines along the longitudinal direction L. For example, the second line can be between the first and third lines with respect to the longitudinal direction L. Further, the third line can be substantially parallel to one or both of the first and second lines.

All other enlarged portions of the anchoring regions of the contacts 200 of the first plurality can be out of alignment with all other enlarged portions of the anchoring regions of the contacts 200' of the second plurality with respect to the lateral direction A. Each electrical contact 200 can have a maximum length $L_{max,1}$ along the longitudinal direction L from its mounting end 202 to its mating end 204 that is greater than a maximum length $L_{max,1}$ of an adjacent one of the electrical contacts 200' along the longitudinal direction L from the mounting end 202 of the adjacent electrical contact 200' to the mating end 204 of the adjacent electrical contact 200'. Further, the anchoring region 214 of each electrical contact 200 can have a maximum length $L_{max,2}$ that is greater than a maximum length $L_{max,2}$ of the anchoring region 214 of an adjacent one of the electrical contacts 200'. Yet further, the intermediate portion 224 of each electrical contact 200 can have a maximum length $L_{max,5}$ that is greater than a maximum length $L_{max,5}$ of the intermediate portion 224 of an adjacent one of the electrical contacts 200'. Yet still further, the contact beam 216 of each electrical contact 200 can have a maximum length $L_{max,3}$ that is substantially equal to a maximum length $L_{max,3}$ of the contact beam 216 of an adjacent one of the electrical contacts 200'.

Referring more specifically to FIG. 8, each pair 502 of the electrical contacts 200 includes a first electrical contact **200*a* and a second electrical contact 200*b*. At least a portion of the outer edges 206 and 208, respectively, of the first and second electrical contacts 200*a* and 200*b* can be tapered towards one another as they extend toward their respective free ends 218. Further, the inner edges 208 and 206, respectively, of the first and second electrical contacts 200*a* and 200*b* can be aligned with the longitudinal direction L so as to not be tapered towards one another as they extend toward their respective free ends 218. In other words, at least a portion of the inner edges 208 and 206, respectively, of the first and second electrical contacts 200*a* and 200*b* can be substantially parallel to one another, rather than taper away from one another. As a result, the spacing between the inner edges 208 and 206, respectively, of the first and second electrical contacts 200*a* and 200*b* can be closer to one another than in comparable electrical connectors where the inner surfaces taper away from one another. Without being bound by theory, it is believed that the closer spacing can result in the contact beams 216** of the first and second electrical contacts

200*a* and 200*b* being more tightly coupled together than comparable contacts that taper away from one another. Further, it is believed that the tighter coupling can increase the power flow of the signals in between the first and second electrical contacts 200*a* and 200*b* along the longitudinal direction L, can improve impedance control, and can reduce crosstalk.

In at least some embodiments, the stubs 219 of the electrical contacts 200 of each pair 502 flare away from one another as the stubs 219 extend toward the free end 218. Further, the stub 219 of a first electrical contact 200 of a pair 502 can extend at an acute angle relative to the stub 219 of a second electrical contact 200 of the pair. Flaring the stubs 219 of two contacts 200 of a pair 502 away from one another can reduce capacitive coupling between the two contacts 200, resulting in less interference between the signals conducted over the two contacts 200 than if the stubs 219 were parallel to one another. Moreover, arranging the shorter contacts 200' adjacent the pairs 502 of contacts 200 can result in lower capacitive coupling between the flared stubs 219 and the adjacent contacts than would occur if the adjacent contacts were longer.

Each individual instance of the first electrical contact 200 can define a signal contact, and each individual instance of the second electrical contact 200' can define a ground contact. Further, each pair 502 of the signal contacts 200 can define a differential signal pair. Thus, the electrical contacts in the arrangement of FIGS. 8 and 10 can define the following pattern along the row direction R from left to right: ground-signal-signal-ground-signal signal, which can be repeated. Thus, in such arrangement, the signal contacts 200 can each have a maximum length $L_{max,1}$ along the longitudinal direction L that is greater than the maximum length $L_{max,1}$ of each of the ground contacts 200' along the longitudinal direction L.

Without being bound by theory, it is believed that designating the shortened contacts 200' in the rows of FIGS. 5 and 8 to 10 as ground contacts can shift common mode resonance of the contacts 200' out in frequency to improve crosstalk. Further, it is believed that interspersing the shortened ground contacts 200' with the elongated signal contacts 200 as shown in FIGS. 5 and 8 to 10 can place the beam profiles of the shortened ground contacts 200' out of plane with those of the elongated signal contacts 200 so to allow signal pair cancellation on ground beam, which can result in reduced cross coupling or crosstalk. Moreover, it is believed that interspersing the shortened ground contacts 200' with the elongated signal contacts 200 can reduce capacitance of the tips of the elongated signal contacts 200. This in turn allows the tips of the elongated signal contacts 200 to be lengthened for a mechanical advantage where longer tips can be more robust to avoid stub damage when the electrical connector 100 is mated with the first complementary component 300. Each of the aforementioned characteristics enables the connector 100 to operate at faster speeds than comparable prior art connectors, such as speeds up to or exceeding 40 Gigabytes/second.

In alternative embodiments, the contacts 200 and 200' can define an open pin field. For instance, the plurality of first electrical contacts 200 can define both signal contacts and ground contacts and the plurality of second electrical contacts 200' can define both signal contacts and ground contacts. At least one of the first electrical contacts 200 can define a signal contact, at least one other of the first electrical contacts 200 can define a ground contact, at least one of the second electrical contacts 200' can define a signal contact, and at least one other of the second electrical contacts 200' can define a ground contact. Thus, the contacts can define grounds and signals in any desired pattern along the row direction R. For instance, the electrical contacts in the arrangement of FIGS. 8 and 10 can define the following pattern along the row direction R from left to right: ground-signal-ground-signal-ground-signal, which can be repeated.

In further alternative embodiments, the electrical contacts 200 and 200' of the first and second pluralities can be arranged along the row direction in a different pattern, such as (without limitation): electrical contact 200' of the second plurality-electrical contact 200' of the second plurality-electrical contact 200 of the first plurality-electrical contact 200 of the first plurality-electrical contact 200' of the second plurality-electrical contact 200' of the second plurality-electrical contact 200 of the first plurality-electrical contact 200 of the first plurality, and so on. Moreover, in such an arrangement, the electrical contacts can define the following pattern along the row direction R from left to right: ground-ground-signal-signal-ground-ground-signal-signal, which can be repeated. Referring back to the connector 100 in FIGS. 1 to 4, the connector housing 102 has a mounting end 104 and a mating end 106 that are spaced from one another along a select direction D, which in this embodiment is aligned with the longitudinal direction L of the electrical contacts. The first and second pluralities of contacts 200 and 200' are supported by the housing 102 such that the mounting ends 202 of the contacts are disposed at the mounting end 104 of the housing 102 and the mating ends 204 of the contacts are disposed at the mating end 106 of the housing. Further, first and second pluralities of contacts 200 and 200' can be bottom loaded into the connector housing 102 through the mounting end 104, can be injection molded or stitched into the connector housing 102, or loaded into the connector housing 102 in any other suitable manner.

The electrical connector 100 is a vertical electrical connector, wherein the mating end 106 is configured to mate with the first complementary electrical component 300 along a mating direction $M_A$ that is aligned with the select direction D, and the mounting end 104 is configured to mount to the second complementary electrical component 400 along a mounting direction $M_O$ that is also aligned with the select direction D. Thus, in FIGS. 1 to 5, the mating direction $M_A$ and the mounting direction $M_O$ are both aligned with (i.e., parallel to) the select direction D.

In alternative embodiments, the electrical connector can be a right-angle electrical connector, where the mating end 106 is configured to mate with the first complementary electrical component 300 along a mating direction $M_A$, and the mounting end 104 is configured to mount to the second complementary electrical component 400 along a mounting direction $M_O$, perpendicular to the mating direction $M_A$. In such embodiments, the mounting direction $M_O$ can be aligned with the select direction D, and the mating direction $M_A$ can be perpendicular to the select direction D.

The connector housing 102 has first and second sidewalls 108 and 110 that extend from the mating end 106 to the mounting end 104 along the select direction D. The first and second sidewalls 108 and 110 are spaced from one another along the column direction C so as to define an insertion slot 112 therebetween that is sized and configured to receive the first complementary electrical component 300. The insertion slot 112 defines a plane that extends along the select direction D and the row direction R between the first and second rows $R_1$ and $R_2$. The connector housing 102 can also include first and second endwalls 114 and 116 that are spaced from one another along the row direction R. The first and second endwalls 114 and 116 can extend from the mating end 106 to the mounting end 104 along the select direction D and from the first sidewall 108 to the second sidewall 110.

The first sidewall 108 includes a first internal surface 108*a*, and a first external surface 108*b* spaced opposite from the first internal surface 108*a* along the column direction C. Similarly, the second sidewall 110 includes a second internal surface 110*a*, and a second external surface 110*b* spaced opposite from the second internal surface 110*a* along the column direction C. The first and second internal surfaces 108*a* and 110*a* can face one another along the column direction C, and the first and second external surfaces 108*b* and 110*b* can face away from one another along the column direction C. Moreover, the first internal surface 108*a* is spaced between the first external surface 108*b* and the second sidewall 110, while the second internal surface 110*a* is spaced between the second external surface 110*b* and the first sidewall 108.

The first sidewall 108 can include a first plurality of ribs 108*c* that extend from the first internal surface 108*a* towards the second sidewall 110. The ribs 108*c* of the first plurality of ribs can be spaced from one another along the row direction R by a width that is greater than the width $W_2$ of the contact beams 216 of the electrical contacts 200 and 200'. Each rib 108*c* can be spaced between a different pair of immediately adjacent electrical contacts such that the edges 106 and 108 of the immediately adjacent electrical contacts that face one another also face the rib 108*c*.

Similarly, the second sidewall 110 can include a second plurality of ribs 110*c* that extend from the second internal surface 110*a* towards the first sidewall 108. The ribs 110*c* of the first plurality of ribs can be spaced from one another along the row direction R by a width that is greater than the maximum width $W_{max}$ of the electrical contacts 200 and 200'. Each rib 110*c* can be spaced between a different pair of immediately adjacent electrical contacts such that the edges 106 and 108 of the immediately adjacent electrical contacts that face one another also face the rib 110*c*.

With reference to the system 10 of FIGS. 1 to 4, the system 10 can include the electrical connector 200 and at least one, or both, of (i) a first complementary electrical component 300 and (ii) a second complementary electrical component 400. The first complementary electrical component 300 can define a PCB such as an edge card. The first complementary electrical component 300 has opposed first and second side surfaces 302 and 304 that are spaced from one another along the column direction C such that the first side surface 302 mates with the electrical contacts of the first row $R_1$ of the electrical connector 100, and the second side surface 304 mates with the electrical contacts of the second row $R_2$ of the electrical connector 100. The first complementary electrical component 300 also has opposed insertion and trailing ends 306 and 308 that are spaced from one another along the select direction D, and opposed first and second edges 310 and 312 that are spaced from one another along the row direction R. The insertion end 306 can also be said to be spaced from the trailing end 308 along the mating direction $M_A$.

The first and second side surfaces 302 and 304 each extend from the insertion end 306 to the trailing end 308 and from the first edge 310 to the second edge 312 so as to define a planar surface having a height along the select direction D from the insertion end 306 to the trailing end 308, and a width from the first edge 310 to the second edge 312 along the row direction R. Further, the first complementary electrical component 300 defines a thickness from the first side surface 302 to the second side surface 304 along the column direction C. The height and width are greater than the thickness. Thus, the first complementary electrical component 300 is planar along the row direction R and the select direction D. The insertion end 306 can also be tapered such that the thickness of the insertion end 306 decreases in the mating direction $M_A$.

The first complementary electrical component 300 has a dielectric substrate 314, a first plurality of first conductive contact pads 316 carried by the substrate 314 at the first side surface 302, and a second plurality of second conductive contact pads 318 carried by the substrate 314 at the first side surface 302. Each first contact pad 316 can include a trailing end 316*a*, and a leading end 316*b* spaced from the trailing end 316*a* along the select direction D. Further, each first contact pad 316 can include opposed sides 316*c* that are spaced from one another along the row direction R, and that extend from the trailing end 316*a* to the leading end 316*b*. Each first contact pad 316 can have a rectangular shape such that each first contact pad 316 is elongate from its respective trailing end 316*a* to its respective leading end 316*b*, or can have any suitable alternative shape such as a circle, square, or other polygon. Similarly, each second contact pad 318 can include a trailing end 318*a*, a leading end 318*b* spaced from the trailing end 318*a* along the select direction D, and opposed sides 318*c* and 318*d* that are spaced from one another along the row direction R, and that extend from the trailing end 318*a* to the leading end 318*b*. Each second contact pad 318 can have a rectangular shape such that each second contact pad 318 is elongate from its respective trailing end 318*a* to its respective leading end 318*b*, or can have any suitable alternative shape such as a circle, square, or other polygon.

The first contact pads 316 are arranged in pairs 320 and are positioned so as to mate with the pairs 502 of the first electrical contacts 200 supported by the electrical connector 100 in the first row $R_1$. Thus, each pair 320 of the first contact pads 316 aligns with a different pair 502 of the first electrical contacts 200 along the column direction C when the first complementary electrical component 300 is mated with the electrical connector 100. The second contact pads 318 are positioned so as to mate with the second electrical contacts 200' supported by the electrical connector 100 in the first row $R_1$. Thus, each second contact pad 318 aligns with a different second electrical contact 200' along the column direction C when the first complementary electrical component 300 is mated with the electrical connector 100.

The second side surface 304 can carry contact pads in a pattern that substantially mirrors that of the first side surface 302. Thus, the first complementary electrical component 300 can also have a first plurality of first conductive contact pads 316 carried by the substrate 314 at the second side surface 304, and a second plurality of second conductive contact pads 318 carried by the substrate 314 at the second side surface 304, where the first and second pluralities of contact pads 316 and 318 are arranged as discussed above in relation to the first side surface 302.

The first and second pluralities of contact pads 316 and 318 can be arranged in a side-by-side manner along the row direction R. The individual first contact pads 316 within each pair 320 can be spaced apart from one another along the row direction R without any other contact pads therebetween. The pairs 320 of first contact pads 316 can be arranged such that at least one of the second contact pads 318 is disposed between adjacent pairs 320 of the first electrical contacts 316 along the row direction R. The adjacent pairs 320 of the first electrical contacts 316 can be immediately adjacent one another without any other pair 320 of the first electrical contacts 316 therebetween. Thus, the electrical contacts can be arranged along the row direction R in the following pattern: second contact pad 318-first contact pad 316-first contact pad 316-second contact pad 318-first contact pad 316-first contact pad 316, which can be repeated.

Each first contact pad 316 can define a signal contact pad, and each second contact pad 318 can define a ground contact pad. Further, each pair 320 of the first contact pads 316 can define a differential signal pair. Thus, the contact pads in the arrangement of FIGS. 1 to 5 can define the following pattern along the row direction R from left to right: ground-signal-signal-ground-signal-signal, which can be repeated. Alternatively, the plurality of first contact pads 316 can define both signal contact pads and ground contact pads and the plurality of second contact pads 318 can define both signal contact pads and ground contact pads. In particular, at least one of the first contact pads 316 can define a signal contact pad, at least one other of the first contact pads 316 can define a ground contact pad, at least one of the second contact pads 318 can define a signal contact pad, and at least one other of the second contact pads 318 can define a ground contact pad. In this case, the contact pads that define grounds and signals can alternate along the row direction R. Thus, the contact pads in the arrangement of FIGS. 1 to 5 can define the following pattern along the row direction R from left to right: ground-signal-ground-signal-ground-signal, which can be repeated.

With continuing reference to the system 10 of FIGS. 1 to 4, the second complementary electrical component 400 can be implemented as a PCB. The second complementary electrical component 400 has opposed upper and lower surfaces 402 and 404 that are spaced from one another along the select direction D, where the upper surface 402 is configured to mate with the mounting ends 202 of the electrical contacts 200 and 200' of the electrical connector 100. The second complementary electrical component 400 also has opposed first and second ends 406 and 408 that are spaced from one another along the column direction C, and opposed first and second sides 410 and 412 that are spaced from one another along the row direction R. The lower surface 404 can also be said to be spaced from the upper surface 402 along the mounting direction $M_O$.

The upper and lower surfaces 402 and 404 each extend from the first end 406 to the second end 408 and from the first side 410 to the second side 412 so as to define a planar surface having a width along the column direction C from the first end 406 to the second end 408, and a length from the first side 410 to the second side 412 along the row direction R. Further, the second complementary electrical component 400 defines a thickness from the upper surface 402 to the lower surface 404 along the select direction D. The length and width are greater than the thickness. Thus, the second complementary electrical component 400 is planar along the row direction R and the column direction C.

The second complementary electrical component 400 has a dielectric substrate 414, a first plurality of first conductive contact pads 416 carried by the substrate 414 at the upper surface 402, and a second plurality of second conductive contact pads 418 carried by the substrate 414 at the upper surface 402. The first and second pluralities of conductive contact pads are arranged in first and second rows $R_1$ and $R_2$ at the upper surface 402 and that are spaced from one another along the column direction C.

Each first contact pad 416 can include a first end 416*a*, and a second end 416*b* spaced from the first end 416*a* along the column direction C. Further, each first contact pad 416 can include opposed sides 416*c* that are spaced from one another along the row direction R, and that extend from the first end 416*a* to the second end 416*b*. Each first contact pad 416 can have a rectangular shape such that each first contact pad 416 is elongate from its respective first end 416*a* to its respective second end 416*b*, or can have any suitable alternative shape such as a circle, square, or other polygon. Similarly, each second contact pad 418 can include a first end 418*a*, a second end 418*b* spaced from the first end 418*a* along the column direction C, and opposed sides 418*c* that are spaced from one another along the row direction R, and that extend from the first end 418*a* to the second end 418*b*. Each second contact pad 418 can have a rectangular shape such that each second contact pad 418 is elongate from its respective first end 418*a* to its respective second end 418*b*, or can have any suitable alternative shape such as a circle, square, or other polygon.

The first contact pads 416 within each row $R_1$ and $R_2$ are arranged in pairs 420 and are positioned so as to mate with the pairs 502 of the electrical contacts 200 supported by the electrical connector 100 in the corresponding rows $R_1$ and $R_2$ of the electrical connector 100. Thus, each pair 420 of the first contact pads 416 aligns with a different pair 502 of the electrical contacts 200 along the mounting direction $M_O$ when the second complementary electrical component 400 is mated with the electrical connector 100. The second contact pads 418 within each row $R_1$ and $R_2$ are positioned so as to mate with the electrical contacts 200' supported by the electrical connector 100 in the corresponding rows $R_1$ and $R_2$ of the electrical connector 100. Thus, each second contact pad 418 aligns with a different electrical contact 200' along the mounting direction $M_O$ when the second complementary electrical component 400 is mated with the electrical connector 100.

The first and second pluralities of contact pads 416 and 418 can be arranged in a side-by-side manner along each row $R_1$ and $R_2$. The individual first contact pads 416 within each pair 420 are spaced apart from one another along the row direction R without any other contact pads therebetween. The pairs 420 of first contact pads 416 can be arranged such that at least one of the second contact pads 418 is disposed between adjacent pairs 420 of the first electrical contacts 416 along the row direction R. The adjacent pairs 420 of the first electrical contacts 416 can be immediately adjacent one another without any other pair 420 of the first electrical contacts 416 therebetween. Thus, the electrical contacts can be arranged along the row direction R in the following pattern: second contact pad 418-first contact pad 416-first contact pad 416-second contact pad 418-first contact pad 416-first contact pad 416, which can be repeated.

Each first contact pad 416 can define a signal contact pad, and each second contact pad 418 can define a ground contact pad. Further, each pair 420 of the first contact pads 416 can define a differential signal pair. Thus, the contact pads in the arrangement of FIGS. 1 to 5 can define the following pattern along the row direction R from left to right: ground-signal-signal-ground-signal-signal, which can be repeated. Alternatively, the plurality of first contact pads 416 can define both signal contact pads and ground contact pads and the plurality of second contact pads 418 can define both signal contact pads and ground contact pads. In particular, at least one of the first contact pads 416 can define a signal contact pad, at least one other of the first contact pads 416 can define a ground contact pad, at least one of the second contact pads 418 can define a signal contact pad, and at least one other of the second contact pads 418 can define a ground contact pad. In this case, the contact pads that define grounds and signals can alternate along the row direction R. Thus, the electrical contact pads in the arrangement of FIGS. 1 to 5 can define the following pattern along the row direction R from left to right: ground-signal-ground-signal-ground-signal, which can be repeated.

Figure 11:
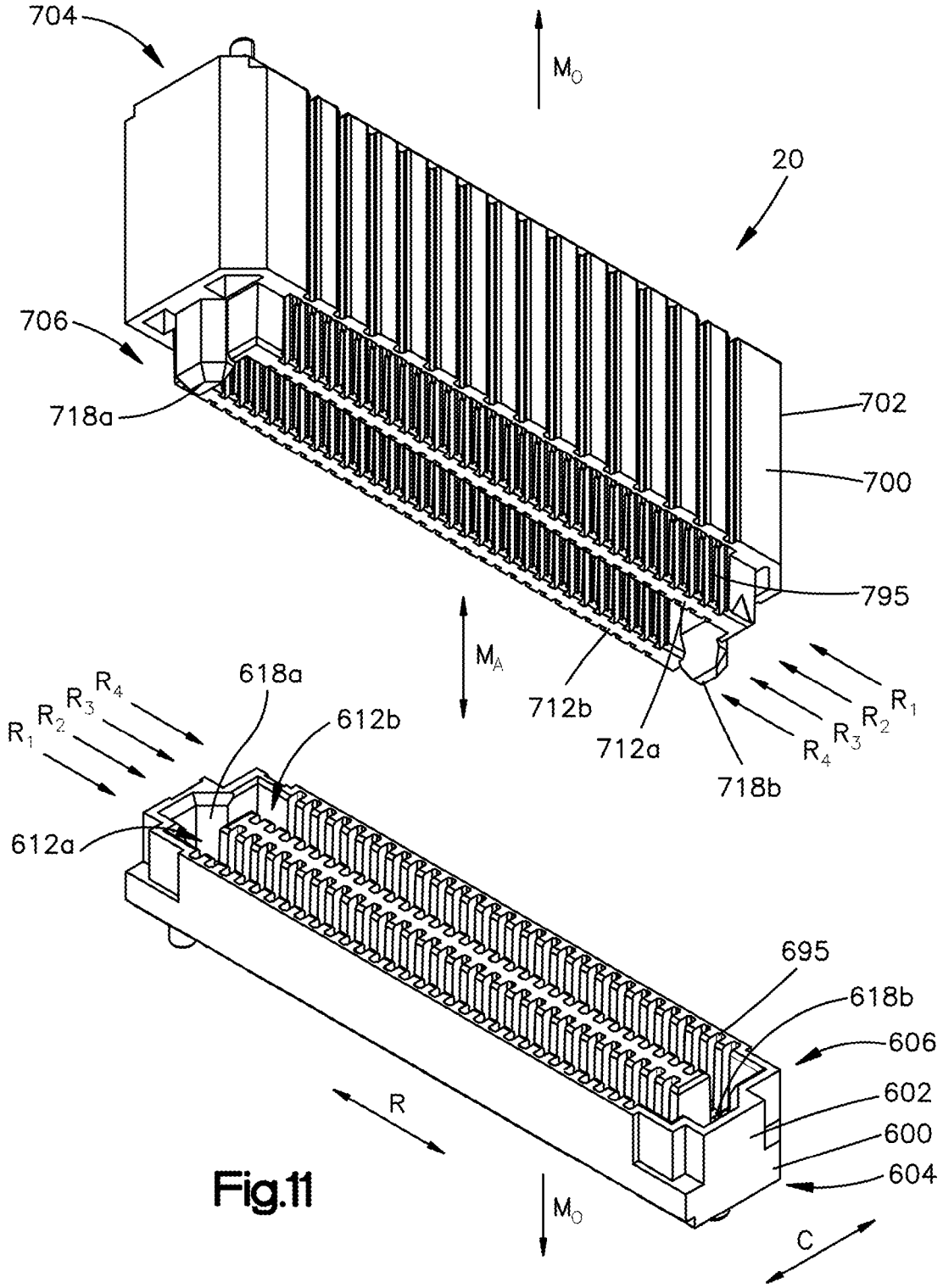
FIG. 11 shows a perspective view of an electrical connector system according to one embodiment having first and second electrical connectors configured to mate with one another.

Referring to FIG. 11, an electrical connector system 20 includes a first electrical connector 600, and a second electrical connector 700. The system 20 can further include first and second complementary electrical components configured as first and second substrates, such as first and second printed circuit boards (PCBs). The first electrical connector 600 is configured to be placed in electrical communication with the first complementary electrical component, and the second electrical connector 700 is configured to be placed in electrical communication with the second complementary electrical component. Thus, the first and second electrical connectors 600 and 700 can together define a mezzanine connector system that places the first complementary electrical component in electrical communication with the second complementary electrical component. In this example, the first and second electrical connectors 600 and 700 are each vertical connectors, and the system places two substantially parallel complementary electrical components in electrical communication with one another. However, in alternative embodiments, a least one of the first and second electrical connectors 600 and 700 can be a right-angle connector.

The first electrical connector 600 can define a mounting end 604 configured to be mounted to the first electrical component, and the second electrical connector 700 can define a mounting end 704 configured to be mounted to the second electrical component. Further, the first electrical connector 600 can define a mating end 606, and the second electrical connector 700 can define a mating end 706, wherein the mating ends 606 and 706 are configured to be mated with one another to provide an electrically conductive path between traces carried by the first complementary electrical component and traces carried by the second complementary electrical component. Accordingly, the electrical connectors 600 and 700 together provide an electrically conductive path between the first and second electrical components, such as from at least one of the first and second complementary electrical components to the other of the first and second complementary electrical components.

The first electrical connector 600 includes a dielectric or electrically insulative connector housing 602 and a plurality of electrical contacts 695 that are supported by the connector housing 602. For instance, the electrical contacts 695 can be arranged in at least one row that is oriented along a row direction R. For instance, the at least one row can be arranged in first and second rows $R_1$ and $R_2$ that are spaced from one another along the column direction so as to define at least one insertion slot 612 therebetween. In one example, the electrical contacts 695 can be supported by the connector housing 602 in at least first to fourth rows $R_1$, $R_2$, $R_3$, and $R_4$ that are spaced apart from one another along a column direction C so as to define a first insertion slot 612*a* between the first and second rows $R_1$ and $R_2$ and a second insertion slot 612*b* between the third and fourth rows $R_3$ and $R_4$. The rows can be oriented along a lateral direction A that is substantially perpendicular to the longitudinal direction L. The column direction C can be oriented along a direction that is perpendicular to each of the lateral direction A and the longitudinal direction L. For instance, the column direction C can be oriented along a transverse direction T. Each of the at least one row of electrical contacts can include a first set of electrical contacts 800 supported by the housing 602, and a second set of electrical contacts 900 supported by the housing 702.

The second electrical connector 700 includes a dielectric or electrically insulative connector housing 702 and a plurality of electrical contacts 795 that are supported by the connector housing 702. For instance, the electrical contacts 795 can be arranged in at least one row that is oriented along a row direction R. Further, the second electrical connector 700 can include at least one spline 712 that carries the at least one row. The at least one spline 712 can be configured to mate with the at least one insertion slot 612 of the first electrical connector 600. In one example, the electrical contacts 795 can be supported by the connector housing 702 in at least first to fourth rows $R_1$, $R_2$, $R_3$, and $R_4$ that are spaced apart from one another along a column direction C. The first and second rows $R_1$ and $R_2$ can be carried by a first spline 712*a* that is configured to be received by the first insertion slot 612*a*, and the third and fourth rows $R_3$ and $R_4$ can be carried by a second spine 712*b* that is configured to be received by the second insertion slot 612*b*. Each of the at least one row of electrical contacts can include a plurality of electrical contacts 1000 supported by the housing 702.

The second electrical connector 700 can define at least one orientation member configured to engage with a complementary orientation member of the first electrical connector 600 to ensure proper orientation of the first and second electrical connectors 600 and 700 relative to each other during mating of the first and second electrical connectors 600 and 700. In accordance with the illustrated embodiment, the second electrical connector 700 can include at least one alignment member, such as at least one post 718 that extends out from the connector housing 702 in the longitudinal direction L. For example, the at least one post 718 can extend from the mating end 706 in a direction away from the mounting end 704. Further, the first electrical connector 600 can include at least one alignment member, such as a recess 618 that extends into the first connector housing 602 in the longitudinal direction. For example, the at least one recess 618 can extend into the mating end 606 in a direction towards the mounting end 604. The at least one post 718 is configured to be received in the at least one recess 618. In at least one embodiment, the second electrical connector 700 can include two alignment members, such first and second posts 718*a* and 718*b* that are spaced from one another along the row direction R, and the first electrical connector 600 can include two alignment members, such first and second recesses 618*a* and 618*b* that are spaced from one another along the row direction R. It should be appreciated that the second electrical connector 700 is not limited to the illustrated posts 718*a* and 718*b*, and the first electrical connector 600 is not limited to the illustrated recesses 618*a* and 618*b*. Accordingly, the electrical connectors 600 and 700 can alternatively be constructed with any other suitable orientation member, or members, as desired.

Figure 12:
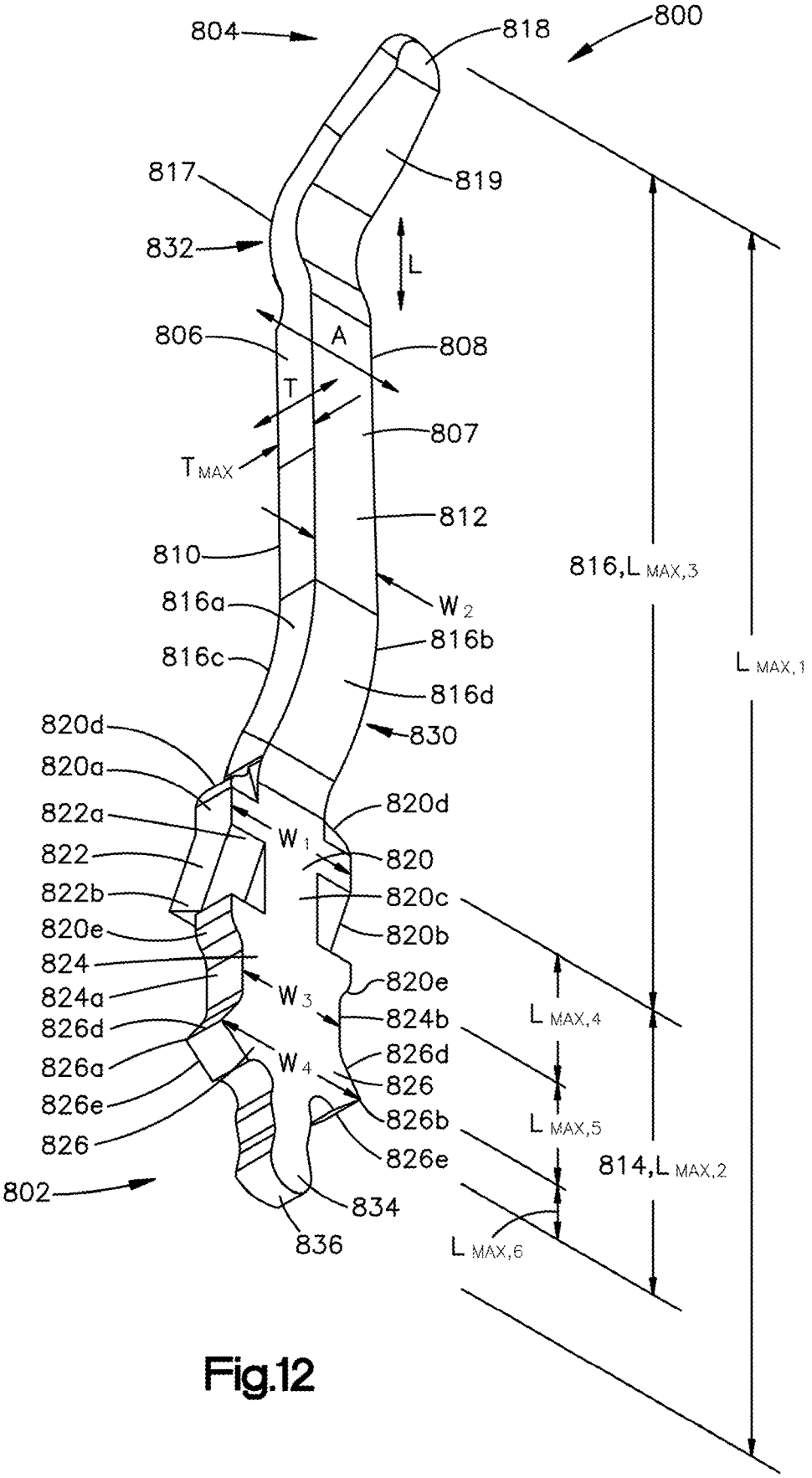
FIG. 12 shows a perspective view of one embodiment of a first electrical contact of the first electrical connector of FIG. 11.
Figure 13:
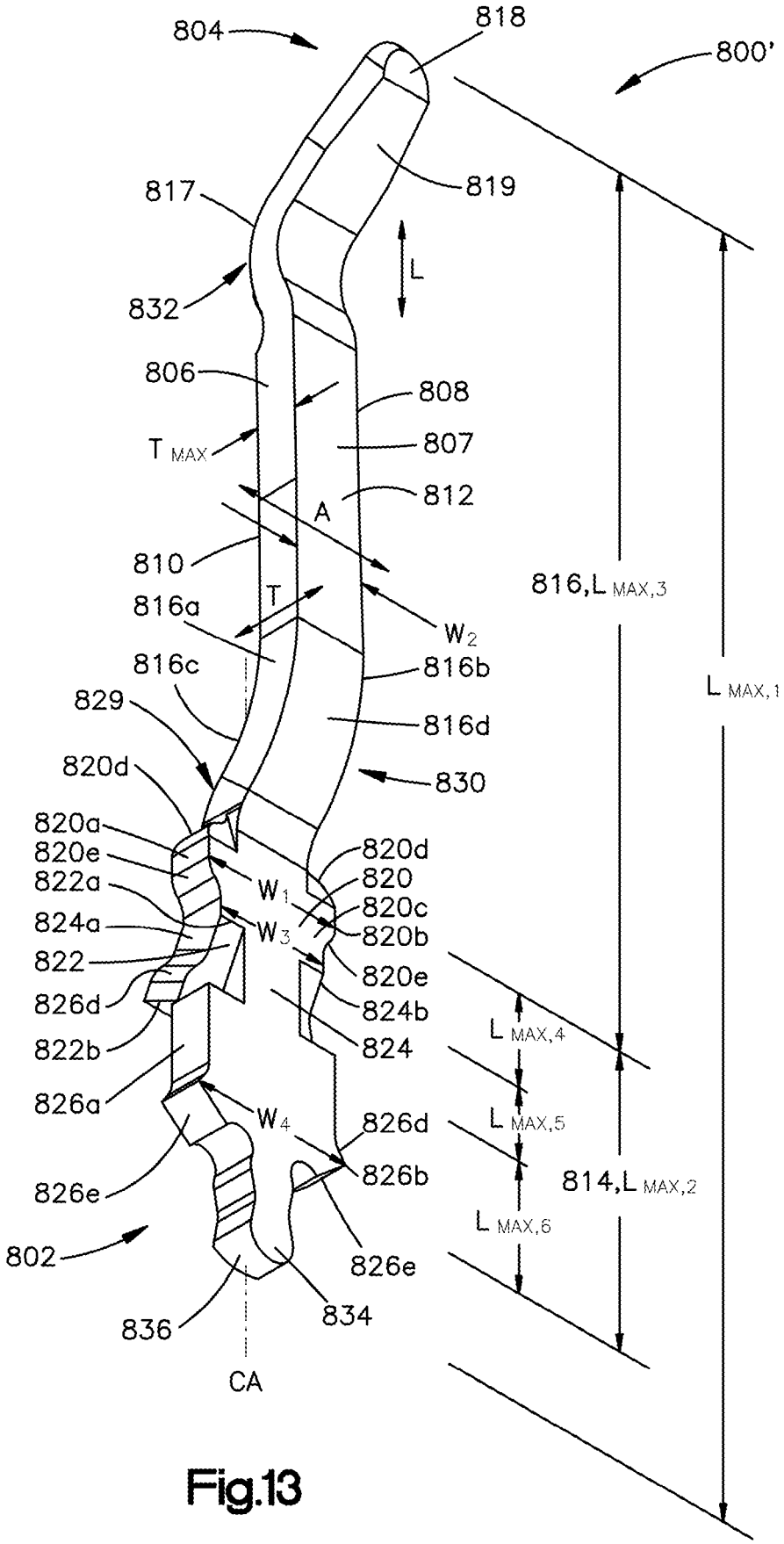
FIG. 13 shows a perspective view of one embodiment of a second electrical contact of the first electrical connector of FIG. 11.

Turning now to FIGS. 12 and 13, each row of contacts of the first electrical connector 600 includes a first set of electrical contacts 800 and a second set of electrical contacts 800'. Similar to the first and second electrical contacts 200 and 200', each of the first and second contacts 800 and 800' includes an anchoring region 814 and a contact beam 816. As will be described in further detail below, each anchoring region 814 includes one or more of a first portion 820, a second portion 826, and a third portion 826. Unless otherwise indicated, the following description of the first electrical contacts 800 will apply equally to the second electrical contact 800'.

The electrical contact 800 includes a mounting end 802, and a mating end 804 opposite the mounting end 802 along the longitudinal direction L. In one example, the electrical contact 800 can be a vertical electrical contact whereby the mating direction and mounting direction are oriented along the same direction, such as along the longitudinal direction L. Alternatively, the electrical contact 800 can be configured as a right-angle contact, whereby the mating direction and the mounting direction are oriented substantially perpendicular to each other in a manner similar to that described above in relation to FIGS. 6 and 7.

The electrical contact 800 includes a contact body 807 that defines first and second edges 806 and 808, and first and second broadsides 810 and 812. The first and second edges 806 and 808 are spaced opposite from one another along the lateral direction A. Thus, the first and second edges 806 and 808 can face away from one another. At least respective portions of the first and second broadsides 810 and 812 can be spaced opposite each other along the transverse direction T. Thus, the first and second broadsides 810 and 812 can face away from one another. It should therefore be appreciated that each of the first and second edges 806 and 808 are connected between the first and second broadsides 810 and 812. Similarly, each of the first and second broadsides 810 and 812 are connected between the first and second edges 806 and 208. The edges 806 and 808 and broadsides 810 and 812 can define respective distances along a plane that is oriented normal to the contact body 807. For instance, the edges 806 and 808 can each extend along a first distance from one of the first and second broadsides 810 and 812 to the other of the first and second broadsides 810 and 812 along the plane. The broadsides 810 and 812 can each extend along a second distance from one of the first and second edges 806 and 808 to the other of the first and second edges 806 and 808 along the plane. The second distance can be greater than the first distance. In one example, the first distance can define a thickness of the contact body 807, and the second distance can define a width of the contact body 807. The thickness along at least a portion of the contact body 807 can be oriented along the transverse direction T, and the width along at least a portion of the contact body 807 can be oriented along the lateral direction A.

The electrical contact 800 includes an anchoring region 814 that is configured to secure the electrical contact to the connector housing 602 of the electrical connector 600. The electrical contact 800 further includes a contact beam 816 that extends out with respect to the anchoring region 814. For instance, the contact beam 816 can extend out with respect to the anchoring region 814 along the longitudinal direction L. In one example, the contact beam 816 can extend from the anchoring region 814.

The contact beam 816 has first and second sides 816*a* and 816*b*, and first and second faces 816*c* and 816*d*. The first and second sides 816*a* and 816*b* of the contact beam 816 are defined by the first and second edges 806 and 808, respectively, of the contact body 807. Similarly, the first and second faces 816*c* and 816*d* of the contact beam 816 are defined by the first and second broadsides 810 and 812, respectively, of the contact body 807. The contact beam 816 can define a mating portion 817 that is configured to mate with the second complementary electrical component, and a stub 819 that extends from the mating portion 817 to the free end 818.

The anchoring region 814 extends between the mounting end 802 and the contact beam 816. For instance, the anchoring region 814 can extend from the mounting end 802 to the contact beam 816. The anchoring region 814 can define a maximum length $L_{max,2}$. Further, the anchoring region 814 can be disposed partially or fully below a midpoint of the electrical contact 800 along the longitudinal direction L. The contact beam 816 extends between a free end 818 of the electrical contact 818 and the anchoring region 814, such as from the free end 818 to the anchoring region 814, and has a maximum length $L_{max,3}$. One or more up to all of the maximum lengths of the first electrical contact 800 can be different than the corresponding one or more up to all of the maximum lengths of the second electrical contact 800' (FIG. 13) as described in further detail below.

The anchoring region 814 can be substantially planar as it extends from the mounting end 802 to the contact beam 816 along the longitudinal direction L. For instance, the broadsides 810 and 812 can be substantially planar along respective planes that are defined by the longitudinal direction L and the lateral direction A at the anchoring region 814 from the mounting end 812 to the contact beam 816. Alternatively, the anchoring region 814 can have a bent, such as a curved, shape between the mounting end 802 and the contact beam 816.

The anchoring region 814 can include at least one of a first portion, a second portion, and a third portion. The third portion can be between the first and second portions, and thus, can be considered to be an intermediate portion. The third portion can define a width along the lateral direction A that is less than the width of at least one or both of the first and second enlarged portions along the lateral direction A. In one example, one or both of the first and second portions can extend out from the contact body 807. For instance, at least one of the first and second portions can extend out from one or both of the edges 806 and 808 along the lateral direction A. Thus, the third portion can be considered to be a narrowed portion, and one or both of the first and second portions can be considered to be enlarged portions. In one example, the anchoring region 814 can include a first portion 820, an intermediate portion 824, and a second portion 826. The intermediate portion 824 can be disposed between the first and second portions 820 and 826. In one example, the intermediate portion 824 can be defined by one or both of the edges 806 and 808 of the contact body 807.

The first portion 820 can define opposed outermost sides 820*a* and 820*b*. The outermost sides 820*a* and 820*b* can be spaced from each other along the lateral direction A. The outermost sides 820*a* and 820*b* can be outwardly spaced from the respective first and second edges 806 and 808 along the lateral direction A. The first portion 820 can have a width $W_1$ along the lateral direction A from the first outermost side 820*a* to the second outermost side 820*b*, the width $W_1$ being greater than the width $W_2$ of the broadsides 810 and 812 from the first edge 806 to the second edge 808. The first portion 820 can extend between the contact beam 816 and the mounting end 802, such as from the contact beam 816 towards the mounting end 802. The first portion 820 can have a substantially rectangular shape in a plane defined by the longitudinal and lateral directions as shown, or can have any other suitable shape in the plane such as a circle, square, or other polygon. Further, the first portion 820 has a maximum length $L_{max,4}$. While the outermost sides 820*a* and 820*b* of the first portion 820 can be spaced outwardly from the respective edges 806 and 808 with respect to the lateral direction A as described above, it should be appreciated that one or both of the outermost sides 820*a* and 820*b* can be continuous or in-line with the respective first and second edges 806 and 808 as desired. As will be described in further detail below, the maximum length $L_{max,4}$ of the first portion 820 of the first electrical connector 800 in FIG. 12 can be greater than the maximum length $L_{max,4}$ of the first portion 820 of the second electrical connector 800' in FIG. 13.

The first portion 820 can extend out from at least one of the edges 806 and 808 along the lateral direction A. For instance, the first portion 820 can extend out from both edges 806 and 808 of the contact beam 816. Further portion 820 can be coplanar with the broadsides 810 and 812. In alternative embodiments, the portion 820 can extend out from only one of the first and second edges 806 and 808 along the lateral direction A. For example, one of the outermost sides 820*a* and 820*b* of the first portion 820 can be spaced outward from a corresponding one of the first and second edges 806 and 808 with respect to the lateral direction A, and the other of the sides 820*a* and 820*b* of the first portion 820 can be flush or aligned with a corresponding one of the first and second edges 806 and 808 of the contact beam 816.

The first portion 820 can define a body 820*c* and at least one shoulder, such as a first upper shoulder 820*d* that extends from the body 820*c* to the contact body 807, and in particular to one of the first and second edges 806 and 808. The first portion 820 can also define a second upper shoulder 820*d* that extends from the body 820*c* to the contact body 807 and in particular to the other one of the first and second edges 806 and 808. It should be appreciated that one or both of the first and second upper shoulders 820*d* can be omitted in some embodiments. Each upper shoulder 820*d* can extend from the portion 820 to the contact body 807 along a direction having a directional component along the lateral direction A.

The intermediate portion 824 can define opposed outermost sides 824*a* and 824*b*. The outermost sides 824*a* and 824*b* can be spaced from each other along the lateral direction A. In one example, the intermediate portion defines a width $W_3$ from one of the outermost sides 824*a* and 824*b* to the other of the outermost sides 824*a* and 824*b*. The width $W_3$ of the intermediate portion 824 can be less than the corresponding width of one or both of the portions 820 and 826. For instance, the width $W_3$ of the intermediate portion 824 can be less than the width of the broadsides 810 and 812 from one of the sides 820*a* and 820*b* to the other of the sides 820*a* and 820*b*. Alternatively, the width $W_3$ of the intermediate portion 824 can be greater than the width of the broadsides 810 and 812. Alternatively still, the outermost sides 824*a* and 824*b* can be defined by the first and second edges 806 and 808, respectively. Thus, the width $W_3$ of the intermediate portion 824 can be substantially equal to the width of the broadsides 810 and 812.

The intermediate portion 824 can extend between the first portion 820 and the mounting end 802 along the longitudinal direction L. For instance, the intermediate portion 824 can extend from the first portion 820 toward the mounting end 802. The intermediate portion 824 can define a maximum length $L_{max,5}$ along the longitudinal direction L. The intermediate portion 824 can have a substantially rectangular shape in a plane defined by the longitudinal and lateral directions as shown, or can have any other suitable shape in the plane such as a circle, square, or other polygon. Further, the first outermost side 824*a* can be linear as it extends from the first portion 820 towards the mounting end 802. Similarly, the second outermost side 824*b* can be linear as it extends from the first portion 820 towards the mounting end 802. As will be described in further detail below, the intermediate portion 824 of the second electrical connector 800' in FIG. 13 can be offset from the intermediate portion 824 of the first electrical connector 800 in FIG. 12 with respect to the longitudinal direction L.

The first portion 820 can define at least one lower shoulder, such as a first lower shoulder 820*e* that extends from the body 820*c* of the first portion 820 to the intermediate portion 824. For instance, the first lower shoulder 820*e* can extend from one of the outermost sides 820*a* and 820*b* to a corresponding one of the outermost sides 824*a* and 824*b*. The first portion 820 can also define a second lower shoulder 820*e* that extends from the body 820*c* to the intermediate portion 824. For instance, the second lower shoulder 820*e* can extend the other of the outermost sides 820*a* and 820*b* to the corresponding other of the outermost sides 824*a* and 824*b*. It should be appreciated that one or both of the first and second lower shoulders 820*e* can be omitted in some embodiments. Each lower shoulder 820*e* can extend from the portion 820 to the intermediate portion 824 along a direction having a directional component along the lateral direction A. Further, each lower shoulder 820*e* can face away from a corresponding upper shoulder 820*d*.

The second portion 826 can define opposed outermost sides 826*a* and 826*b*. The outermost sides 826*a* and 826*b* can be spaced from each other along the lateral direction A. The outermost sides 826*a* and 826*b* can be outwardly spaced from the respective first and second sides 824*a* and 824*b* of the intermediate portion 824 along the lateral direction A. The outermost sides 826*a* and 826*b* can also be outwardly spaced from the respective first and second edges 806 and 808 along the lateral direction A. The second portion 826 can have a width $W_4$ along the lateral direction A from the first outermost side 826*a* to the second outermost side 826*b*, the width $W_4$ being greater than the width $W_2$ of the broadsides 810 and 812 from the first edge 806 to the second edge 808. The second portion 826 can extend between the contact beam 816 and the mounting end 802, such as from the mounting end 802 towards the contact beam 816. The second portion 826 can have a substantially rectangular shape in a plane defined by the longitudinal and lateral directions as shown, or can have any other suitable shape in the plane such as a circle, square, or other polygon. Further, the second portion 826 has a maximum length $L_{max,6}$. While the outermost sides 826*a* and 826*b* of the second portion 826 can be spaced outwardly from the respective first and second sides 824*a* and 824*b* with respect to the lateral direction A as described above, it should be appreciated that one or both of the outermost sides 826*a* and 826*b* can be continuous with the respective first and second sides 824*a* and 824*b* as desired. As will be described in further detail below, the maximum length $L_{max,6}$ of the second portion 826 of the first electrical connector 800 in FIG. 12 can be less than the maximum length $L_{max,6}$ of the second portion 826 of the second electrical connector 800' in FIG. 13.

The second portion 826 can extend outward from at least one of the sides 824*a* and 824*b* of the intermediate portion 824 along the lateral direction A. For instance, the second portion 826 can extend outward from both of the sides 824*a* and 824*b* of the intermediate portion 824. Further, the second portion 826 can be coplanar with the broadsides 810 and 812. In alternative embodiments, the second portion 826 can extend out from only one of the first and second sides 824*a* and 824*b* along the lateral direction A. For example, one of the outermost sides 826*a* and 826*b* of the second portion 826 can be spaced outward from a corresponding one of the first and second sides 824*a* and 824*b* with respect to the lateral direction A, and the other of the sides 826*a* and 826*b* of the second portion 826 can be flush or aligned with a corresponding one of the first and second sides 824*a* and 824*b* of the intermediate portion.

The second portion 826 can define a body 826*c* and at least one shoulder, such as a first upper shoulder 826*d* that extends from the body 826*c* to the intermediate portion 824, and in particular to one of the first and second sides 824*a* and 824*b* of the intermediate portion 824. The second portion 826 can also define a second upper shoulder 826*d* that extends from the body 826*c* to the intermediate portion 824, and in particular to the other one of the first and second sides 824*a* and 824*b* of the intermediate portion 824. It should be appreciated that one or both of the first and second upper shoulders 826*d* can be omitted in some embodiments. Each upper shoulder 820*d* can extend from the portion 826 to the contact body intermediate portion 824 along a direction having a directional component along the lateral direction A. Further, each upper shoulder 826*c* can face towards a corresponding lower shoulder 820*c* of the first portion 820.

The second portion 826 can define at least one lower shoulder, such as a first lower shoulder 826*e* that extends from the body 826*c* of the second portion 826 to the mounting tail 834. For instance, the first lower shoulder 826*e* can extend from one of the outermost sides 826*a* and 826*b* to a corresponding side of the mounting tail 834. The second portion 826 can also define a second lower shoulder 826*e* that extends from the body 826*c* of the second portion 826 to the mounting tail 834. For instance, the second lower shoulder 826*e* can extend from the other one of the outermost sides 826*a* and 826*b* to a corresponding side of the mounting tail 834. It should be appreciated that one or both of the first and second lower shoulders 826*e* can be omitted in some embodiments. Each lower shoulder 826*e* can extend from the portion 826 to the mounting tail 834 along a direction having a directional component along the lateral direction A. Further, each lower shoulder 826*e* can face away from a corresponding upper shoulder 826*d*.

As will become appreciated from the description below, at least one first and second portions of the second electrical contact 800' is configured to reside at a location aligned with the intermediate portion 824 of the first electrical contact 800 along the lateral direction A. Similarly, at least one first and second portions of the first electrical contact 800 is configured to reside at a location aligned with the intermediate portion 824 of the second electrical contact 800' along the lateral direction A.

The anchoring regions 814 of each of the first and second electrical contacts 800 and 800' can include at least one retention feature 822 that is configured to engage the connector housing 602 so as to secure the electrical contact to the connector housing 602. For example, each anchoring region can include two retention features 822 that are spaced from one another along the lateral direction A. The two retention features 822 can be aligned along the lateral direction A. Each retention feature 822 can define a barb having a first barb end 822*a* that is connected to the body of the anchoring region 814 in a hinged manner. Each retention feature 822 can further include a second, or free, barb end 822*b* that is opposite the first barb end 822*a* and is free from attachment to the body of the anchoring region 814. As shown, the second barb end 822*b* can be spaced from the first barb end 822*a* along the longitudinal direction L, and the hinge can be configured to bend about an axis that extends along the lateral direction A so as to offset the second barb end 822*b* from the first barb end 822*a* along the transverse direction T. Alternatively, the second barb end 822*b* can be spaced from the first barb end 822*a* along the lateral direction A, and the hinge can be configured to bend about an axis that extends along the longitudinal direction L so as to offset the second barb end 822*b* from the first barb end 822*a* along the transverse direction T. Note that, in alternative embodiments, the at least one retention feature 822 can define a feature other than a barb, such as (without limitation) a fixed protrusion, or a recess that receives a protrusion on the connector housing 602, or the at least one retention feature 822 can be omitted altogether.

In FIG. 12, the first barb end 822*a* of each retention feature 822 is connected to the body 820*c* of the first portion 820. For example, the contact 800 can include a first retention feature 822 connected to the body 820*c* at the first side 820*a* of the first portion 820, and a second retention feature 822 connected to the body 820*c* at the second side 820*b* of the first portion 820. Further, each retention feature 822 extends from the body 820*c* towards the intermediate portion 824 along the longitudinal direction L. In one example, each retention feature 822 can extend from the body 820*c* and terminate at or before the intermediate portion 824.

In FIG. 13, the first barb end 822*a* of each retention feature 822 is connected to the body 824*c* of the intermediate portion 824. For example, the contact 800' can include a first retention feature 822 connected to the body 824*c* at the first side 824*a* of the intermediate portion 824, and a second retention feature 822 connected to the body 824*c* at the second side 824*b* of the intermediate portion 824. Further, each retention feature 822 extends from the body 824*c* towards the second portion 826 along the longitudinal direction L. In one example, each retention feature 822 can extend from the body 824*c* and terminate at the second portion 826. For instance, each retention feature 822 can include an upper shoulder 826*d* of the second portion 826. Thus, as will be further described below, the retention features 822 of the second electrical contact 800' can be offset from the retention features 822 of the first electrical contact 800 with respect to the longitudinal direction L.

The contact beam 816 can be constructed as a flexible beam having a bent, such as curved, shape that extends from the anchoring region 814 to a free end 818 of the electrical contact 800. Bent structures as described herein refer to bent shapes that can be fabricated, for instance, by bending the end or by stamping a bent shape, or by any other suitable manufacturing process. The first broadside 810 at the contact beam 816 is configured to wipe against a corresponding electrical contact 900 of the second electrical connector 700 as the connector is mated with the contact beam 816 along the longitudinal direction L. Further, the contact beam 816 is configured to contact the corresponding contact 900 second electrical connector 700 so as to apply a force to the corresponding contact 900 along the transverse direction T.

The contact beam 816 can include at least a first bend region 829 between the anchoring region 814 and the mating end 804. The first bend region 829 can curve towards a first direction that extends from the second broadside 812 toward the first broadside 810 as the contact beam 816 extends away from the anchoring region 814 along the longitudinal direction L. The contact beam 816 can further include at least a second bend region 830 that is between the first bend region 829 and the mating end 804. The second bend region 829 can curve towards a second direction, opposite the first direction, that extends from the first broadside 810 toward the second broadside 812 as the contact beam 816 extends away from the first bend region 829 along the longitudinal direction L. The contact beam 816 can include at least a third bend region 832 between the second bend region 830 and the mating end 804. The third bend region 832 can curve towards the first direction that extends from the second broadside 812 toward the first broadside 810 as the contact beam 816 extends away from the second bend region 830 along the longitudinal direction L. In alternative embodiments, the curvature of the contact beam 816 can vary from that shown. For example, the contact beam 816 can include as few as one bend region, or greater than two bend regions.

The anchoring region 814 can define a central axis CA that extends in the longitudinal direction between the first and second broadsides 810 and 812. One or more of the second bend region 830, the third bend region 832, and the free end 818 can extend at least partially on a first side of the central axis CA with respect to the transverse direction T, the first side being spaced from the central axis CA along a direction that is opposite the first broadside 212.

The mounting end 802 can include a mounting tail 834 that extends away from the anchoring region 814 along the longitudinal direction L. For example, the mounting tail 834 can define a press-fit tail that is coplanar with the anchoring region 814. In alternative embodiments, the mounting tail 834 can be configured as a surface-mount tail, as a differently-configured press-fit tail, as a fusible element such as a solder ball, or combinations thereof. The electrical contact 800 defines maximum length $L_{max,1}$ along the longitudinal direction L from the free end 818 to the terminal end 836. The electrical contact 800 further defines a maximum width $W_{max,1}$ along the lateral direction A. The maximum width $W_{max,1}$ can be equal to at least one of the width $W_1$ of the first portion 820 and the width $W_4$ of the second portion 826, such as a larger of the widths $W_1$ and $W_4$. Alternatively, the maximum width $W_{max,1}$ can be equal to both the width $W_1$ of the first portion 820 and the width $W_4$ of the second portion 826 when the widths $W_1$ and $W_4$ are equal. The contact body 807 yet further defines a maximum thickness $T_{max}$ along the transverse direction T from one of the opposed broadsides 810 and 812 to the other. The maximum length $L_{max,1}$ of the electrical contact 800 is greater than both the maximum width $W_{max,1}$ and the maximum thickness $T_{max}$. Further, the maximum width $W_{max,1}$ of the electrical contact 800 can be greater than the maximum thickness $T_{max}$. Thus, the electrical contact 800 can be said to be elongate along the longitudinal direction L.

Figure 14:
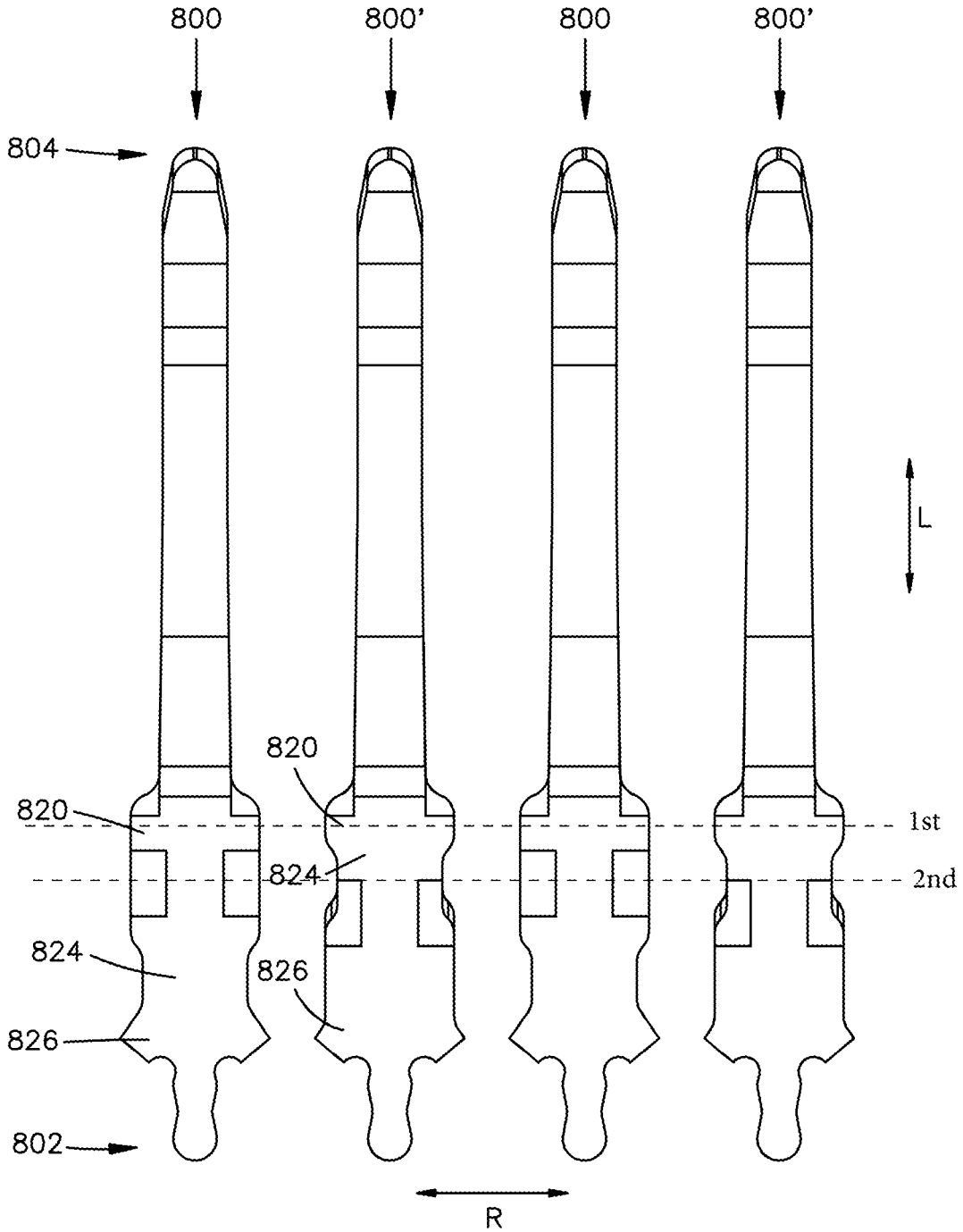
FIG. 14 shows front plan view of a row of the electrical contacts of the first electrical connector of FIG. 11.

Turning now to FIG. 14, embodiments of the present disclosure can include a kit having at least one first electrical contact 800 and at least a second electrical contact 800'. For instance, the kit can have a first set of the first electrical contacts 800 and a second set of the second electrical contacts 800'. The first and second electrical contacts 800 and 800' can be arranged edge-to-edge in a row of the electrical connector 600. Further, the first and second electrical contacts 800 and 800' can be arranged such that the mounting ends 802 of the first and second electrical contacts 800 and 800' are aligned along the lateral direction A. In this arrangement, the anchoring regions 814 of the first and second electrical contacts 800 and 800' can be aligned along the lateral direction A.

The anchoring region 814 of each of the first and second electrical contacts 800 and 800' can define an upper-most point and a lower-most point, the upper-most point being closer to the mating end of the electrical contact, and the lower-most point being closer to the mounting end of the electrical contact 800. In one example, the upper-most points of one or more, up to all, of the anchoring regions 814 of the first electrical contacts 800 can be aligned with the upper-most points of one or more, up to all, of the anchoring regions 814 of the second electrical contacts 800' along the lateral direction A. Further, lower-most points of one or more, up to all, of the anchoring regions 814 of the first electrical contacts 800 can be aligned with the lower-most points of one or more, up to all, of the anchoring regions 814 of the second electrical contacts 800' along the lateral direction A. Alternatively, at least one of (i) the upper-most points of the anchoring regions 814 of the first and second electrical contacts 800 and 800' can be offset from one another, and (ii) the lower-most points of the anchoring regions 814 of the first and second electrical contacts 800 and 800' can be offset from one another.

The first portions 820 of the first and second electrical contacts 800 and 800' can each define a center. The centers of the first portions 820 of the first electrical contacts 800 can be aligned along a first line that extends substantially along the lateral direction A. Similarly, the centers of the first portions 820 of the second electrical contacts 800' can be aligned along a second line that extends substantially along the lateral direction A. The second line can be offset from the first line along the longitudinal direction L. For instance, the second line can be closer to the mounting ends 802 than the first line. Further, the second line can be substantially parallel to the first line.

The intermediate portions 824 of each adjacent pair of first and second electrical contacts 800 and 800' can be offset relative to one another with respect to the lateral direction A. For example, the intermediate portion 824 of each first electrical contact 800 is aligned with the second portion 826 of each second electrical contact 800' along the lateral direction A. Further, the intermediate portion 824 of each second electrical contact 800' is aligned with the first portion 826 of each first electrical contact 800 along the lateral direction A. In at least some embodiments, the intermediate portion 824 and the second portion 826 of each first electrical contact 800 can be aligned with the second portion 826 of each second electrical contact 800' along the lateral direction A. Further, the intermediate portion 824 and first portion 820 of each second electrical contact 800' can aligned with the first portion 826 of each first electrical contact 800 along the lateral direction A.

Additionally, or alternatively, the retention features 822 of each adjacent pair of first and second electrical contacts 800 and 800' can be staggered relative to one another with respect to the longitudinal direction L. For example, the at least one retention feature 822 of each first electrical contact 800 can be disposed closer to the mating ends 804 of the contacts with respect to the longitudinal direction L than the at least one retention feature of each second electrical contact 800'. Further, the at least one retention feature 822 of each second electrical contact 800' can be disposed closer to the mounting ends 802 of the contacts with respect to the longitudinal direction L than the at least one retention feature of each first electrical contact 800. For example, a distance from the free end 818 of each first electrical contact 800 to the at least one retention feature 822 of the first electrical contact 800 can be less than a distance from the free end 818 of each second electrical contact 800' to its at least one retention feature 822. Further, a distance from the mounting tail 834 of each second electrical contact 800' to the at least one retention feature 822 of the second electrical contact 800' can be less than a distance from the mounting tail 834 of each first electrical contact 800 to its at least one retention feature 822.

Each first electrical contact 800 can have a maximum length $L_{max,1}$ along the longitudinal direction L from the mounting end 802 of the first electrical contact 800 to the mating end 804 of the first electrical contact 800 that is substantially equal to a maximum length $L_{max,1}$ of the second electrical contact 800' along the longitudinal direction L from the mounting end 802 of the second electrical contact 800' to the mating end 804 of the second electrical contact 800'. The anchoring region 814 of the first electrical contact 800 can have a maximum length $L_{max,2}$ that is substantially equal to a maximum length $L_{max,2}$ of the anchoring region 814 of the second electrical contact 800'. The intermediate portion 824 of the first electrical contact 800 can have a maximum length $L_{max,5}$ that is substantially equal to a maximum length $L_{max,5}$ of the intermediate portion 824 of the second electrical contact 800'. The first portion 820 of the first electrical contact 800 can have a maximum length $L_{max,4}$ that is greater than a maximum length $L_{max,4}$ of the first enlarged 820 of the second electrical contact 800'. The second portion 826 of the first electrical contact 800 can have a maximum length $L_{max,6}$ that is less than a maximum length $L_{max,6}$ of the second portion 826 of the second electrical contact 800'. The contact beam 816 of the first electrical contact 800 can have a maximum length $L_{max,3}$ that is substantially equal to a maximum length $L_{max,3}$ of the contact beam 816 of the second electrical contact 200'. In alternative embodiments, at least one of the maximum length $L_{max,1}$ of the first electrical contact 800, the maximum length of the anchoring region 814 of the first electrical contact 800, the maximum length $L_{max,5}$ of the intermediate portion 824 of the first electrical contact 800, and the maximum length $L_{max,3}$ of the contact beam 816 of the first electrical contact 800 can vary from the corresponding dimension of the second electrical contact 800'.

In at least one embodiment, the contacts 800 and 800' within each row can define an open pin field, or each of the contacts 800 and 800' can alternatively be designated as a signal or ground. Each first electrical contact 800 can each define either a signal contact or a ground contact, and each second electrical contact 800' can define either a signal contact or a ground contact. For example, the first and second sets of the contacts can be spaced along the row direction R in alternating fashion such that each pair of adjacent first contacts 800 are separated by a second contact 800', and each pair of adjacent second contacts 800' are separated by a first contact 800. For instance, the electrical contacts can define the following pattern along the row direction R from left to right: ground-signal-ground-signal-ground-signal, which can be repeated. It will be appreciated that other patterns are possible.

Figure 15:
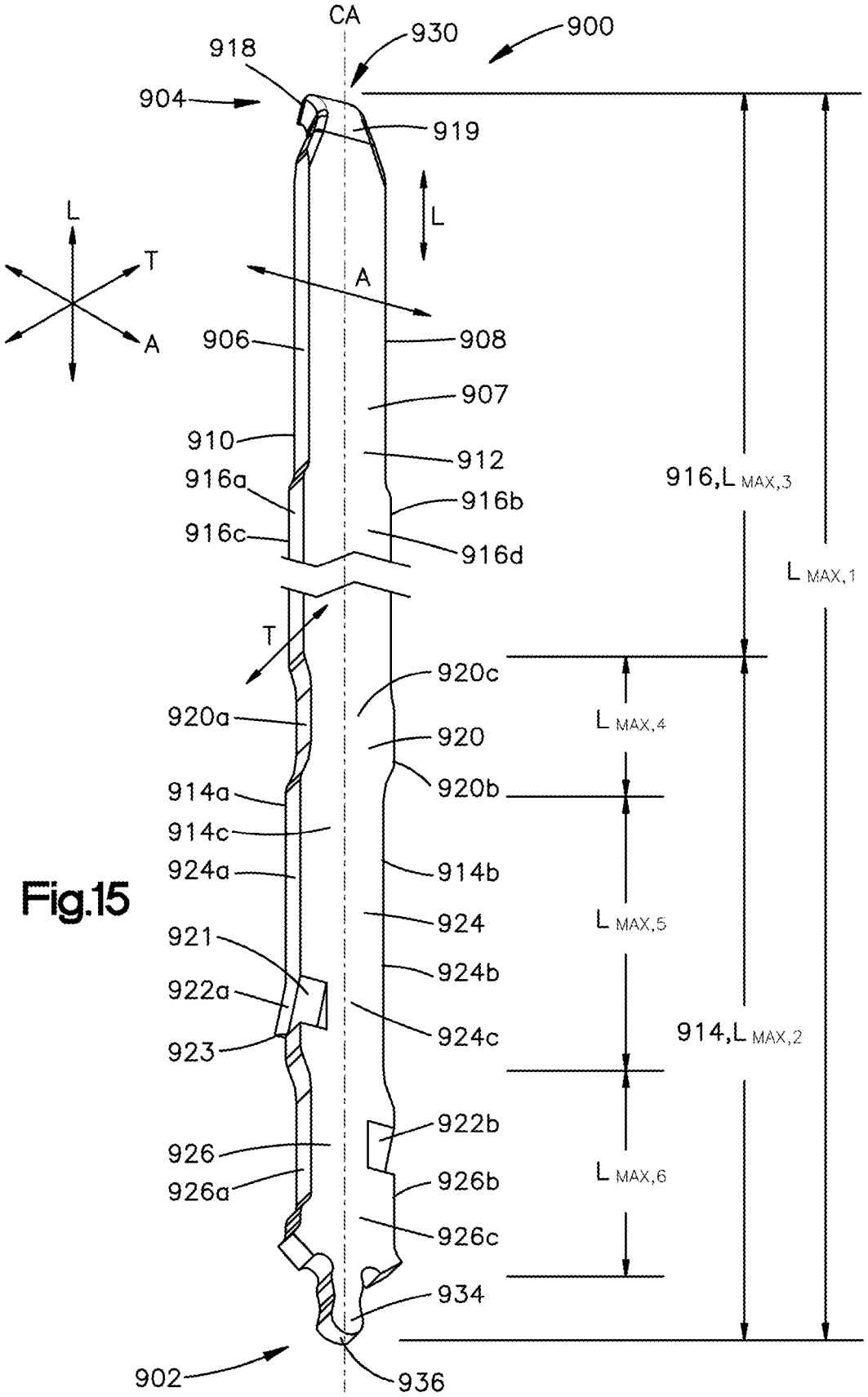
FIG. 15 shows a perspective view of one embodiment of an electrical contact of the second electrical connector of FIG. 11.

Turning now to FIG. 15, each row of contacts of the second electrical connector 700 includes a set of third electrical contacts 900. Each of the third contacts 900 includes an anchoring region 914 and a contact beam 916. As will be described in further detail below, each anchoring region 914 includes one or more portions 920, 924, and 926.

The electrical contact 900 includes a mounting end 902, and a mating end 904 opposite the mounting end 902 along the longitudinal direction L. In one example, the electrical contact 900 can be a vertical electrical contact whereby the mating direction and mounting direction are oriented along the same direction, such as along the longitudinal direction L. Alternatively, the electrical contact 900 can be configured as a right-angle contact, whereby the mating direction and the mounting direction are oriented substantially perpendicular to each other in a manner similar to that described above in relation to FIGS. 6 and 7.

The electrical contact 900 includes a contact body 907 that defines first and second edges 906 and 908, and first and second broadsides 910 and 912. The first and second edges 906 and 908 are spaced opposite from one another along the lateral direction A. Thus, the first and second edges 906 and 908 can face away from one another. At least respective portions of the first and second broadsides 910 and 912 can be spaced opposite each other along the transverse direction T. Thus, the first and second broadsides 910 and 912 can face away from one another. It should therefore be appreciated that each of the first and second edges 906 and 908 are connected between the first and second broadsides 910 and 912. Similarly, each of the first and second broadsides 910 and 912 are connected between the first and second edges 906 and 908. The edges 906 and 908 and broadsides 910 and 912 can define respective distances along a plane that is oriented normal to the contact body 907. For instance, the edges 906 and 908 can each extend along a first distance from one of the first and second broadsides 910 and 912 to the other of the first and second broadsides 910 and 912 along the plane. The broadsides 910 and 912 can each extend along a second distance from one of the first and second edges 906 and 908 to the other of the first and second edges 906 and 908 along the plane. The second distance can be greater than the first distance. In one example, the first distance can define a thickness of the contact body 907, and the second distance can define a width of the contact body 907. The thickness along at least a portion of the contact body 907 can be oriented along the transverse direction T, and the width along at least a portion of the contact body 907 can be oriented along the lateral direction A.

The electrical contact 900 includes an anchoring region 914 that is configured to secure the electrical contact to the connector housing 702 of the electrical connector 700. The electrical contact 900 further includes a contact beam 916 that extends out with respect to the anchoring region 914. For instance, the contact beam 916 can extend out with respect to the anchoring region 914 along the longitudinal direction L. In one example, the contact beam 916 can extend from the anchoring region 914.

The contact beam 916 has first and second sides **916*a* and 916*b*, and first and second faces 916*c* and 916*d*. The first and second sides 916*a* and 916*b* of the contact beam 916 are defined by the first and second edges 906 and 908, respectively, of the contact body 907. Similarly, the first and second faces 916*c* and 916*d* of the contact beam 916 are defined by the first and second broadsides 910 and 912, respectively, of the contact body 907. The contact beam 916 can define a mating portion 917 that is configured to mate with the second complementary electrical component, and a stub 919 that extends from the mating portion 917 to the free end 918**.

The anchoring region 914 extends between the mounting end 902 and the contact beam 916. For instance, the anchoring region 914 can extend from the mounting end 902 to the contact beam 916. The anchoring region 914 can define a maximum length $L_{max,2}$ from the mounting end 902 to the contact beam 916. Further, the anchoring region 914 can be disposed partially or fully below a midpoint of the electrical contact 900 along the longitudinal direction L. The contact beam 916 extends between a free end 918 of the electrical contact 918 and the anchoring region 914, such as from the free end 918 to the anchoring region 914, and has a maximum length $L_{max,3}$.

The anchoring region has a body **914*c* that includes opposed first and second sides 914*a* and 914*b* that are spaced from one another along the lateral direction A. The anchoring region 914 can be substantially planar as it extends from the mounting end 902 to the contact beam 916 along the longitudinal direction L. For instance, the broadsides 910 and 912 can be substantially planar along respective planes that are defined by the longitudinal direction L and the lateral direction A at the anchoring region 914 from the mounting end 912 to the contact beam 916. Alternatively, the anchoring region 914 can have a bent, such as a curved, shape between the mounting end 902 and the contact beam 916**.

The anchoring region 914 can include at least one portion. In one example, the anchoring region 914 can include a first portion 920, a second portion 926, and a third portion 924. The third portion 924 can be between the first and second portions 920 and 926, and thus can be considered to be an intermediate portion. The first portion 920 can extend between the contact beam 916 and the mounting end 902. For example, the first portion 920 can extend from the contact beam 916 toward the mounting end 902. The first portion 920 can have a body 920*c* that defines opposed outermost sides 920*a* and 920*b*. The outermost sides 920*a* and 920*b* can be spaced from each other along the lateral direction A. The second outermost side 920*b* can be outwardly spaced from the second edge 908 along the lateral direction A. The first outermost side 920*a* can extend up to the first edge 906. For example, the first outermost side 920*a* can be spaced inwardly from, or be aligned with, the first edge 906. In some embodiments, as shown in FIG. 15, the first portion 920*a* can be considered to be a first jogged portion. The first portion 920 has a maximum length $L_{max,4}$. Further, the first portion 920 can be coplanar with the broadsides 910 and 912.

The second portion 926 can extend between the mounting end 902 and the intermediate portion 924. For example, the second portion 926 can extend from the mounting end 902 towards the intermediate portion 924. The second portion 926 can have a body 926*c* that defines opposed outermost sides 926*a* and 926*b*. The outermost sides 926*a* and 926*b* can be spaced from each other along the lateral direction A. The second outermost side 926*b* can be outwardly spaced from the second edge 908 along the lateral direction A. The first outermost side 926*a* can extend up to the first edge 906. For example, the first outermost side 926*a* can be spaced inwardly from, or be aligned with, the first edge 906. In some embodiments, as shown in FIG. 15, the second portion 926*a* can be considered to be a second jogged portion. The second portion 926 has a maximum length $L_{max,6}$. Further, the second portion 926 can be coplanar with the broadsides 910 and 912.

The intermediate portion 924 can extend between the first portion 920 and the mounting end 902. For example, the intermediate portion 924 can extend from the first portion 920 towards the mounting end 902. The intermediate portion 924 have a body 924*c* that defines opposed outermost sides 924*a* and 924*b*. The outermost sides 924*a* and 924*b* can be spaced from each other along the lateral direction A. The first outermost side 924*b* can be outwardly spaced from the first edge 906 along the lateral direction A. The second outermost side 924*b* can extend up to the second edge 908. For example, the second outermost side 924*b* can extend inward from, or be aligned with, the second edge 908. In some embodiments, as shown in FIG. 15, the intermediate portion 924*a* can be considered to be a third jogged portion. The intermediate portion 924 has a maximum length $L_{max,5}$. Further, the intermediate portion 924 can be coplanar with the broadsides 910 and 912.

The contact beam 916 can define a central axis CA that extends in the longitudinal direction between the first and second edges 906 and 908. The first side 920*a* of the first portion 920 can be spaced closer to the central axis CA than the second side 920*b* of the first portion 920. In one example, the first portion 920 can have a central axis that is offset from the central axis CA of the contact beam 916 along a first lateral direction that extends from the first edge 906 towards the second edge 908. Thus, it can be said that the first portion 920 is offset from the central axis CA along the first lateral direction. The second side 924*b* of the intermediate portion 924 can be spaced closer to the central axis CA than the first side 924*a* of the intermediate portion 924. In one example, the intermediate portion 924 can have a central axis that is offset from the central axis CA of the contact beam 916 along a second lateral direction that is opposite the first lateral direction and that extends from the second edge 908 towards the first edge 906. Thus, it can be said that the intermediate portion 924 is offset from the central axis CA along the second lateral direction. The first side 926*a* of the second portion 926 can be spaced closer to the central axis CA than the second side 926*b* of the second portion 926. In one example, the second portion 926 can have a central axis that is offset from the central axis CA of the contact beam 916 along the first lateral direction that extends from the first edge 906 towards the second edge 908. Thus, it can be said that the second portion 926 is offset from the central axis CA along the first lateral direction. It will be appreciated that, in other examples, the directions of the first, second, and third portions can be reversed.

The anchoring region 914 can include at least one retention feature 922 that is configured to engage the connector housing 702 so as to secure the electrical contact to the connector housing 702. Each retention feature 922 can define a barb having a first barb end 921 that extends from the body 914*c* of the anchoring region 914 in a hinged manner. Each retention feature 922 can further include a second, or free, barb end 923 that is opposite the first barb end 921 and is free from attachment to the body 914*c* of the anchoring region 914. As shown, the second barb end 923 can be spaced from the first barb end 921 along the longitudinal direction L, and the hinge can be configured to bend about an axis that extends along the lateral direction A so as to offset the second barb end 923 from the first barb end 921 along the transverse direction T. Alternatively, the second barb end 923 can be spaced from the first barb end 921 along the lateral direction A, and the hinge can be configured to bend about an axis that extends along the longitudinal direction L so as to offset the second barb end 923 from the first barb end 921 along the transverse direction T. Note that, in alternative embodiments, the at least one retention feature 922 can define a feature other than a barb, such as (without limitation) a fixed protrusion, or a recess that receives a protrusion on the connector housing 702, or the at least one retention feature 922 can be omitted altogether.

In the illustrated example of FIG. 15, the anchoring region 914 has first and second retention features 922*a* and 922*b* that define first and second barbs. The first retention feature 922*a* can be connected to the body 914*c* at the first side 914*a* of the anchoring region 914 and the second retention feature 922*b* can be connected to the body 914*c* at the second side 914*b* of the anchoring region 914. Thus, the first and second retention features 922*a* and 922*b* can be offset from one another with respect to the lateral direction A. The first retention feature 922*a* can be connected to the body 914*c* at a location closer to the mating end 904 than the second retention feature 922*b*. Accordingly, the second retention feature 922*b* can be connected to the body 914*c* at a location closer to the mounting end 902 than the first retention feature 922*a*. Thus, the first and second retention features 922*a* and 922*b* can be offset from one another with respect to the longitudinal direction L.

In the illustrated example, the first barb end 921 of the first retention feature 922*a* can be connected to the body 924*c* of the intermediate portion 924. Further, the first retention feature 922*a* can extend toward the second portion 926. The first retention feature 922*a* can also terminate before the second portion 926. The first barb end 921 of the second retention feature 922*b* can be connected to the body 926*c* of the second portion 926. Further, the second retention feature 922*b* can extend toward the mounting tail 934. The second retention feature 922*b* can also terminate before the mounting tail 934.

The contact beam 916 can be constructed as a flexible beam having a bent, such as curved, shape that extends from the anchoring region 914 to a free end 918 of the electrical contact 900. Bent structures as described herein refer to bent shapes that can be fabricated, for instance, by bending the end or by stamping a bent shape, or by any other suitable manufacturing process. The first broadside 910 at the contact beam 916 is configured to wipe against a corresponding electrical contact 800, 800' of the first electrical connector 600 as the connector is mated with the contact beam 916 along the longitudinal direction L. Further, the contact beam 916 is configured to contact the corresponding contact 800, 800' of the first electrical connector 600 so as to apply a force to the corresponding contact 800, 800' along the transverse direction T.

The contact beam 916 can include at least one bend region 930 between the anchoring region 914 and the mating end 904. The at least one bend region 830 can curve towards a first direction that extends from the second broadside 912 toward the first broadside 910 as the contact beam 916 extends away from the anchoring region 914 along the longitudinal direction L. In alternative embodiments, the curvature of the contact beam 916 can vary from that shown. For example, the contact beam 916 can include more than one bend region, or can have a bend region that is located other than as shown.

The mounting end 902 can include a mounting tail 934 that extends away from the anchoring region 814 along the longitudinal direction L. For example, the mounting tail 934 can define a press-fit tail that is coplanar with the anchoring region 914. In alternative embodiments, the mounting tail 934 can be configured as a surface-mount tail, as a differently-configured press-fit tail, as a fusible element such as a solder ball, or combinations thereof. The electrical contact 900 defines maximum length $L_{max,1}$ along the longitudinal direction L from the free end 918 to the terminal end 936 of the mounting tail 934. The electrical contact 900 further defines a maximum width $W_{max,1}$ along the lateral direction A. The contact body 907 yet further defines a maximum thickness $T_{max}$ along the transverse direction T from one of the opposed broadsides 910 and 912 to the other. The maximum length $L_{max,1}$ of the electrical contact 900 is greater than both the maximum width $W_{max,1}$ and the maximum thickness $T_{max}$. Further, the maximum width $W_{max,1}$ of the electrical contact 900 can be greater than the maximum thickness $T_{max}$. Thus, the electrical contact 900 can be said to be elongate along the longitudinal direction L.

Figure 16:
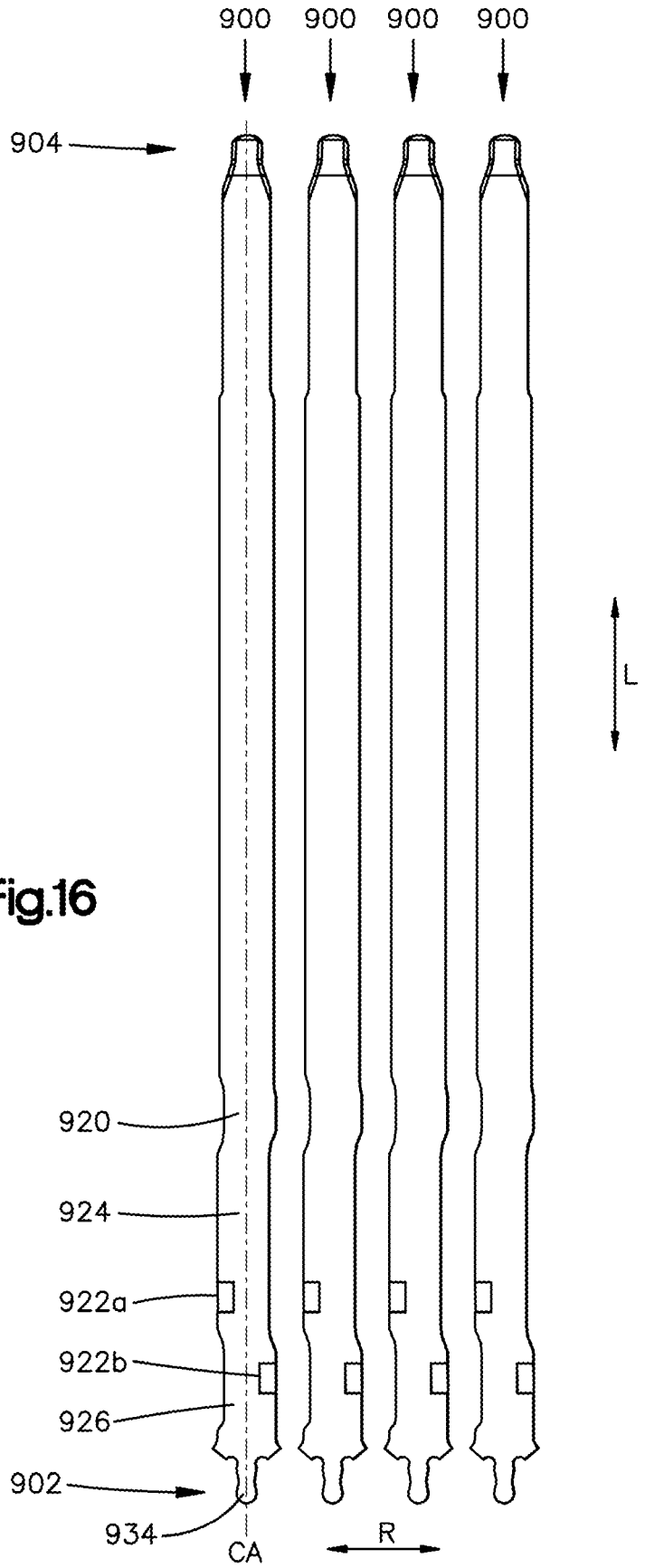
FIG. 16 shows front plan view of a row of the electrical contacts of the second electrical connector of FIG. 11.
Figure 17:
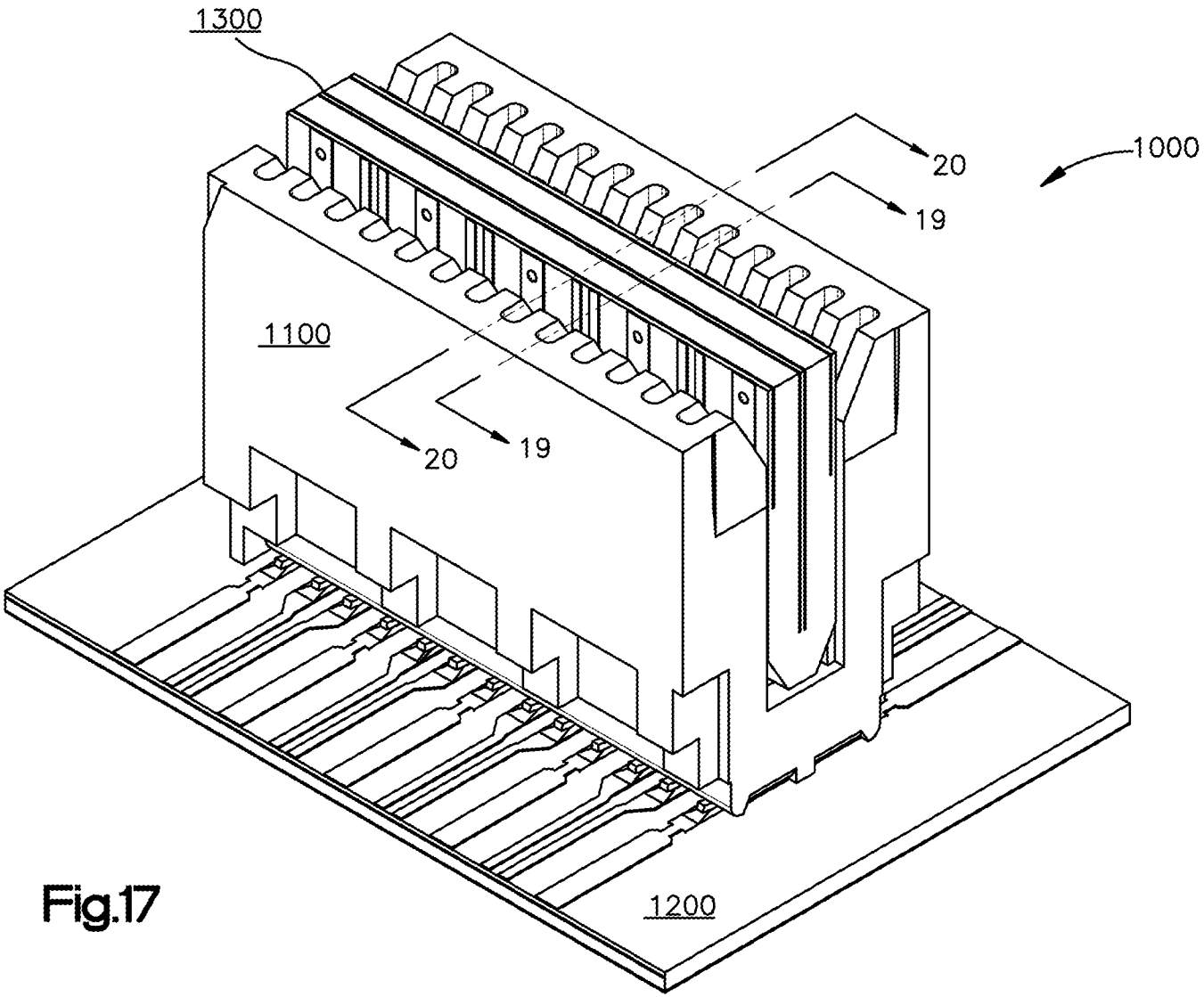
FIG. 17 shows a perspective view of an electrical connector system according to one embodiment having a first complementary electrical component, an electrical connector mounted onto the first complementary electrical component, and a second complementary electrical component mated with the electrical connector.
Figure 18:
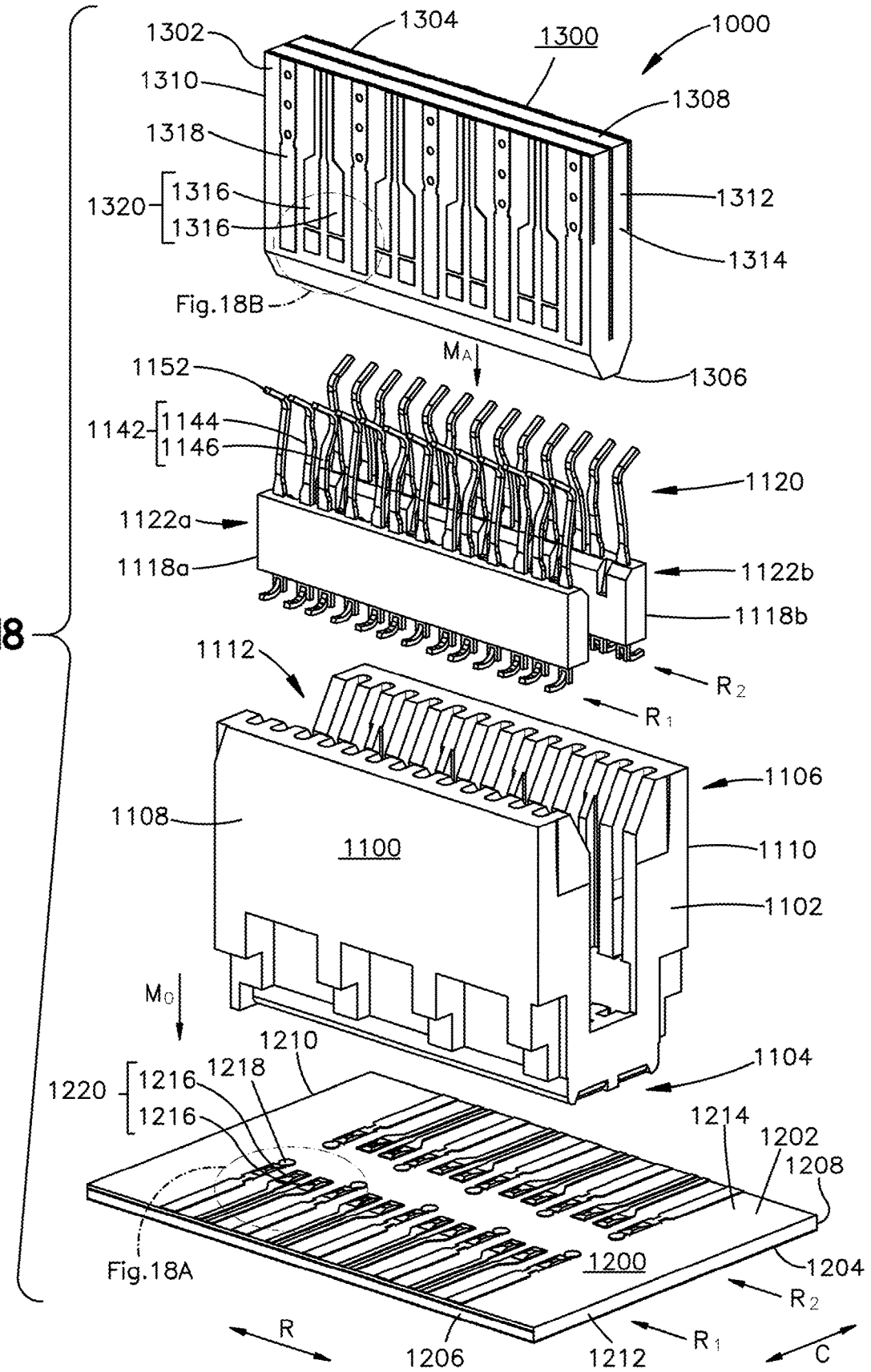
FIG. 18 shows an exploded perspective view of the electrical connector system of FIG. 17.
Figure 18A:
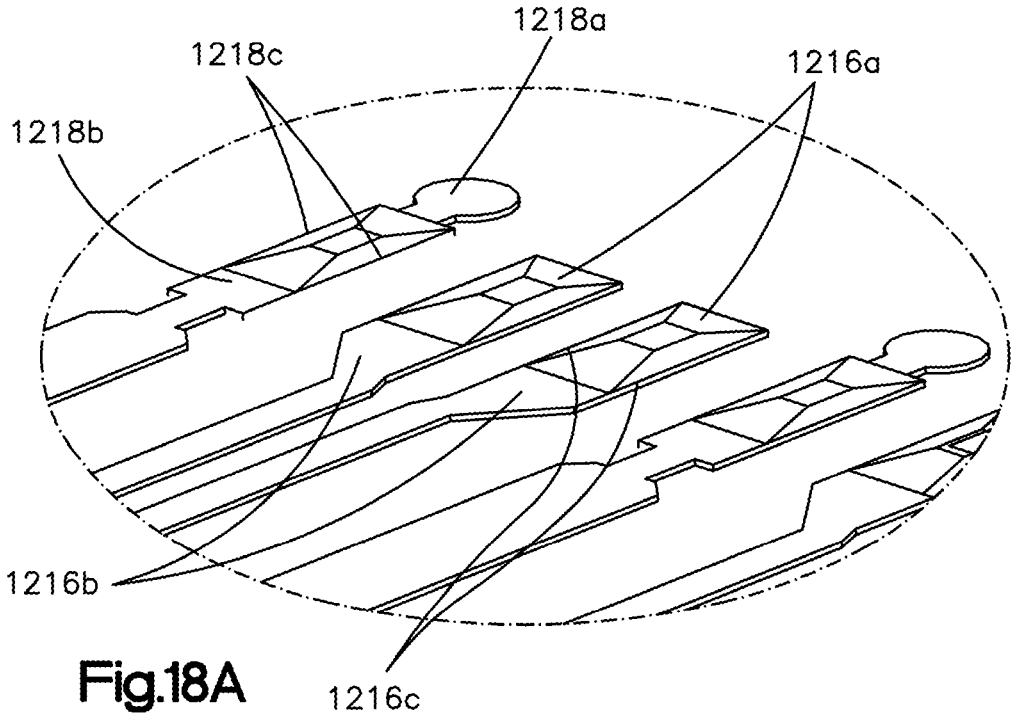
FIG. 18A shows an enlarged view of some of the contact pads of the first complementary electrical component of FIG. 17.
Figure 18B:
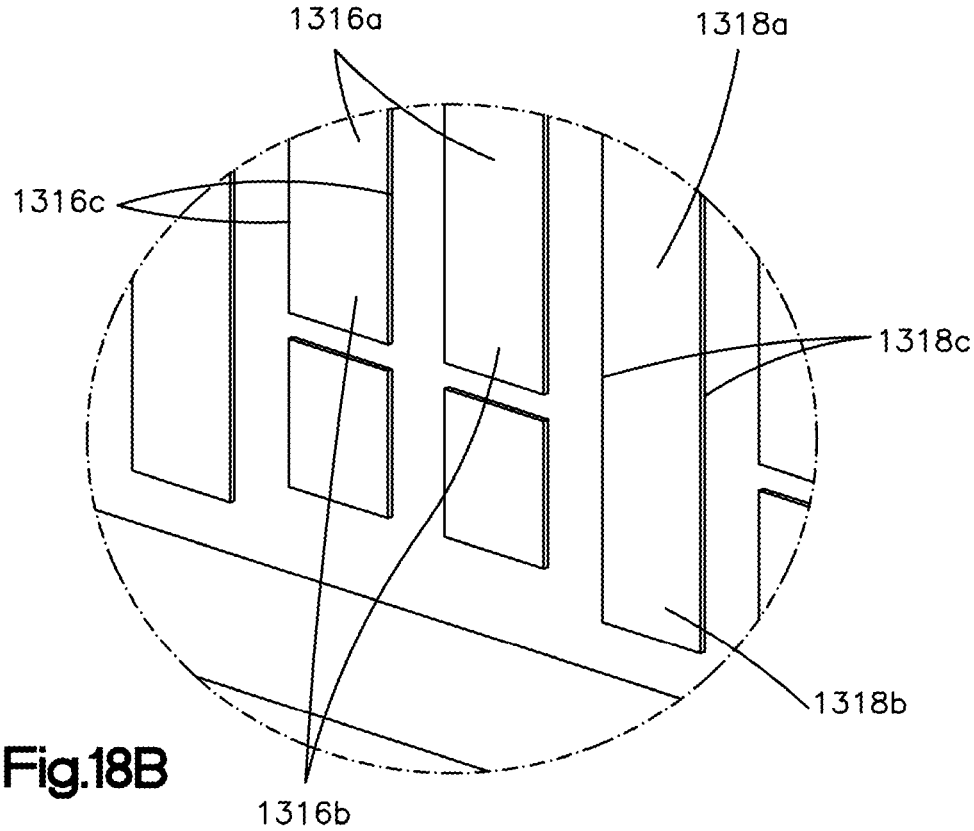
FIG. 18B shows an enlarged view of some of the contact pads of the second complementary electrical component of FIG. 17.
Figure 19:
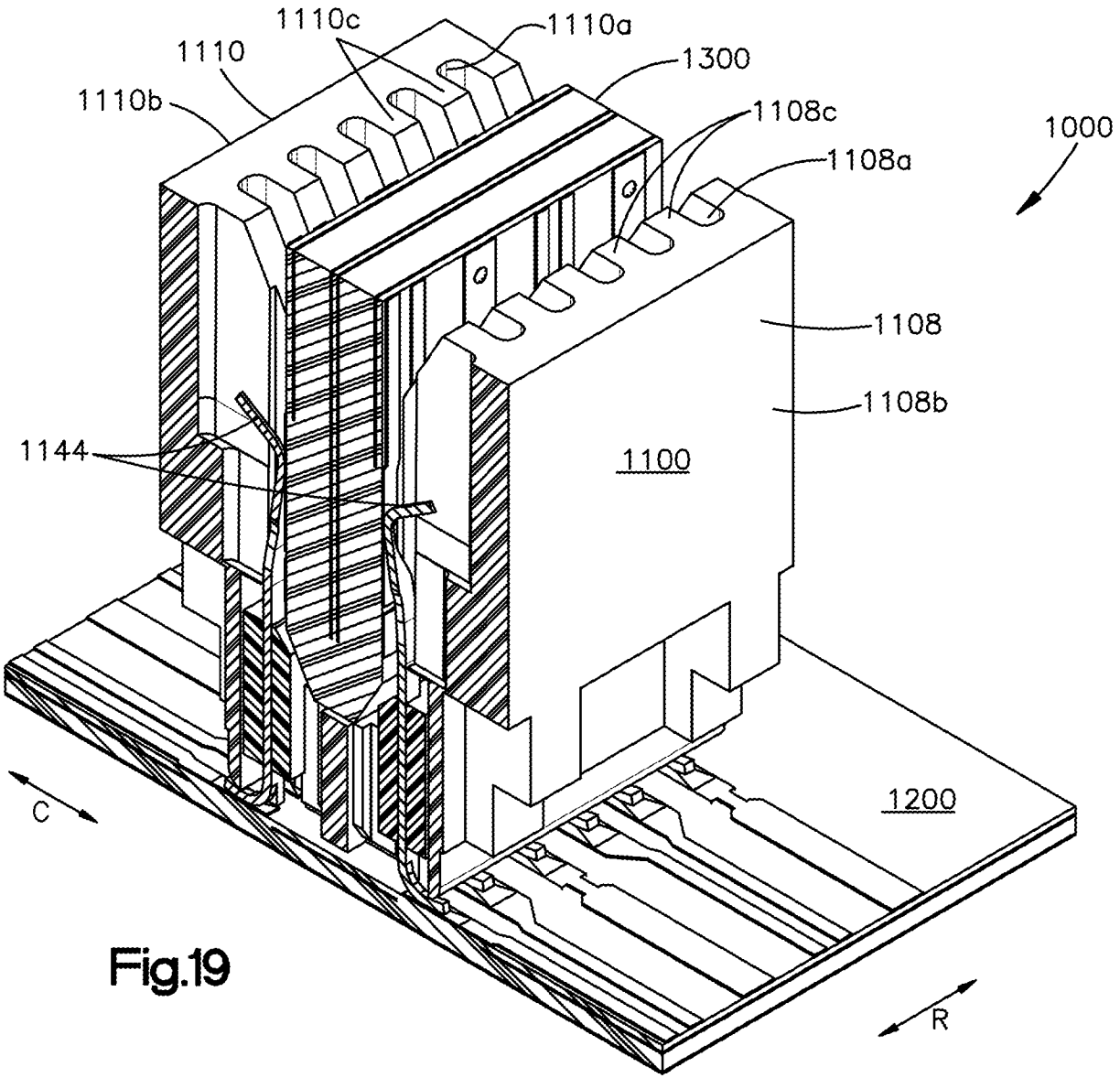
FIG. 19 shows a perspective section view of the electrical connector system of FIG. 17 taken at line 19-19.
Figure 20:
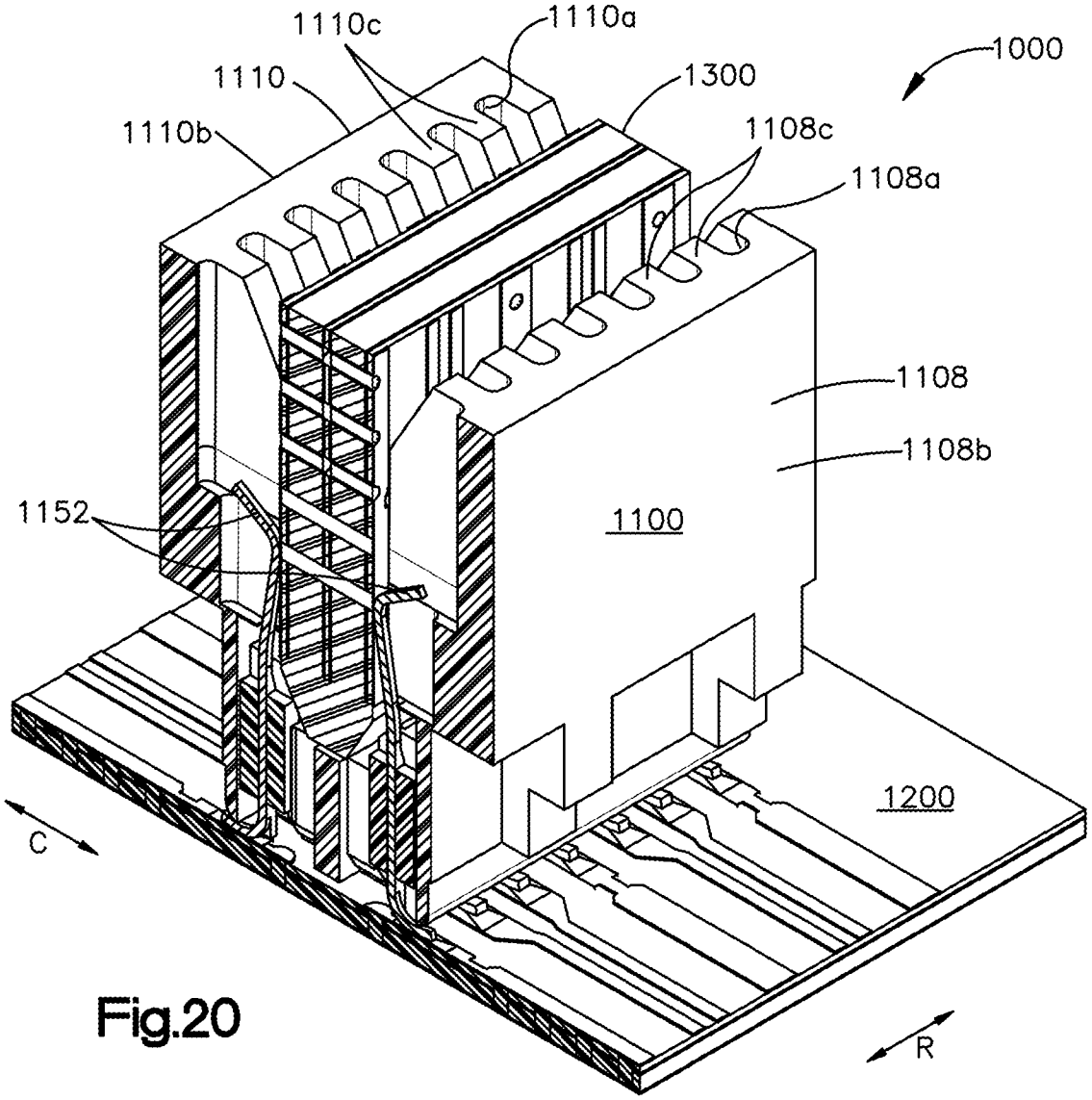
FIG. 20 shows a perspective section view of the electrical connector system of FIG. 17 taken at line 20-20.

Turning now to FIG. 16, embodiments of the present disclosure can include a kit having a plurality of the third electrical contact 900. The plurality of electrical contacts 900 can be arranged edge-to-edge in a row of the electrical connector 700. Further, the electrical contacts 900 can be arranged such that their respective mounting ends 902 are aligned along the lateral direction A. In this arrangement, the anchoring regions 914 of the plurality of electrical contacts 900 can be aligned along the lateral direction A. The anchoring regions 914 of each of the plurality of electrical contacts 900 can define an upper-most point and a lower-most point, the upper-most point being closer to the mating end of the electrical contact, and the lower-most point being closer to the mounting end of the electrical contact 900. In one example, the upper-most points of two or more, up to all, of the anchoring regions 914 of the first electrical contacts 900 can be aligned with one another along the lateral direction A. Further, lower-most points of two or more, up to all, of the anchoring regions 914 of the electrical contacts 900 can be aligned with one another along the lateral direction A.

Each jogged portion of an electrical contact 900 can be aligned with a corresponding jogged portion of the other electrical contacts 900 in the plurality of contacts along the lateral direction A. For example, the first portions 920 of the electrical contacts 900 can be aligned along the lateral direction A, the second portions 924 of the electrical contacts 900 can be aligned along the lateral direction A, and the third portions 926 of the electrical contacts 900 can be aligned along the lateral direction A. Further, each first portion 920 is offset along the first lateral direction from the first edge 906 toward the second edge 908, each second intermediate is offset along the second lateral direction, opposite the first lateral direction, and each second portion 926 is offset along the first lateral direction. Without being bound by theory, it is believed that offsetting jogged portions can improve impedance matching at the anchoring regions 914 of the contacts 900.

The first retention features 922*a* of the electrical contacts 900 can be aligned with one another along the lateral direction A, and the second retention features 922*b* of the electrical contacts 900 can be aligned with one another along the lateral direction A. The first retention feature 922*a* of each electrical contact 900 can be connected to the body 914*c* of the anchoring region 914 at the first side 914*a* of the anchoring region 914. As a result, the first retention features 922*a* can be evenly spaced across the row direction. Similarly, the second retention feature 922*b* of each electrical contact 900 can be connected to the body 914*c* of the anchoring region 914 at the second side 914*b* of the anchoring region 914. As a result, the second retention features 922*b* can be evenly spaced across the row direction.

The electrical contacts 900 within each row can define an open pin field, or each contact 900 can be designated as either a signal or a ground. In one example, the electrical contacts can define the following pattern along the row direction R from left to right: ground-signal-ground-signal-ground-signal, which can be repeated. It will be appreciated that other patterns are possible.

Referring to FIGS. 17-20, an electrical connector system 1000 includes an electrical connector 1100, a first complementary electrical component 1200, and a second complementary electrical component 1300. The first complementary electrical component 1200 can be configured as a first substrate, such as a first printed circuit board (PCB). Similarly, the second electrical component 1300 can be a second substrate, such as a second PCB. The electrical connector 1100 is configured to be placed in electrical communication with each of the first and second electrical components 1200 and 1300. For instance, the electrical connector 1100 can be mounted to the first electrical component 1200. The second electrical component 1300 can define an edge card that is configured to be received by the electrical connector 1100 along a longitudinal direction L so as to mate the electrical connector 1100 with the second electrical component. It is thus appreciated that the electrical connector can be configured to electrically couple the first and second complementary electrical components 1200 and 1300 to one another. Accordingly, the electrical connector 1100 provides an electrically conductive path between the first and second electrical components 1200 and 1300, such as from at least one of the first and second complementary electrical components 1200 and 1300 to the other of the first and second complementary electrical components 1200 and 1300.

The electrical connector 1100 includes a dielectric or electrically insulative connector housing 1102 and a plurality of electrical contacts 1120 that are supported by the connector housing 1102. For instance, the electrical contacts 1120 can be arranged in at least one row that is oriented along a row direction R. The at least one row of the electrical contacts 1120 can be supported by at least one dielectric or electrically insulative insert mold body 1118 that is in turn supported by the connector housing 1102. Thus, the electrical connector 1100 can include at least one insert mold assembly 1122 that includes the at least one insert mold body 1118 and the at least one row of electrical contacts 1120.

In one example, the electrical contacts 1120 can be supported by the connector housing 1102 in at least first and second rows $R_1$ and $R_2$ that are spaced apart from one another along a column direction C so as to define an insertion slot 1112 between the first and second rows $R_1$ and $R_2$. The first row $R_1$ of electrical contacts 1120 can be supported by a first insert mold body 1118*a* and the second row $R_2$ can be supported by a second insert mold body 1118*b*. Thus, the electrical connector can include a first insert mold assembly 1122*a* that includes the first insert mold body 1118*a* and the first row $R_1$ of electrical contacts, and a second insert mold assembly 1122*b* that includes the second insert mold body 1122*b* and the second row $R_2$ of electrical contacts.

The rows $R_1$ and $R_2$ can be oriented along a lateral direction A that is substantially perpendicular to the longitudinal direction L. The column direction C can be oriented along a direction that is perpendicular to each of the lateral direction A and the longitudinal direction L. For instance, the column direction C can be oriented along a transverse direction T.

Each of the at least one row of electrical contacts can include a first set 1140 of electrical contacts supported by the housing 1102, and a second set 1150 of electrical contacts supported by the housing 1102. The first set 1140 of electrical contacts in each row can include at least one pair 1142 of adjacent electrical contacts 1144 and 1146. For instance, the first set 1140 can include a plurality of pairs 1142 of adjacent electrical contacts. In some embodiments, the at least one pair 1142 of adjacent electrical contacts can be configured as a pair of signal contacts, although, as will be discussed in further detail below, embodiments of the disclosure are not so limited. The second set 1150 of electrical contacts in each row can include a plurality of individual electrical contacts 1152. In some embodiments, the individual electrical contacts 1152 can be configured as ground contacts, although, as will be discussed in further detail below, embodiments of the disclosure are not so limited.

Figure 23:
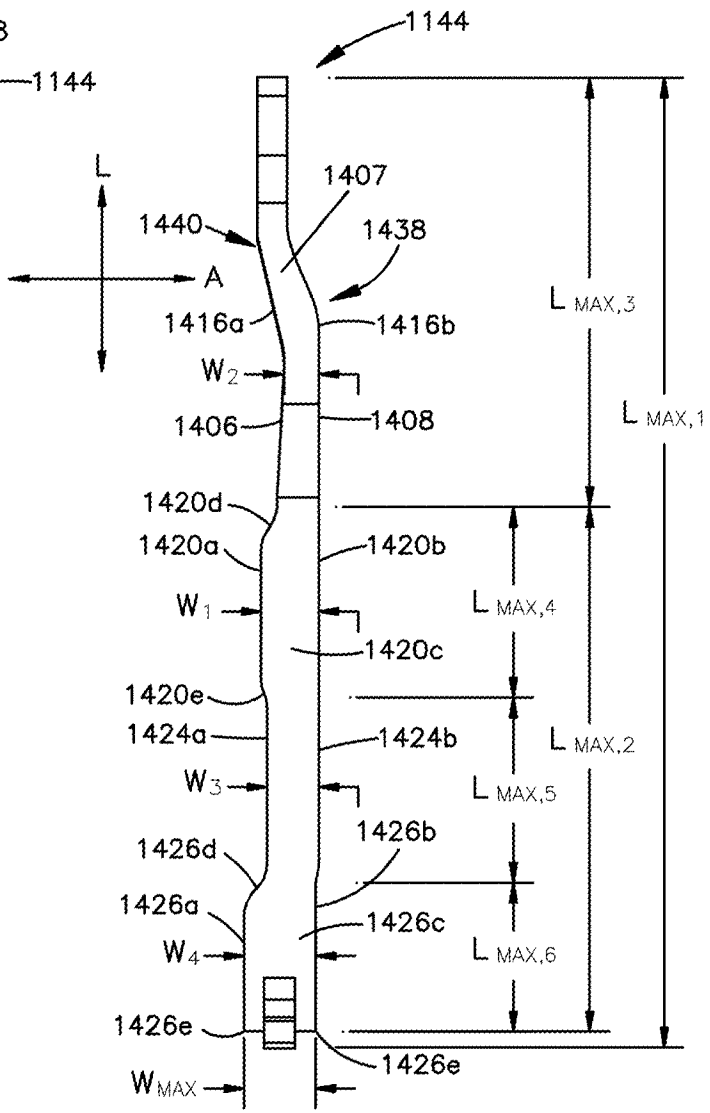
FIG. 23 shows a front plan view of the first electrical contact of FIG. 21.
Figure 22:
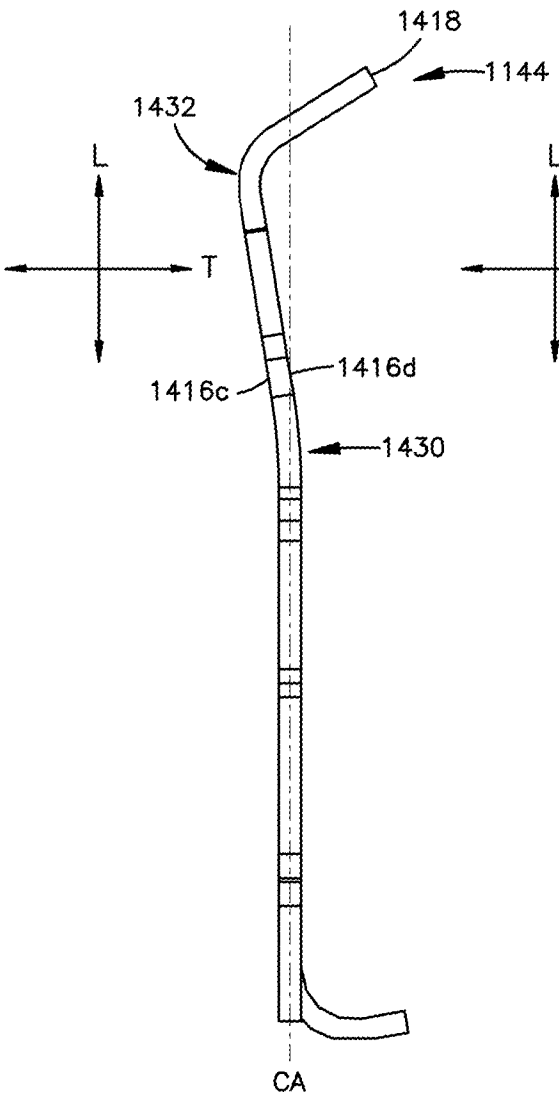
FIG. 22 shows a side plan view of the first electrical contact of FIG. 2.
Figure 21:
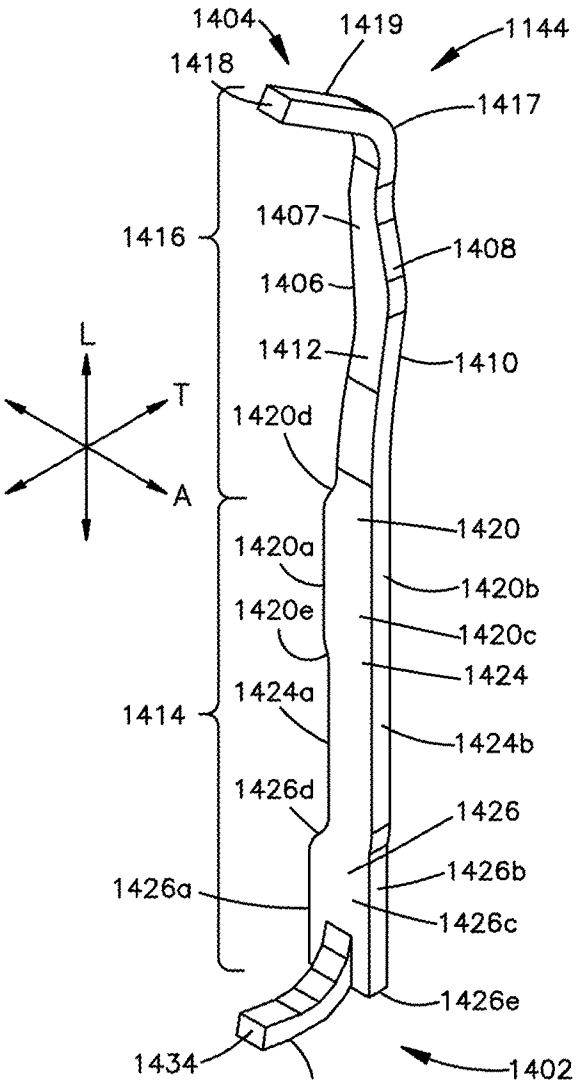
FIG. 21 shows a perspective view of an embodiment of a first electrical contact of the connector of FIG. 17.

Turning now to FIGS. 21 to 23, the first electrical contact 1144 of each pair 1142 can include a mounting end 1402, and a mating end 1404 opposite the mounting end 1402 along the longitudinal direction L. The mounting end 1402 is configured to be mounted onto, for example, the first complementary electrical component 1200 along a mounting direction. The mating end 1404 is configured to mate with, for example, the second complementary electrical component 1300 along a mating direction. In one example, the mating direction and mounting direction can be oriented along the same direction. For instance, the mating direction and mounting direction can be oriented along the longitudinal direction L. Thus, the first electrical contact 1144 is considered to be a vertical electrical contact. Alternatively, the first electrical contact 1144 can be configured as a right-angle contact, whereby the mating direction and the mounting direction are oriented substantially perpendicular to each other. For instance, when the electrical contact 1144 is configured as a right-angle contact, the mounting end 1402 can be oriented along the longitudinal direction L, and the mating end 1404 can be oriented along the transverse direction T.

The electrical contact 1144 includes a contact body 1407 that defines first and second edges 1406 and 1408, and first and second broadsides 1410 and 1412. The first and second edges 1406 and 1408 are spaced opposite from one another along the lateral direction A. Thus, the first and second edges 1406 and 1408 can face away from one another. At least respective portions of the first and second broadsides 1410 and 1412 can be spaced opposite each other along the transverse direction T. Thus, the first and second broadsides 1410 and 1412 can face away from one another. It should therefore be appreciated that each of the first and second edges 1406 and 1408 are connected between the first and second broadsides 1410 and 1412. Similarly, each of the first and second broadsides 1410 and 1412 are connected between the first and second edges 1406 and 1408.

The edges 1406 and 1408 and broadsides 1410 and 1412 can define respective distances along a plane that is oriented normal to the contact body 1407. For instance, the edges 1406 and 1408 can each extend along a first distance from one of the first and second broadsides 1410 and 1412 to the other of the first and second broadsides 1410 and 1412 along the plane. The broadsides 1410 and 1412 can each extend along a second distance from one of the first and second edges 1406 and 1408 to the other of the first and second edges 1406 and 1408 along the plane. The second distance can be greater than the first distance. In one example, the first distance can define a thickness of the contact body 1407, and the second distance can define a width of the contact body 1407. The thickness along at least a portion of the contact body 1407 can be oriented along the transverse direction T, and the width along at least a portion of the contact body 1407 can be oriented along the lateral direction A.

The electrical contact 1144 includes an anchoring region 1414 that is configured to secure the electrical contact 1144 to the at least one insert mold body 1118 of the electrical connector 1100. The electrical contact 1144 further includes a contact beam 1416 that extends out with respect to the anchoring region 1414. For instance, the contact beam 1416 can extend out with respect to the anchoring region 1414 along the longitudinal direction L. In one example, the contact beam 1416 can extend from the anchoring region 1414.

The contact beam 816 has first and second sides 1416*a* and 1416*b*, and first and second faces 1416*c* and 1416*d*. The first and second sides 1416*a* and 1416*b* of the contact beam 1416 are defined by the first and second edges 1406 and 1408, respectively, of the contact body 1407. Similarly, the first and second faces 1416*c* and 1416*d* of the contact beam 1416 are defined by the first and second broadsides 1410 and 1412, respectively, of the contact body 1407. The contact beam 1416 can define a mating portion 1417 that is configured to mate with the second complementary electrical component 1300, and a stub 1419 that extends from the mating portion 1417 to a free end 1418 of the electrical contact 1144. The contact beam has a first beam portion that extends along a central axis CA, and a second beam portion that extends from the first beam portion towards the free end 1418 of the contact beam 1416 along a direction that is angularly offset from the central axis with respect to the lateral direction A.

The anchoring region 1414 extends between the mounting end 1402 and the contact beam 1416. For instance, the anchoring region 1414 can extend from the mounting end 1402 to the contact beam 1416. The anchoring region 1414 can define a maximum length $L_{max,2}$. Further, the anchoring region 1414 can be disposed partially or fully below a midpoint of the electrical contact 1144 along the longitudinal direction L. The contact beam 1416 extends between the free end 1418 of the electrical contact 1144 and the anchoring region 1414, such as from the free end 1418 to the anchoring region 1414, and has a maximum length $L_{max,3}$.

The anchoring region 1414 can be substantially planar as it extends from the mounting end 1402 to the contact beam 1416 along the longitudinal direction L. For instance, the broadsides 1410 and 1412 can be substantially planar along respective planes that are defined by the longitudinal direction L and the lateral direction A at the anchoring region 1414 from the mounting end 1412 to the contact beam 1416. Alternatively, the anchoring region 1414 can have a bent, such as a curved, shape between the mounting end 1402 and the contact beam 1416.

The anchoring region 1414 can include at least one portion that extends outward from one of the first and second edges 1406 and 1408 along the lateral direction A. At least a portion of the at least one of the first and second portions portion can be aligned with, or at least not extend outward from, the one of the first and second edges 1406 and 1408 of the contact body 1407 along the lateral direction A. For example, the at least one of the first and second portions can extend outward from the first edge 1406 along the lateral direction A, and can be aligned with, or at least not extend outward from, the second edge 1408 of the contact body 1407 along the lateral direction A.

The at least one of the first and second enlarged portion has first and second sides spaced from one another along the lateral direction A. At least a portion of the first side extends outward from the first edge 1406 of the first electrical contact 1144 along the lateral direction A and at least a portion of the second side extends up to the second edge 1408 of the first electrical contact 1144 along the lateral direction A. For example, at least a portion of the second side can extend inward from or can be aligned with the second edge 1408 of the first electrical contact 1144 along the lateral direction A.

The anchoring region 1414 can include at least one of a first portion, a second portion, and a third portion. The third portion can be between the first and second portions, and can thus be considered to be an intermediate portion. The intermediate portion can define a width along the lateral direction A that is less than the width of at least one or both of the first and second enlarged portions along the lateral direction A. In one example, one or both of the first and second portions can extend out from the contact body 1407. Thus, the intermediate portion can be considered to be a narrowed portion, and one or both of the first and second portions can be considered to be enlarged portions. For instance, at least one of the first and second portions can extend out from the first edge 1406 along the lateral direction A. In one example, the anchoring region 1414 can include a first portion 1420, an intermediate portion 1424, and a second portion 1426. The intermediate portion 1424 can be disposed between the first and second portions 1420 and 1426. One or more of the first portion 1420, the intermediate portion 1424, and the second portion 1426 can extend up to the second edge 1408 of the contact body 1407 with respect to the lateral direction A. For example, one or more of the first portion 1420, the intermediate portion 1424, and the second portion 1426 can extend inward of, or can be aligned with the second edge 1408 along the lateral direction A. In one example, the first portion 1420, the intermediate portion 1424, and the second portion 1426 can be substantially aligned along the second edge 1408.

The first portion 1420 can define first and second opposed outermost sides 1420*a* and 1420*b*. The outermost sides 1420*a* and 1420*b* can be spaced from each other along the lateral direction A. The first outermost side 1420*a* can be outwardly spaced from the first edge 1406 along the lateral direction A. The second outermost side 1420*b* can be aligned with, or at least not extend outward from, the second edge 1408. The first portion 1420 can have a width $W_1$ along the lateral direction A from the first outermost side 1420*a* to the second outermost side 1420*b*, the width $W_1$ being greater than a width $W_2$ of the broadsides 1410 and 1412 from the first edge 1406 to the second edge 1408. The first portion 1420 can extend between the contact beam 1416 and the mounting end 1402, such as from the contact beam 1416 towards the mounting end 1402. The first portion 1420 can have a substantially rectangular shape in a plane defined by the longitudinal and lateral directions as shown, or can have any other suitable shape in the plane such as a circle, square, or other polygon. Further, the first portion 1420 has a maximum length $L_{max,4}$. While the outermost side 1420*a* of the first portion 1420 can be spaced outwardly from the first edge 1406 with respect to the lateral direction A as described above, it should be appreciated that the outermost side 1420*a* can be aligned with the first edge 1406 as desired. Further, while the second side 1420*b* of the first portion 1420 can be aligned with the second edge 1408 as described above, it should be appreciated that the outermost side 1420*b* can extend inward from the second edge 1408 with respect to the lateral direction A. The first portion 1420 can extend out from at least one of the edges 1406 and 1408 along the lateral direction A. For instance, the first portion 1420 can extend out from the first edge 1406 of the contact beam 1416. Further, the first portion 1420 can be coplanar with the broadsides 1410 and 1412.

The first portion 1420 can define a body 1420*c* and at least one shoulder, such as a first upper shoulder 1420*d* that extends from the body 1420*c* to the contact body 1407, and in particular to the first edge 1406. It should be appreciated that the first upper shoulder 1420*d* can be omitted in some embodiments. The first upper shoulder 1420*d* can extend from the portion 1420 to the contact body 1407 along a direction having a directional component along the lateral direction A.

The intermediate portion 1424 can define opposed outermost sides 1424*a* and 1424*b*. The outermost sides 1424*a* and 1424*b* can be spaced from each other along the lateral direction A. In one example, the intermediate portion defines a width $W_3$ from one of the outermost sides 1424*a* and 1424*b* to the other of the outermost sides 1424*a* and 1424*b*. The width $W_3$ of the intermediate portion 1424 can be less than the corresponding width of one or both of the portions 1420 and 1426. In some embodiments, the width $W_3$ of the intermediate portion 1424 can be less than the width $W_2$ of the broadsides 1410 and 1412 from one of the edges 1406 and 1408 to the other of the edges 1406 and 1408. Alternatively, the width $W_3$ of the intermediate portion 1424 can be greater than the width of the broadsides 1410 and 1412. Alternatively still, the outermost sides 1424*a* and 1424*b* can be aligned with the first and second edges 1406 and 1408, respectively. Thus, the width $W_3$ of the intermediate portion 1424 can be substantially equal to the width $W_2$ of the broadsides 1410 and 1412.

The intermediate portion 1424 can extend between the first portion 1420 and the mounting end 1402 along the longitudinal direction L. For instance, the intermediate portion 1424 can extend from the first portion 1420 toward the mounting end 1402. The intermediate portion 1424 can define a maximum length $L_{max,5}$ along the longitudinal direction L. The intermediate portion 1424 can have a substantially rectangular shape in a plane defined by the longitudinal and lateral directions as shown, or can have any other suitable shape in the plane such as a circle, square, or other polygon. Further, the first outermost side 1424*a* can be linear as it extends from the first portion 1420 towards the mounting end 1402. Similarly, the second outermost side 1424*b* can be linear as it extends from the first portion 1420 towards the mounting end 1402. Alternatively, one or both of the first and second outermost sides 1424*a* and 1424*b* can be curved between the first portion 1420 and the mounting end 1402. For example, one or both of the first and second outermost sides 1424*a* and 1424*b* can be concave between the first portion 1420 and the mounting end 1402. As shown, the intermediate portion 1424 of the electrical contact 1144 can be elongate along the longitudinal direction L as it extends between the first portion 1420 and the mounting end 1402, such that the maximum length $L_{max,5}$ of the intermediate portion 1424 is greater than each of the width $W_3$ of the intermediate portion 1424 along the lateral direction A and the thickness of the intermediate portion 1424 along the transverse direction T.

The first portion 1420 can define at least one lower shoulder, such as a first lower shoulder 1420*e* that extends from the body 1420*c* of the first portion 1420 to the intermediate portion 1424. For instance, the first lower shoulder 1420*e* can extend from the outermost side 1420*a* to the outermost side 1424*a*. It should be appreciated that the first lower shoulder 1420*e* can be omitted in some embodiments. The lower shoulder 1420*e* can extend from the portion 1420 to the intermediate portion 1426 along a direction having a directional component along the lateral direction A. Further, the lower shoulder 1420*e* can face away from the upper shoulder 1420*d*.

The second portion 1426 can define first and second opposed outermost sides 1426*a* and 1426*b*. The outermost sides 1426*a* and 1426*b* can be spaced from each other along the lateral direction A. The first outermost side 1426*a* can be outwardly spaced from the first side 1424*a* of the intermediate portion 1424 along the lateral direction A. The first outermost side 1426*a* can also be outwardly spaced from one or more of the first side 1420*a* of the first portion 1420 and the first edge 1406 along the lateral direction A. The second outermost side 1426*b* can extend inwardly from or can be aligned with one or more of the second outermost side 1424*b* of the intermediate portion 1424, the second outermost side 1420*b* of the first portion 1420, and the second edge 1408.

The second portion 1426 can have a width $W_4$ along the lateral direction A from the first outermost side 1426*a* to the second outermost side 1426*b*, the width $W_4$ being greater than the width $W_2$ of the broadsides 1410 and 1412 from the first edge 1406 to the second edge 1408. The second portion 1426 can extend between the contact beam 1416 and the mounting end 1402, such as from the mounting end 1402 towards the contact beam 1416. The second portion 1426 can have a substantially rectangular shape in a plane defined by the longitudinal and lateral directions as shown, or can have any other suitable shape in the plane such as a circle, square, or other polygon. Further, the second portion 1426 has a maximum length $L_{max,6}$. While the outermost side 1426*a* of the second portion 1426 can be spaced outwardly from the first side 1426*a* with respect to the lateral direction A as described above, it should be appreciated that the outermost side 1426*a* can be aligned with the outermost side 1424*a* as desired. Further, while the second side 1426*b* of the second portion 1426 can be aligned with the second side 1424*b* or the second edge 1408 as described above, it should be appreciated that the second side 1426*b* can extend up to one or more of the second side 1420*b*, the second side 1424*b*, and the second edge 1408. The second portion 1426 can extend outward from one or more of the first side 1420*a* of the first portion 1420, the first side 1426*a* of the intermediate portion 1424, and the first edge 1406 along the lateral direction A. Further, the second portion 1426 can be coplanar with the broadsides 1410 and 1412.

The second portion 1426 can define a body 1426*c* and at least one shoulder, such as a first upper shoulder 1426*d* that extends from the body 1426*c* to the intermediate portion 1424, and in particular to the first side 1424*a* of the intermediate portion 1424. It should be appreciated that the first upper shoulder 1426*d* can be omitted in some embodiments. The upper shoulder 1426*d* can extend from the portion 1426 to the intermediate portion 1424 along a direction having a directional component along the lateral direction A. Further, the upper shoulder 1426*c* can face the lower shoulder 1420*e* of the first portion 1420.

The second portion 1426 can define at least one lower shoulder, such as a first lower shoulder 1426*e* that extends from the body 1426*c* of the second portion 1426 to the mounting tail 1434. For instance, the first lower shoulder 1426*e* can extend from the outermost side 1426*a* to the mounting tail 1434. The second portion 1426 can also define a second lower shoulder 1426*e* that extends from the body 1426*c* of the second portion 1426 to the mounting tail 1434. For instance, the second lower shoulder 1426*e* can extend from the outermost side 1426*b* to a corresponding side of the mounting tail 1434. It should be appreciated that one or both of the first and second lower shoulders 1426*e* can be omitted in some embodiments. Each lower shoulder 1426*e* can extend from the portion 1426 to the mounting tail 1434 along a direction having a directional component along the lateral direction A. Further, each the first lower shoulder 1426*e* can face away from the first upper shoulder 1426*d*. The first lower shoulder 1420*e* of the first portion 1420 and the first upper shoulder 1426*d* of the second portion 1426 together can provide two locations of mechanical support that retains the electrical contact in the insert mold body.

The contact beam 1416 can be constructed as a flexible beam having a bent, such as curved, shape that extends from a free end 1418 of the electrical contact 1144 towards the anchoring region 1414. Bent structures as described herein refer to bent shapes that can be fabricated, for instance, by bending the end or by stamping a bent shape, or by any other suitable manufacturing process. The first broadside 1410 at the contact beam 1416 is configured to wipe against the second complementary electrical component 1300 as the component is mated with the contact beam 1416 along the longitudinal direction L. Further, the contact beam 1416 is configured to contact the second complementary electrical component 1300 so as to apply a force to a surface of the complementary electrical component 1300 along the transverse direction T.

The contact beam 1416 can include at least a first transverse bend region 1430 between the anchoring region 1414 and the mating end 1404. The first transverse bend region 1430 can curve towards a first transverse direction that extends from the second broadside 1412 toward the first broadside 1410 as the contact beam 1416 extends away from the anchoring region 1414 along the longitudinal direction L. The contact beam 1416 can further include at least a second transverse bend region 1432 that is between the first transverse bend region 1430 and the mating end 1404. The second transverse bend region 1432 can curve towards a second transverse direction, opposite the first transverse direction, that extends from the first broadside 1410 toward the second broadside 1412 as the contact beam 1416 extends away from the first transverse bend region 1430 along the longitudinal direction L. In alternative embodiments, the curvature of the contact beam 1416 can vary from that shown. For example, the contact beam 1416 can include as few as one transverse bend region, or greater than transverse two bend regions.

The contact beam 1416 can include at least a first lateral bend region 1438 between the anchoring region 1414 and the mating end 1404. The first lateral bend region 1438 can curve towards the lateral direction as the contact beam 1416 extends away from the anchoring region 1414 along the longitudinal direction L. For example, the first lateral bend region 1438 can curve towards a first lateral direction that extends from the second edge 1408 toward the first edge 1406 as the contact beam 1416 extends away from the anchoring region 1414 along the longitudinal direction L. The contact beam 1416 can further include at least a second lateral bend region 1440 that is between the first lateral bend region 1438 and the mating end 1404. For example, the second lateral bend region 1440 can curve towards the lateral direction as the contact beam 1416 extends away from the first lateral bend region 1438 along the longitudinal direction L. The second lateral bend region 1440 can curve towards a second lateral direction, opposite the first lateral direction, that extends from the first edge 1406 toward the second edge 1408 as the contact beam 1416 extends away from the first lateral bend region 1438 along the longitudinal direction L. In alternative embodiments, the curvature of the contact beam 1416 can vary from that shown. For example, the contact beam 1416 can include as few as one lateral bend region, or greater than two lateral bend regions.

The anchoring region 1414 can define a central axis CA that extends in the longitudinal direction between the first and second broadsides 1410 and 1412. The second transverse bend region 1432 can extend at least partially on a first side of the central axis CA with respect to the transverse direction T, the first side being spaced from the central axis CA along a direction that is opposite the second broadside 1412. Further, the free end 1418 can be positioned on a second side of the central axis CA with respect to the transverse direction T, the second side being spaced from the central axis CA along a direction that is opposite the first broadside 1410.

The mounting end 1402 can include a mounting tail 1434 that extends away from the anchoring region 1414. For example, the mounting tail 1434 can define a surface-mount tail as shown that is bent, or otherwise curved, outward from the anchoring region 1414 along the transverse direction T, such as along a direction that extends from the first broadside 1410 towards the second broadside 1412. Thus, the mounting tail 1434 can be disposed on the same side of the central axis CA as the free end 1418 with respect to the transverse direction T as shown in FIG. 22. Alternatively, the mounting tail 1434 can extend on the opposite side of the central axis CA as the free end 1418. The mounting tail 1434 defines a terminal end 1436 of the electrical contact 1144. The terminal end 1436 can be configured as a mounting surface that mounts onto, such as abuts, an electrical contact of the first complementary electrical component 1300. The mounting surface can substantially face the longitudinal direction L, such as in a direction away from the free end 1418 of the electrical contact. Thus, the mounting surface can be configured to mount onto a complementary electrical component that lies in a plane that is substantially perpendicular to the longitudinal direction L. In alternative embodiments, the mounting tail 1434 can be configured as a differently-configured surface-mount tail, as a press-fit tail, as a fusible element such as a solder ball, or combinations thereof.

The electrical contact 1144 defines maximum length $L_{max,1}$ along the longitudinal direction L from the free end 1418 to the terminal end 1436. The electrical contact 1144 can further define a maximum width $W_{max}$ along the lateral direction A. The maximum width $W_{max}$ can be equal to at least one of the width $W_1$ of the first portion 1420 and the width $W_4$ of the second portion 1426, such as a larger of the widths $W_1$ and $W_4$. Alternatively, the maximum width $W_{max}$ can be equal to both the width $W_1$ of the first portion 1420 and the width $W_4$ of the second portion 1426 when the widths $W_1$ and $W_4$ are equal. The contact body 1407 yet further defines a maximum thickness $T_{max}$ along the transverse direction T from one of the opposed broadsides 1410 and 1412 to the other. The maximum length $L_{max,1}$ of the electrical contact 1144 can be greater than both the maximum width $W_{max}$ and the maximum thickness $T_{max}$. Further, the maximum width $W_{max}$ of the electrical contact 1144 can be greater than the maximum thickness $T_{max}$. Thus, the electrical contact 1144 can be said to be elongate along the longitudinal direction L.

Figures 24, 25, 26:
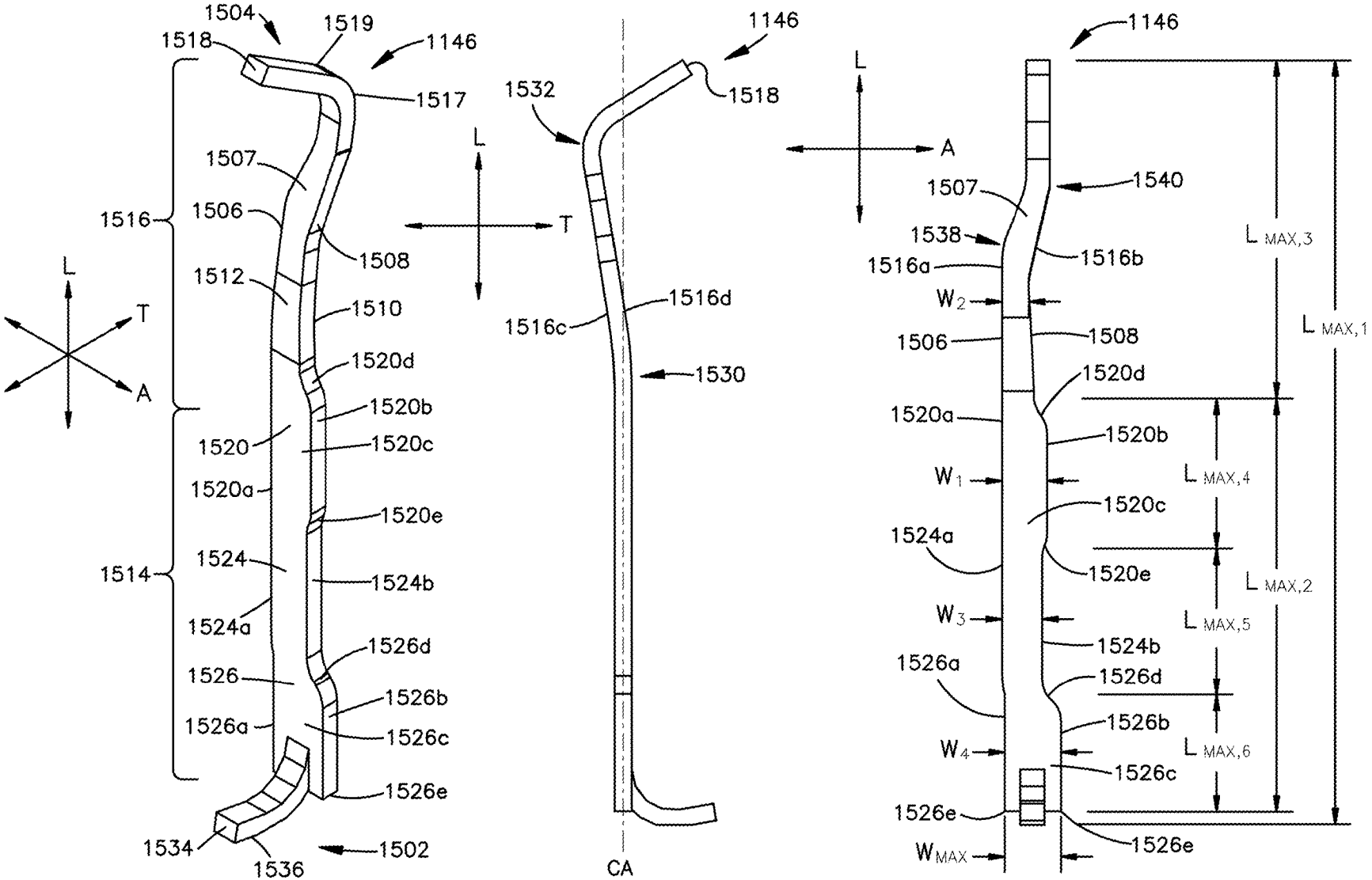
FIG. 24 shows a perspective view of an embodiment of a second electrical contact of the connector of FIG. 17.
FIG. 25 shows a side plan view of the second electrical contact of FIG. 24.
FIG. 26 shows a front plan view of the second electrical contact of FIG. 24.

Turning now to FIGS. 24 to 26, the second electrical contact 1146 of each pair 1142 can be a substantial mirror image of the first electrical contact 1144 taken about a line that extends substantially along the longitudinal direction. The second electrical contact 1146 of each pair 1142 can include a mounting end 1502, and a mating end 1504 opposite the mounting end 1502 along the longitudinal direction L. The mounting end 1502 is configured to be mounted onto, for example, the first complementary electrical component 1200 along a mounting direction. The mating end 1504 is configured to mate with, for example, the second complementary electrical component 1300 along a mating direction. In one example, the mating direction and mounting direction can be oriented along the same direction. For instance, the mating direction and mounting direction can be oriented along the longitudinal direction L. Thus, the second electrical contact 1146 is considered to be a vertical electrical contact. Alternatively, the second electrical contact 1146 can be configured as a right-angle contact, whereby the mating direction and the mounting direction are oriented substantially perpendicular to each other. For instance, when the electrical contact 1146 is configured as a right-angle contact, the mounting end 1502 can be oriented along the longitudinal direction L, and the mating end 1504 can be oriented along the transverse direction T.

The electrical contact 1146 includes a contact body 1507 that defines first and second edges 1506 and 1508, and first and second broadsides 1510 and 1512. The first and second edges 1506 and 1508 are spaced opposite from one another along the lateral direction A. Thus, the first and second edges 1506 and 1508 can face away from one another. At least respective portions of the first and second broadsides 1510 and 1512 can be spaced opposite each other along the transverse direction T. Thus, the first and second broadsides 1510 and 1512 can face away from one another. It should therefore be appreciated that each of the first and second edges 1506 and 1508 are connected between the first and second broadsides 1510 and 1512. Similarly, each of the first and second broadsides 1510 and 1512 are connected between the first and second edges 1506 and 1508.

The edges 1506 and 1508 and broadsides 1510 and 1512 can define respective distances along a plane that is oriented normal to the contact body 1507. For instance, the edges 1506 and 1508 can each extend along a first distance from one of the first and second broadsides 1510 and 1512 to the other of the first and second broadsides 1510 and 1512 along the plane. The broadsides 1510 and 1512 can each extend along a second distance from one of the first and second edges 1506 and 1508 to the other of the first and second edges 1506 and 1508 along the plane. The second distance can be greater than the first distance. In one example, the first distance can define a thickness of the contact body 1507, and the second distance can define a width of the contact body 1507. The thickness along at least a portion of the contact body 1507 can be oriented along the transverse direction T, and the width along at least a portion of the contact body 1507 can be oriented along the lateral direction A.

The electrical contact 1146 includes an anchoring region 1514 that is configured to secure the electrical contact 1146 to the at least one insert mold body 1118 of the electrical connector 1100. The electrical contact 1146 further includes a contact beam 1516 that extends out with respect to the anchoring region 1514. For instance, the contact beam 1516 can extend out with respect to the anchoring region 1514 along the longitudinal direction L. In one example, the contact beam 1516 can extend from the anchoring region 1514.

The contact beam 1516 has first and second sides 1516*a* and 1516*b*, and first and second faces 1516*c* and 1516*d*. The first and second sides 1516*a* and 1516*b* of the contact beam 1516 are defined by the first and second edges 1506 and 1508, respectively, of the contact body 1507. Similarly, the first and second faces 1516*c* and 1516*d* of the contact beam 1516 are defined by the first and second broadsides 1510 and 1512, respectively, of the contact body 1507. The contact beam 1516 can define a mating portion 1517 that is configured to mate with the second complementary electrical component 1300, and a stub 1519 that extends from the mating portion 1517 to a free end 1518 of the electrical contact 1146. The contact beam 1516 has a first beam portion that extends along a central axis CA, and a second beam portion that extends from the first beam portion towards the free end 1518 of the contact beam 1516 along a direction that is angularly offset from the central axis with respect to the lateral direction A.

The anchoring region 1514 extends between the mounting end 1502 and the contact beam 1516. For instance, the anchoring region 1514 can extend from the mounting end 1502 to the contact beam 1516. The anchoring region 1514 can define a maximum length $L_{max,2}$. Further, the anchoring region 1514 can be disposed partially or fully below a midpoint of the electrical contact 1146 along the longitudinal direction L. The contact beam 1516 extends between the free end 1518 of the electrical contact 1146 and the anchoring region 1514, such as from the free end 1518 to the anchoring region 1514, and has a maximum length $L_{max,3}$.

The anchoring region 1514 can be substantially planar as it extends from the mounting end 1502 to the contact beam 1516 along the longitudinal direction L. For instance, the broadsides 1510 and 1512 can be substantially planar along respective planes that are defined by the longitudinal direction L and the lateral direction A at the anchoring region 1514 from the mounting end 1512 to the contact beam 1516. Alternatively, the anchoring region 1514 can have a bent, such as a curved, shape between the mounting end 1502 and the contact beam 1516.

The anchoring region 1514 can include at least one enlarged portion that extends outward from one of the first and second edges 1506 and 1508 along the lateral direction A. At least a portion of the at least one enlarged portion can be aligned with, or at least not extend outward from, the one of the first and second edges 1506 and 1508 of the contact body 1507 along the lateral direction A. For example, the at least one enlarged portion can extend outward from the second edge 1508 along the lateral direction A, and can be aligned with, or at least not extend outward from, the first edge 1506 of the contact body 1507 along the lateral direction A.

The at least one enlarged portion has first and second sides spaced from one another along the lateral direction A. At least a portion of the second side extends outward from the second edge 1508 of the second electrical contact 1146 along the lateral direction A and at least a portion of the first side extends up to the first edge 1506 of the second electrical contact 1146 along the lateral direction A. For example, at least a portion of the first side can extend inward from or can be aligned with the first edge 1506 of the second electrical contact 1146 along the lateral direction A.

The anchoring region 1514 can include at least one of a first portion, a second portion, and a third portion. The third portion can be disposed between the first and second portions, and thus can be considered to be an intermediate portion. The intermediate portion can define a width along the lateral direction A that is less than the width of at least one or both of the first and second portions along the lateral direction A. Thus, the intermediate portion can be considered to be a intermediate portion, and one or both of the first and second portions can be considered to be enlarged portions. In one example, one or both of the first and second portions can extend out from the contact body 1507. For instance, at least one of the first and second portions can extend out from the second edge 1508 along the lateral direction A. In one example, the anchoring region 1514 can include a first portion 1520, an intermediate portion 1524, and a second portion 1526. The intermediate portion 1524 can be disposed between the first and second portions 1520 and 1526. One or more of the first portion 1520, the intermediate portion 1524, and the second portion 1526 can extend up to the first edge 1506 of the contact body 1507 along the lateral direction A. Thus, one or more of the first portion 1520, the intermediate portion 1524, and the second portion 1526 can extend inward from, or can be aligned with, the first edge 1506. In one example, the first portion 1520, the intermediate portion 1524, and the second portion 1526 can be aligned with the first edge 1506 such that they are all substantially aligned along the first edge 1506.

The first portion 1520 can define opposed outermost sides 1520*a* and 1520*b*. The outermost sides 1520*a* and 1520*b* can be spaced from each other along the lateral direction A. The second outermost side 1520*b* can be outwardly spaced from the second edge 1508 along the lateral direction A. The first outermost side 1520*a* can be extend inward from or can be aligned with the first edge 1506 along the lateral direction.

The first portion 1520 can have a width $W_1$ along the lateral direction A from the first outermost side 1520*a* to the second outermost side 1520*b*, the width $W_1$ being greater than a width $W_2$ of the broadsides 1510 and 1512 from the first edge 1506 to the second edge 1508. The first portion 1520 can extend between the contact beam 1516 and the mounting end 1502, such as from the contact beam 1516 towards the mounting end 1502. The first portion 1520 can have a substantially rectangular shape in a plane defined by the longitudinal and lateral directions as shown, or can have any other suitable shape in the plane such as a circle, square, or other polygon. Further, the first portion 1520 has a maximum length $L_{max,4}$. While the second side 1520*b* of the first portion 1520 can be spaced outwardly from the second edge 1508 with respect to the lateral direction A as described above, it should be appreciated that the second side 1520*b* can be aligned with the second edge 1508 as desired. Further, while the first side 1520*a* of the first portion 1520 can be aligned with the first edge 1506 as described above, it should be appreciated that the first side 1520*a* can extend inward from the first edge 1506. Further, the first portion 1520 can be coplanar with the broadsides 1510 and 1512.

The first portion 1520 can define a body 1520*c* and at least one shoulder, such as a first upper shoulder 1520*d* that extends from the body 1520*c* to the contact body 1507, and in particular to the second edge 1508. It should be appreciated that the first upper shoulder 1520*d* can be omitted in some embodiments. The first upper shoulder 1520*d* can extend from the portion 1520 to the contact body 1507 along a direction having a directional component along the lateral direction A.

The intermediate portion 1524 can define first and second opposed outermost sides 1524*a* and 1524*b*. The outermost sides 1524*a* and 1524*b* can be spaced from each other along the lateral direction A. In one example, the intermediate portion defines a width $W_3$ from one of the outermost sides 1524*a* and 1524*b* to the other of the outermost sides 1524*a* and 1524*b*. The width $W_3$ of the intermediate portion 1524 can be less than the corresponding width of one or both of the portions 1520 and 1526. For instance, the width $W_3$ of the intermediate portion 1524 can be less than the width of the broadsides 1510 and 1512 from one of the edges 1506 and 1508 to the other of the edges 1506 and 1508. Alternatively, the width $W_3$ of the intermediate portion 1524 can be greater than the width of the broadsides 1510 and 1512. Alternatively still, the outermost sides 1524*a* and 1524*b* can be aligned with the first and second edges 1506 and 1508, respectively. Thus, the width $W_3$ of the intermediate portion 1524 can be substantially equal to the width of the broadsides 1510 and 1512.

The intermediate portion 1524 can extend between the first portion 1520 and the mounting end 1502 along the longitudinal direction L. For instance, the intermediate portion 1524 can extend from the first portion 1520 toward the mounting end 1502. The intermediate portion 1524 can define a maximum length $L_{max,5}$ along the longitudinal direction L. The intermediate portion 1524 can have a substantially rectangular shape in a plane defined by the longitudinal and lateral directions as shown, or can have any other suitable shape in the plane such as a circle, square, or other polygon. Further, the first outermost side 1524*a* can be linear as it extends from the first portion 1520 towards the mounting end 1502. Similarly, the second outermost side 1524*b* can be linear as it extends from the first portion 1520 towards the mounting end 1502. Alternatively, one or both of the first and second outermost sides 1524*a* and 1524*b* can be curved between the first portion 1520 and the mounting end 1502. For example, one or both of the first and second outermost sides 1524*a* and 1524*b* can be concave between the first portion 1520 and the mounting end 1502. As shown, the intermediate portion 1524 of the electrical contact 1146 can be elongate along the longitudinal direction L as it extends between the first portion 1520 and the mounting end 1502, such that the maximum length $L_{max,5}$ of the intermediate portion 1524 is greater than each of the width $W_3$ of the intermediate portion 1524 along the lateral direction A and the thickness of the intermediate portion 1524 along the transverse direction T.

The first portion 1520 can define at least one lower shoulder, such as a first lower shoulder 1520*e* that extends from the body 1520*c* of the first portion 1520 to the intermediate portion 1524. For instance, the first lower shoulder 1520*e* can extend from the second outermost side 1520*b* to the second outermost side 1524*b*. It should be appreciated that the first lower shoulder 1520*e* can be omitted in some embodiments. The lower shoulder 1520*e* can extend from the portion 1520 to the intermediate portion 1526 along a direction having a directional component along the lateral direction A. Further, the lower shoulder 1520*e* can face away from the upper shoulder 1520*d*.

The second portion 1526 can define first and second opposed outermost sides 1526*a* and 1526*b*. The outermost sides 1526*a* and 1526*b* can be spaced from each other along the lateral direction A. The second outermost side 1526*b* can be outwardly spaced from the second side 1524*b* of the intermediate portion 1524 along the lateral direction A. The outermost side 1526*b* can also be outwardly spaced from the second edge 1508 along the lateral direction A. The first outermost side 1526*a* can extend up to one or more of the first outermost side 1524*a* of the intermediate portion 1524 and the first outermost side 1520*a* of the first portion 1520, and the first edge 1506 along the lateral direction A. For example, the first outermost side 1526*a* can extend inward from, or can be aligned with, one or more of the first outermost side 1524*a* of the intermediate portion 1524, the first outermost side 1520*a* of the first portion 1520, and the first edge 1506.

The second portion 1526 can have a width $W_4$ along the lateral direction A from the first outermost side 1526*a* to the second outermost side 1526*b*, the width $W_4$ being greater than the width $W_2$ of the broadsides 1510 and 1512 from the first edge 1506 to the second edge 1508. The second portion 1526 can extend between the contact beam 1516 and the mounting end 1502, such as from the mounting end 1502 towards the contact beam 1516. The second portion 1526 can have a substantially rectangular shape in a plane defined by the longitudinal and lateral directions as shown, or can have any other suitable shape in the plane such as a circle, square, or other polygon. Further, the second portion 1526 has a maximum length $L_{max,6}$. While the second outermost side 1526*b* of the second portion 1526 can be spaced outwardly from the second side 1524*b* with respect to the lateral direction A as described above, it should be appreciated that the second outermost side 1526*b* can be aligned with the second outermost side 1524*b* as desired. Further, while the first outermost side 1526*a* of the second portion 1526 can be aligned with the outermost side 1524*a* or the first edge 1506 as described above, it should be appreciated that the outermost side 1526*a* can extend up to one or more of the first outermost side 1524*a* of the intermediate portion 1524, the first outermost side 1520*a* of the first portion 1520, and the first edge 1506. The second portion 1526 can be coplanar with the broadsides 1510 and 1512.

The second portion 1526 can define a body 1526*c* and at least one shoulder, such as a first upper shoulder 1526*d* that extends from the body 1526*c* to the intermediate portion 1524, and in particular to the second side 1524*b* of the intermediate portion 1524. It should be appreciated that the first upper shoulder 1526*d* can be omitted in some embodiments. The upper shoulder 1526*d* can extend from the portion 1526 to the intermediate portion 1524 along a direction having a directional component along the lateral direction A. Further, the upper shoulder 1526*c* can face the lower shoulder 1520*e* of the first portion 1520.

The second portion 1526 can define at least one lower shoulder, such as a first lower shoulder 1526*e* that extends from the body 1526*c* of the second portion 1526 to the mounting tail 1534. For instance, the first lower shoulder 1526*e* can extend from the outermost side 1526*b* to the mounting tail 1534. The second portion 1526 can also define a second lower shoulder 1526*e* that extends from the body 1526*c* of the second portion 1526 to the mounting tail 1534. For instance, the second lower shoulder 1526*e* can extend from the outermost side 1526*a* to a corresponding side of the mounting tail 1534. It should be appreciated that one or both of the first and second lower shoulders 1526*e* can be omitted in some embodiments. Each lower shoulder 1526*e* can extend from the portion 1526 to the mounting tail 1534 along a direction having a directional component along the lateral direction A. Further, each the first lower shoulder 1526*e* can face away from the first upper shoulder 1526*d*. The first lower shoulder 1520*e* of the first portion 1520 and the first upper shoulder 1526*d* of the second portion 1526 together can provide two locations of mechanical support that retains the electrical contact in the insert mold body 1118.

The contact beam 1516 can be constructed as a flexible beam having a bent, such as curved, shape that extends from the anchoring region 1514 to a free end 1518 of the electrical contact 1146. Bent structures as described herein refer to bent shapes that can be fabricated, for instance, by bending the end or by stamping a bent shape, or by any other suitable manufacturing process. The first broadside 1510 at the contact beam 1516 is configured to wipe against the second complementary electrical component 1300 as the component is mated with the contact beam 1516 along the longitudinal direction L. Further, the contact beam 1516 is configured to contact the second complementary electrical component 1300 so as to apply a force to a surface of the complementary electrical component 1300 along the transverse direction T.

The contact beam 1516 can include at least a first transverse bend region 1517 between the anchoring region 1514 and the mating end 1504. The first transverse bend region 1517 can curve towards a first transverse direction that extends from the second broadside 1512 toward the first broadside 1510 as the contact beam 1516 extends away from the anchoring region 1514 along the longitudinal direction L. The contact beam 1516 can further include at least a second transverse bend region 1532 that is between the first transverse bend region 1517 and the mating end 1504. The second transverse bend region 1532 can curve towards a second transverse direction, opposite the first transverse direction, that extends from the first broadside 1510 toward the second broadside 1512 as the contact beam 1516 extends away from the first transverse bend region 1517 along the longitudinal direction L. In alternative embodiments, the curvature of the contact beam 1516 can vary from that shown. For example, the contact beam 1516 can include as few as one transverse bend region, or greater than transverse two bend regions.

The contact beam 1516 can include at least a first lateral bend region 1538 between the anchoring region 1514 and the mating end 1504. The first lateral bend region 1538 can curve towards the lateral direction as the contact beam 1516 extends away from the anchoring region 1514 along the longitudinal direction L. For example, the first lateral bend region 1538 can curve towards the second lateral direction that extends from the first edge 1506 toward the second edge 1508 as the contact beam 1516 extends away from the anchoring region 1514 along the longitudinal direction L. The contact beam 1516 can further include at least a second lateral bend region 1540 that is between the first lateral bend region 1538 and the mating end 1504. The second lateral bend region 1540 can curve towards the lateral direction as the contact beam 1516 extends away from the first lateral bend region 1538 along the longitudinal direction L. For example, the second lateral bend region 1540 can curve towards the first lateral direction, opposite the second lateral direction, that extends from the second edge 1508 toward the first edge 1506 as the contact beam 1516 extends away from the first lateral bend region 1538 along the longitudinal direction L. In alternative embodiments, the curvature of the contact beam 1516 can vary from that shown. For example, the contact beam 1516 can include as few as one lateral bend region, or greater than two lateral bend regions.

The anchoring region 1514 can define a central axis CA that extends in the longitudinal direction between the first and second broadsides 1510 and 1512. The second transverse bend region 1532 can extend at least partially on a first side of the central axis CA with respect to the transverse direction T, the first side being spaced from the central axis CA along a direction that is opposite the second broadside 1512. Further, the free end 1518 can be positioned on a second side of the central axis CA with respect to the transverse direction T, the second side being spaced from the central axis CA along a direction that is opposite the first broadside 1510.

The mounting end 1502 can include a mounting tail 1534 that extends away from the anchoring region 1514. For example, the mounting tail 1534 can define a surface-mount tail as shown that is bent, or otherwise curved, outward from the anchoring region 1514 along the transverse direction T, such as along a direction that extends from the first broadside 1510 towards the second broadside 1512. Thus, the mounting tail 1534 can be disposed on the same side of the central axis CA as the free end 1518 with respect to the transverse direction T as shown in FIG. 25. Alternatively, the mounting tail 1534 can extend on the opposite side of the central axis CA as the free end 1518. The mounting tail 1534 defines a terminal end 1536 of the electrical contact 1146. The terminal end 1536 can be configured as a mounting surface that mounts onto, such as abuts, an electrical contact of the first complementary electrical component 1300. The mounting surface can substantially face the longitudinal direction L, such as in a direction away from the free end 1518 of the electrical contact. Thus, the mounting surface can be configured to mount onto a complementary electrical component that lies in a plane that is substantially perpendicular to the longitudinal direction L. In alternative embodiments, the mounting tail 1534 can be configured as a differently-configured surface-mount tail, as a press-fit tail, as a fusible element such as a solder ball, or combinations thereof.

The electrical contact 1146 defines maximum length $L_{max,1}$ along the longitudinal direction L from the free end 1518 to the terminal end 1536. The electrical contact 1146 can further define a maximum width $W_{max}$ along the lateral direction A. The maximum width $W_{max}$ can be equal to at least one of the width $W_1$ of the first portion 1520 and the width $W_4$ of the second portion 1526, such as a larger of the widths $W_1$ and $W_4$. Alternatively, the maximum width $W_{max}$ can be equal to both the width $W_1$ of the first portion 1520 and the width $W_4$ of the second portion 1526 when the widths $W_1$ and $W_4$ are equal. The contact body 1507 yet further defines a maximum thickness $T_{max}$ along the transverse direction T from one of the opposed broadsides 1510 and 1512 to the other. The maximum length $L_{max,1}$ of the electrical contact 1146 can be greater than both the maximum width $W_{max}$ and the maximum thickness $T_{max}$. Further, the maximum width $W_{max}$ of the electrical contact 1146 can be greater than the maximum thickness $T_{max}$. Thus, the electrical contact 1146 can be said to be elongate along the longitudinal direction L.

Figure 29:
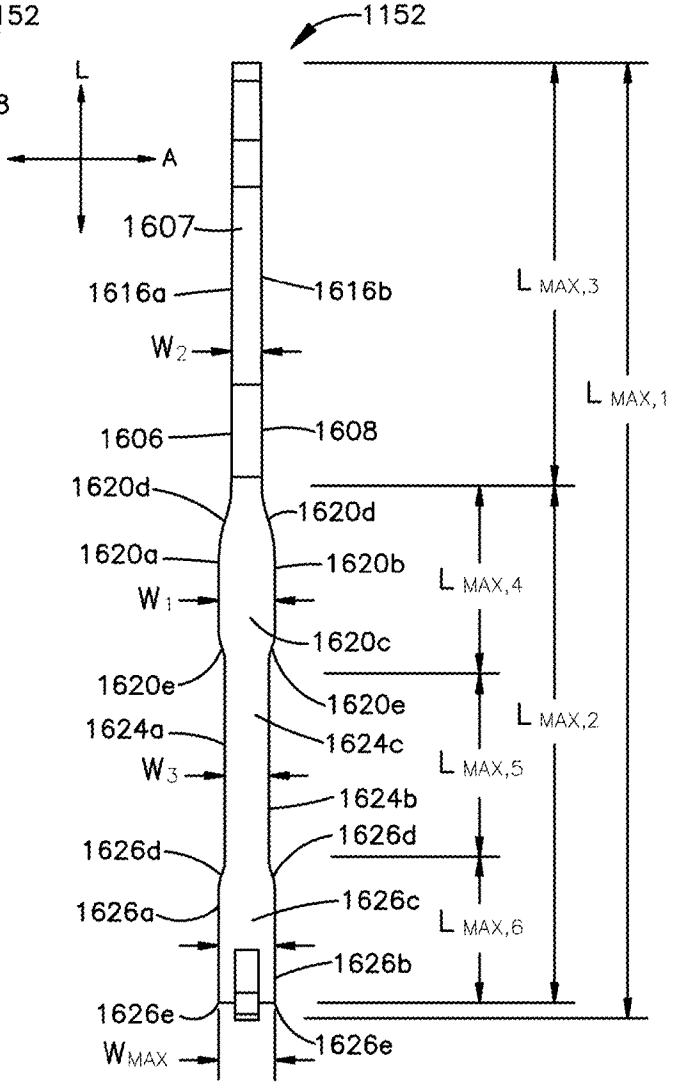
FIG. 29 shows a front plan view of the third electrical contact of FIG. 27.
Figure 28:
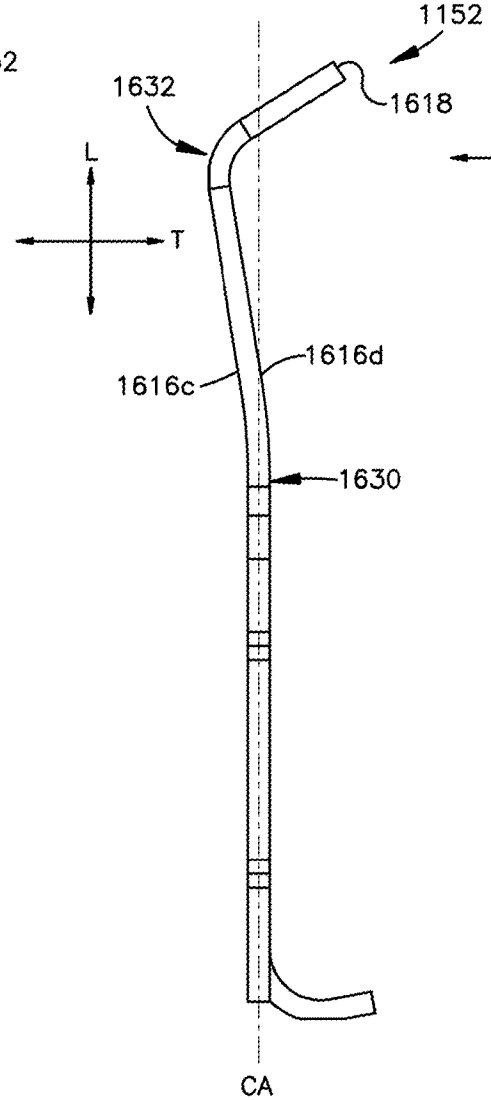
FIG. 28 shows a side plan view of the third electrical contact of FIG. 27.
Figure 27:
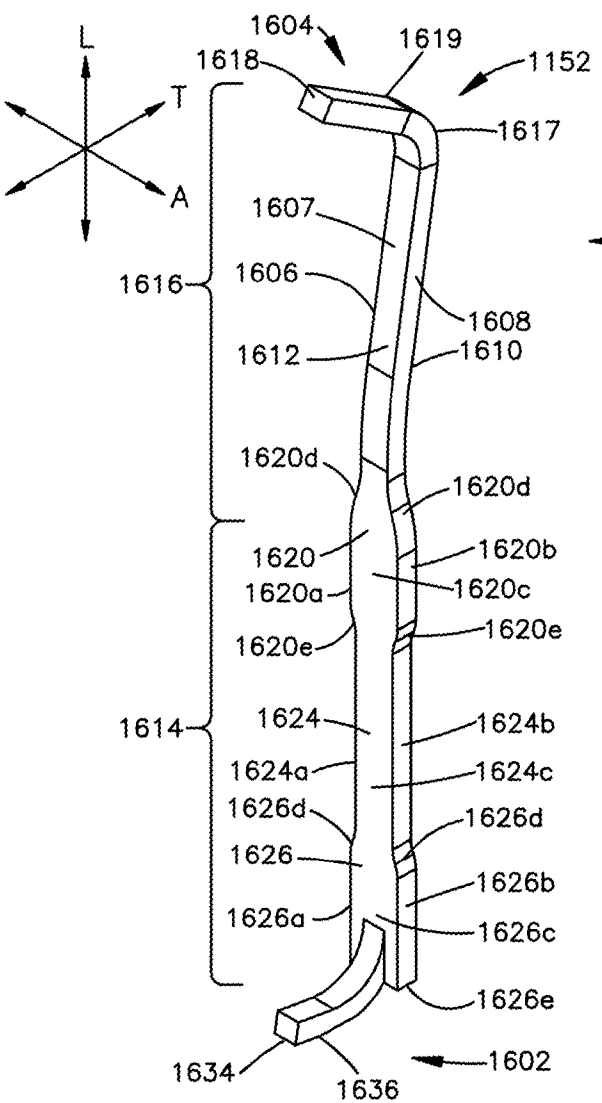
FIG. 27 shows a perspective view of an embodiment of a third electrical contact of the connector of FIG. 17.

Turning now to FIGS. 27 to 29, each electrical contact 1152 of the second set 1150 can be substantially similar to the electrical contacts 1144 and 1146 of the first set 1140 with a few exceptions. For example, in at least some embodiments, each electrical contact 1152 can have first and second portions 1620 and 1626 that extend out on both sides, rather than on a single side. Further, in at least some embodiments, each electrical contact 1152 can have dimensions that vary from those of the electrical contacts 1144 and 1146.

Each electrical contact 1152 of the second set 1150 can each include a mounting end 1602, and a mating end 1604 opposite the mounting end 1602 along the longitudinal direction L. The mounting end 1602 is configured to be mounted onto, for example, the first complementary electrical component 1200 along a mounting direction. The mating end 1604 is configured to mate with, for example, the second complementary electrical component 1300 along a mating direction. In one example, the mating direction and mounting direction can be oriented along the same direction. For instance, the mating direction and mounting direction can be oriented along the longitudinal direction L. Thus, the electrical contact 1152 is considered to be a vertical electrical contact. Alternatively, the electrical contact 1152 can be configured as a right-angle contact, whereby the mating direction and the mounting direction are oriented substantially perpendicular to each other. For instance, when the electrical contact 1152 is configured as a right-angle contact the mating end 1604 can be oriented along the longitudinal direction L, and the mounting end 1602 can be oriented along the transverse direction T.

The electrical contact 1152 includes a contact body 1607 that defines first and second edges 1606 and 1608, and first and second broadsides 1610 and 1612. The first and second edges 1606 and 1608 are spaced opposite from one another along the lateral direction A. Thus, the first and second edges 1606 and 1608 can face away from one another. At least respective portions of the first and second broadsides can be spaced opposite each other along the transverse direction T. Thus, the first and second broadsides 1610 and 1612 can face away from one another. It should therefore be appreciated that each of the first and second edges 1606 and 1608 are connected between the first and second broadsides 1610 and 1612. Similarly, each of the first and second broadsides 1610 and 1612 are connected between the first and second edges 1606 and 1608. The edges 1606 and 1608 and broadsides 1610 and 1612 can define respective distances along a plane that is oriented normal to the contact body 1607. For instance, the edges 1606 and 1608 can each extend along a first distance from one of the first and second broadsides 1610 and 1612 to the other of the first and second broadsides 1610 and 1612 along the plane. The broadsides 1610 and 1612 can each extend along a second distance from one of the first and second edges 1606 and 1608 to the other of the first and second edges 1606 and 1608 along the plane. The second distance can be greater than the first distance. In one example, the first distance can define a thickness of the contact body 1607, and the second distance can define a width of the contact body 1607. The thickness along at least a portion of the contact body 1607 can be oriented along the transverse direction T, and the width along at least a portion of the contact body 1607 can be oriented along the lateral direction A.

The electrical contact 1152 includes an anchoring region 1614 that is configured to secure the electrical contact 1152 to the connector housing 1102 of the electrical connector 1100. The electrical contact 1152 further includes a contact beam 1616 that extends out with respect to the anchoring region 1614. For instance, the contact beam 1616 can extend out with respect to the anchoring region 1614 along the longitudinal direction L. In one example, the contact beam 1616 can extend from the anchoring region 1614.

The contact beam 1616 has first and second sides **1616*a* and 1616*b*, and first and second faces 1616*c* and 1616*d*. The first and second sides 1616*a* and 1616*b* of the contact beam 1616 are defined by the first and second edges 1606 and 1608, respectively, of the contact body 1607. Similarly, the first and second faces 1616*c* and 1616*d* of the contact beam 1616 are defined by the first and second broadsides 1610 and 1612, respectively, of the contact body 1607. The contact beam 1616 can define a mating portion 1617 that is configured to mate with the second complementary electrical component 1300, and a stub 1619 that extends from the mating portion 1617 to the free end 1618. The anchoring region 1614 extends between the mounting end 1602 and the contact beam 1616. For instance, the anchoring region 1614 can extend from the mounting end 1602 to the contact beam 1616**.

The anchoring region 1614 can define a maximum length $L_{max,2}$. Further, the anchoring region 1614 can be disposed partially or fully below a midpoint of the electrical contact 1152 along the longitudinal direction L. The contact beam 1616 extends between a free end 1618 of the electrical contact 1618 and the anchoring region 1614, such as from the free end 1618 to the anchoring region 1614, and has a maximum length $L_{max,3}$. One or more up to all of the maximum lengths of the electrical contact 1152 can be different than the corresponding one or more up to all of the maximum lengths of the electrical contacts 1144 and 1146 as described in further detail below.

The anchoring region 1614 can be substantially planar as it extends from the mounting end 1602 to the contact beam 1616 along the longitudinal direction L. For instance, the broadsides 1610 and 1612 can be substantially planar along respective planes that are defined by the longitudinal direction L and the lateral direction A at the anchoring region 1614 from the mounting end 1612 to the contact beam 1616. Similarly, the edges 1606 and 1608 can be substantially planar along respective planes that are defined by the longitudinal direction L and the transverse direction at the anchoring region 1614 from the mounting end 1612 to the contact beam 1616. Alternatively, the anchoring region 1614 can have a bent, such as a curved, shape between the mounting end 1602 and the contact beam 1616.

The anchoring region 1614 can include at least one of first portion, a second portion, and a third portion. The third portion can be disposed between the first and second portions, and thus can be considered to be an intermediate portion. The third portion can define a width along the lateral direction A that is less than the width of at least one or both of the first and second enlarged portions along the lateral direction A. Thus, the third portion can be considered to be a narrowed portion and one or both of the first and second portions can be considered to be enlarged portions. In one example, one or both of the first and second portions can extend out from the contact body 1607. For instance, at least one of the first and second portions can extend out from one or both of the edges 1606 and 1608 along the lateral direction A. In one example, the anchoring region 1614 can include a first portion 1620, an intermediate portion 1624, and a second portion 1626. The intermediate portion 1624 can be disposed between the first and second portions 1620 and 1626. In one example, the intermediate portion 1624 can be defined by one or both of the edges 1606 and 1608 of the contact body 1607.

The first portion 1620 can define first and second opposed outermost sides 1620*a* and 1620*b*. The outermost sides 1620*a* and 1620*b* can be spaced from each other along the lateral direction A. The outermost sides 1620*a* and 1620*b* can be outwardly spaced from the respective first and second edges 1606 and 1608 along the lateral direction A. The first portion 1620 can have a width $W_1$ along the lateral direction A from the first outermost side 1620*a* to the second outermost side 1620*b*, the width $W_1$ being greater than the width $W_2$ of the broadsides 1610 and 1612 from the first edge 1606 to the second edge 1608. The first portion 1620 can extend between the contact beam 1616 and the mounting end 1602, such as from the contact beam 1616 towards the mounting end 1602. The first portion 1620 can have a substantially rectangular shape in a plane defined by the longitudinal and lateral directions as shown, or can have any other suitable shape in the plane such as a circle, square, or other polygon. Further, the first portion 1620 has a maximum length $L_{max,4}$. While the outermost sides 1620*a* and 1620*b* of the first portion 1620 can be spaced outward from the respective edges 1606 and 1608 with respect to the lateral direction A as described above, it should be appreciated that one or both of the outermost sides 1620*a* and 1620*b* can be aligned with, or at least not extend outward from, the respective first and second edges 1606 and 1608 as desired.

The first portion 1620 can extend out from at least one of the edges 1606 and 1608 along the lateral direction A. For instance, the first portion 1620 can extend out from both edges 1606 and 1608 of the contact beam 1616. Further portion 1620 can be coplanar with the broadsides 1610 and 1612. In alternative embodiments, the portion 1620 can extend out from only one of the first and second edges 1606 and 1608 along the lateral direction A. For example, one of the outermost sides 1620*a* and 1620*b* of the first portion 1620 can be spaced outward from a corresponding one of the first and second edges 1606 and 1608 with respect to the lateral direction A, and the other of the sides 1620*a* and 1620*b* of the first portion 1620 can extend up to a corresponding one of the first and second edges 1606 and 1608 of the contact beam 1616 along the lateral direction A.

The first portion 1620 can define a body 1620*c* and at least one shoulder, such as a first upper shoulder 1620*d* that extends from the body 1620*c* to the contact body 1607, and in particular to one of the first and second edges 1606 and 1608. The first portion 1620 can also define a second upper shoulder 1620*d* that extends from the body 1620*c* to the contact body 1607 and in particular to the other one of the first and second edges 1606 and 1608. It should be appreciated that one or both of the first and second upper shoulders 1620*d* can be omitted in some embodiments. Each upper shoulder 1620*d* can extend from the portion 1620 to the contact body 1607 along a direction having a directional component along the lateral direction A.

The intermediate portion 1624 can define opposed outermost sides 1624*a* and 1624*b*. The outermost sides 1624*a* and 1624*b* can be spaced from each other along the lateral direction A. In one example, the intermediate portion defines a width $W_3$ from one of the outermost sides 1624*a* and 1624*b* to the other of the outermost sides 1624 and 1624*b*. The width $W_3$ of the intermediate portion 1624 can be less than the corresponding width of one or both of the portions 1620 and 1626. For instance, the width $W_3$ of the intermediate portion 1624 can be less than the width of the broadsides 1610 and 1612 from one of the edges 1606 and 1608 to the other of the edges 1606 and 1608. Alternatively, the width $W_3$ of the intermediate portion 1624 can be greater than the width of the broadsides 1610 and 1612. Alternatively still, the outermost sides 1624*a* and 1624*b* can be defined by the first and second edges 1606 and 1608, respectively. Thus, the width $W_3$ of the intermediate portion 1624 can be substantially equal to the width of the broadsides 1610 and 1612.

The intermediate portion 1624 can extend between the first portion 1620 and the mounting end 1602 along the longitudinal direction L. For instance, the intermediate portion 1624 can extend from the first portion 1620 toward the mounting end 1602. The intermediate portion 1624 can define a maximum length $L_{max,5}$ along the longitudinal direction L. The intermediate portion 1624 can have a substantially rectangular shape in a plane defined by the longitudinal and lateral directions as shown, or can have any other suitable shape in the plane such as a circle, square, or other polygon. Further, the first outermost side 1624*a* can be linear as it extends from the first portion 1620 towards the mounting end 1602. Similarly, the second outermost side 1624*b* can be linear as it extends from the first portion 1620 towards the mounting end 1602. Alternatively, one or both of the first and second outermost sides 1624*a* and 1624*b* can be curved between the first portion 1620 and the mounting end 1602. For example, one or both of the first and second outermost sides 1624*a* and 1624*b* can be concave between the first portion 1620 and the mounting end 1602.

As shown, the intermediate portion 1624 of the electrical contact 1152 can be elongate along the longitudinal direction L as it extends between the first portion 1620 and the mounting end 1602, such that the maximum length $L_{max,5}$ of the intermediate portion 1624 is greater than each of the width $W_3$ of the intermediate portion 1624 along the lateral direction and the thickness of the intermediate portion 1624 along the transverse direction T. Further, the intermediate portion 1624 of the electrical contact 1152 can be shortened in comparison to the intermediate portions 1424 and 1524 of the electrical contacts 1144 and 1146, such that the maximum length $L_{max,5}$ of the intermediate portion 1624 is less than or equal to one or more of the width $W_3$ of the intermediate portion 1624 and the thickness of the intermediate portion 1624, or can be eliminated altogether.

The first portion 1620 can define at least one lower shoulder, such as a first lower shoulder 1620*e* that extends from the body 1620*c* of the first portion 1620 to the intermediate portion 1624. For instance, the first lower shoulder 1620*e* can extend from one of the outermost sides 1620*a* and 1620*b* to a corresponding one of the outermost sides 1624*a* and 1624*b*. The first portion 1620 can also define a second lower shoulder 1620*e* that extends from the body 1620*c* to the intermediate portion 1624. For instance, the second lower shoulder 1620*e* can extend the other of the outermost sides 1620*a* and 1620*b* to the corresponding other of the outermost sides 1624*a* and 1624*b*. It should be appreciated that one or both of the first and second lower shoulders 1620*e* can be omitted in some embodiments. Each lower shoulder 1620*e* can extend from the portion 1620 to the intermediate portion 1624 along a direction having a directional component along the lateral direction A. Further, each lower shoulder 1620*e* can face away from a corresponding upper shoulder 1620*d*.

The second portion 1626 can define opposed outermost sides 1626*a* and 1626*b*. The outermost sides 1626*a* and 1626*b* can be spaced from each other along the lateral direction A. The outermost sides 1626*a* and 1626*b* can be outwardly spaced from the respective first and second sides 1624*a* and 1624*b* of the intermediate portion 1624 along the lateral direction A. The outermost sides 1626*a* and 1626*b* can also be outwardly spaced from the respective first and second edges 1606 and 1608 along the lateral direction A. The second portion 1626 can have a width $W_4$ along the lateral direction A from the first outermost side 1626*a* to the second outermost side 1626*b*, the width $W_4$ being greater than the width $W_2$ of the broadsides 1610 and 1612 from the first edge 1606 to the second edge 1608. The second portion 1626 can extend between the contact beam 1616 and the mounting end 1602, such as from the mounting end 1602 towards the contact beam 1616. The second portion 1626 can have a substantially rectangular shape in a plane defined by the longitudinal and lateral directions as shown, or can have any other suitable shape in the plane such as a circle, square, or other polygon. Further, the second portion 1626 has a maximum length $L_{max,6}$. While the outermost sides 1626*a* and 1626*b* of the second portion 1626 can be spaced outwardly from the respective first and second sides 1624*a* and 1624*b* with respect to the lateral direction A as described above, it should be appreciated that one or both of the outermost sides 1626*a* and 1626*b* can be continuous with the respective first and second sides 1624*a* and 1624*b* as desired.

The second portion 1626 can extend outward from at least one of the sides 1624*a* and 1624*b* of the intermediate portion 1624 along the lateral direction A. For instance, the second portion 1626 can extend outward from both of the sides 1624*a* and 1624*b* of the intermediate portion 1624. Further, the second portion 1626 can be coplanar with the broadsides 1610 and 1612. In alternative embodiments, the second portion 1626 can extend out from only one of the first and second sides 1624*a* and 1624*b* along the lateral direction A. For example, one of the outermost sides 1626*a* and 1626*b* of the second portion 1626 can be spaced outward from a corresponding one of the first and second sides 1624*a* and 1624*b* with respect to the lateral direction A, and the other of the sides 1626*a* and 1626*b* of the second portion 1626 can be aligned with, or at least not extend outward from, a corresponding one of the first and second sides 1624*a* and 1624*b* of the intermediate portion.

The second portion 1626 can define a body 1626*c* and at least one shoulder, such as a first upper shoulder 1626*d* that extends from the body 1626*c* to the intermediate portion 1624, and in particular to one of the first and second sides 1624*a* and 1624*b* of the intermediate portion 1624. The second portion 1626 can also define a second upper shoulder 1626*d* that extends from the body 1626*c* to the intermediate portion 1624, and in particular to the other one of the first and second sides 1624*a* and 1624*b* of the intermediate portion 1624. It should be appreciated that one or both of the first and second upper shoulders 1626*d* can be omitted in some embodiments. Each upper shoulder 1620*d* can extend from the portion 1626 to the contact body intermediate portion 1624 along a direction having a directional component along the lateral direction A. Further, each upper shoulder 1626*c* can face a corresponding lower shoulder 1620*c* of the first portion 1620.

The second portion 1626 can define at least one lower shoulder, such as a first lower shoulder 1626*e* that extends from the body 1626*c* of the second portion 1626 to the mounting tail 1634. For instance, the first lower shoulder 1626*e* can extend from one of the outermost sides 1626*a* and 1626*b* to a corresponding side of the mounting tail 1634. The second portion 1626 can also define a second lower shoulder 1626*e* that extends from the body 1626*c* of the second portion 1626 to the mounting tail 1634. For instance, the second lower shoulder 1626*e* can extend from the other one of the outermost sides 1626*a* and 1626*b* to a corresponding side of the mounting tail 1634. It should be appreciated that one or both of the first and second lower shoulders 1626*e* can be omitted in some embodiments. Each lower shoulder 1626*e* can extend from the portion 1626 to the mounting tail 1634 along a direction having a directional component along the lateral direction A. Further, each lower shoulder 1626*e* can face away from a corresponding upper shoulder 1626*d*.

The contact beam 1616 can be constructed as a flexible beam having a bent, such as curved, shape that extends from the anchoring region 1614 to a free end 1618 of the electrical contact 1152. Bent structures as described herein refer to bent shapes that can be fabricated, for instance, by bending the end or by stamping a bent shape, or by any other suitable manufacturing process. The first broadside 1610 at the contact beam 1616 is configured to wipe against the second complementary electrical component 1300 as the component is mated with the contact beam 1616 along the longitudinal direction L. Further, the contact beam 1616 is configured to contact the second complementary electrical component 1300 so as to apply a force to a surface of the complementary electrical component 1300 along the transverse direction T.

The contact beam 1616 can include at least a first transverse bend region 1630 between the anchoring region 1614 and the mating end 1604. The first bend region 1630 can curve towards the first transverse direction that extends from the second broadside 1612 toward the first broadside 1610 as the contact beam 1616 extends away from the anchoring region 1614 along the longitudinal direction L. The contact beam 1616 can further include at least a second transverse bend region 1632 that is between the first bend region 1630 and the mating end 1604. The second bend region 1632 can curve towards the second transverse direction, opposite the first transverse direction, that extends from the first broadside 1610 toward the second broadside 1612 as the contact beam 1616 extends away from the first bend region 1630 along the longitudinal direction L. In alternative embodiments, the curvature of the contact beam 1616 can vary from that shown. For example, the contact beam 1616 can include as few as one bend region, or greater than two bend regions.

At the contact beam 1616, at least one of the first and second edges 1606 and 1608 can taper toward the other of the first and second edges 1606 and 1608 as the contact body extends along a direction from the anchoring region 1614 toward the mating portion 1617. For example, the first edge 1606 can taper towards the second edge 1608 as the first edge 1606 extends from the anchoring region 1614 to at least the second bend region 1632 or the free end 1618. Similarly, the second edge 1608 can taper toward the first edge 1606 as the second edge 1606 extends from the anchoring region 1614 to at least the second bend region 1632 or the free end 1618. Alternatively, one or both of the first and second edges can extend along the longitudinal direction L as the contact body 1607 extends from the anchoring region 1614 to at least the second bend region 1632 or the free end 1618. For instance, the first and second edges 1606 and 1608 can be parallel with each other as the contact body 1607 extends from the anchoring region 1614 to at least the second bend region 1632 or the free end 1618. As another example, the second edge 1608 can taper towards the first edge 1606 as the second edge 1608 extends from the anchoring region 1614 to at least the second bend region 1632 or the free end 1618, while the first edge 1606 can extend along the longitudinal direction L as the first edge 1606 extends from the anchoring region 1614 to at least the second bend region 1632 or the free end 1618. As yet another example, the first and second edges 1606 and 1608 can taper towards each other as they extend from the anchoring region 1614 to at least the second bend region 1632 or the free end 1618. Alternatively, the first and second edges 1606 and 1608 can be parallel to one another along at least a portion up to an entirety of the length of the contact beam 1616.

The anchoring region 1614 can define a central axis CA that extends in the longitudinal direction between the first and second broadsides 1610 and 1612. The second bend region 1632 can extend at least partially on a first side of the central axis CA with respect to the transverse direction T, the first side being spaced from the central axis CA along a direction that is opposite the second broadside 1612. Further, the free end 1618 can be positioned on a second side of the central axis CA with respect to the transverse direction T, the second side being spaced from the central axis CA along a direction that is opposite the first broadside 1610.

The mounting end 1602 can include a mounting tail 1634 that extends away from the anchoring region 1614. For example, the mounting tail 1634 can define a surface-mount tail as shown that is bent, or otherwise curved, outward from the anchoring region 1614 along the transverse direction T, such as along a direction that extends from the first broadside 1610 towards the second broadside 1612. Thus, the mounting tail 1634 can be disposed on the same side of the central axis CA as the free end 1618 with respect to the transverse direction T as shown in FIG. 28. Alternatively, the mounting tail 1634 can extend on the opposite side of the central axis CA as the free end 1618. The mounting tail 1634 defines a terminal end 1636 of the electrical contact 1152. The terminal end 1636 can be configured as a mounting surface that mounts onto, such as abuts, an electrical contact of the first complementary electrical component 1200. The mounting surface can substantially face the longitudinal direction L, such as in a direction away from the free end 1618 of the electrical contact. Thus, the mounting surface can be configured to mount onto a complementary electrical component that lies in a plane that is substantially perpendicular to the longitudinal direction L. In alternative embodiments, the mounting tail 1634 can be configured as a differently-configured surface-mount tail, as a press-fit tail, as a fusible element such as a solder ball, or combinations thereof.

The electrical contact 1152 defines maximum length $L_{max,1}$ along the longitudinal direction L from the free end 1618 to the terminal end 1636. The electrical contact 1152 further defines a maximum width $W_{max,1}$ along the lateral direction A. The maximum width $W_{max,1}$ can be equal to at least one of the width $W_1$ of the first portion 1620 and the width $W_4$ of the second portion 1626, such as a larger of the widths $W_1$ and $W_4$. Alternatively, the maximum width $W_{max,1}$ can be equal to both the width $W_1$ of the first portion 1620 and the width $W_4$ of the second portion 1626 when the widths $W_1$ and $W_4$ are equal. The contact body 1607 yet further defines a maximum thickness $T_{max}$ along the transverse direction T from one of the opposed broadsides 1610 and 1612 to the other. The maximum length $L_{max,1}$ of the electrical contact 1152 is greater than both the maximum width $W_{max,1}$ and the maximum thickness $T_{max}$. Further, the maximum width $W_{max,1}$ of the electrical contact 1152 can be greater than the maximum thickness $T_{max}$. Thus, the electrical contact 1152 can be said to be elongate along the longitudinal direction L.

Figure 30:
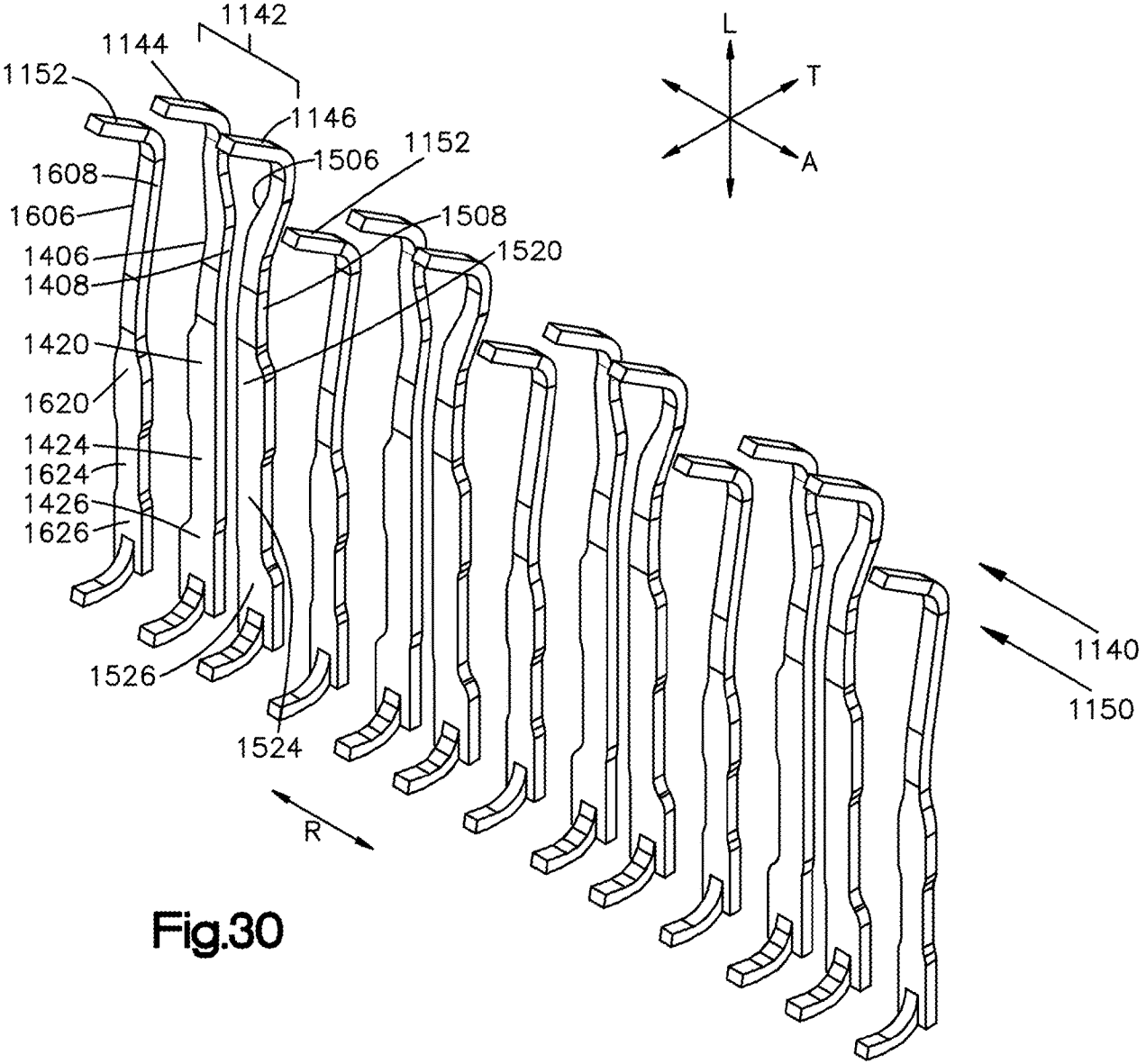
FIG. 30 shows a perspective view of a row of the contacts of FIG. 1 according to one embodiment.
Figure 31:
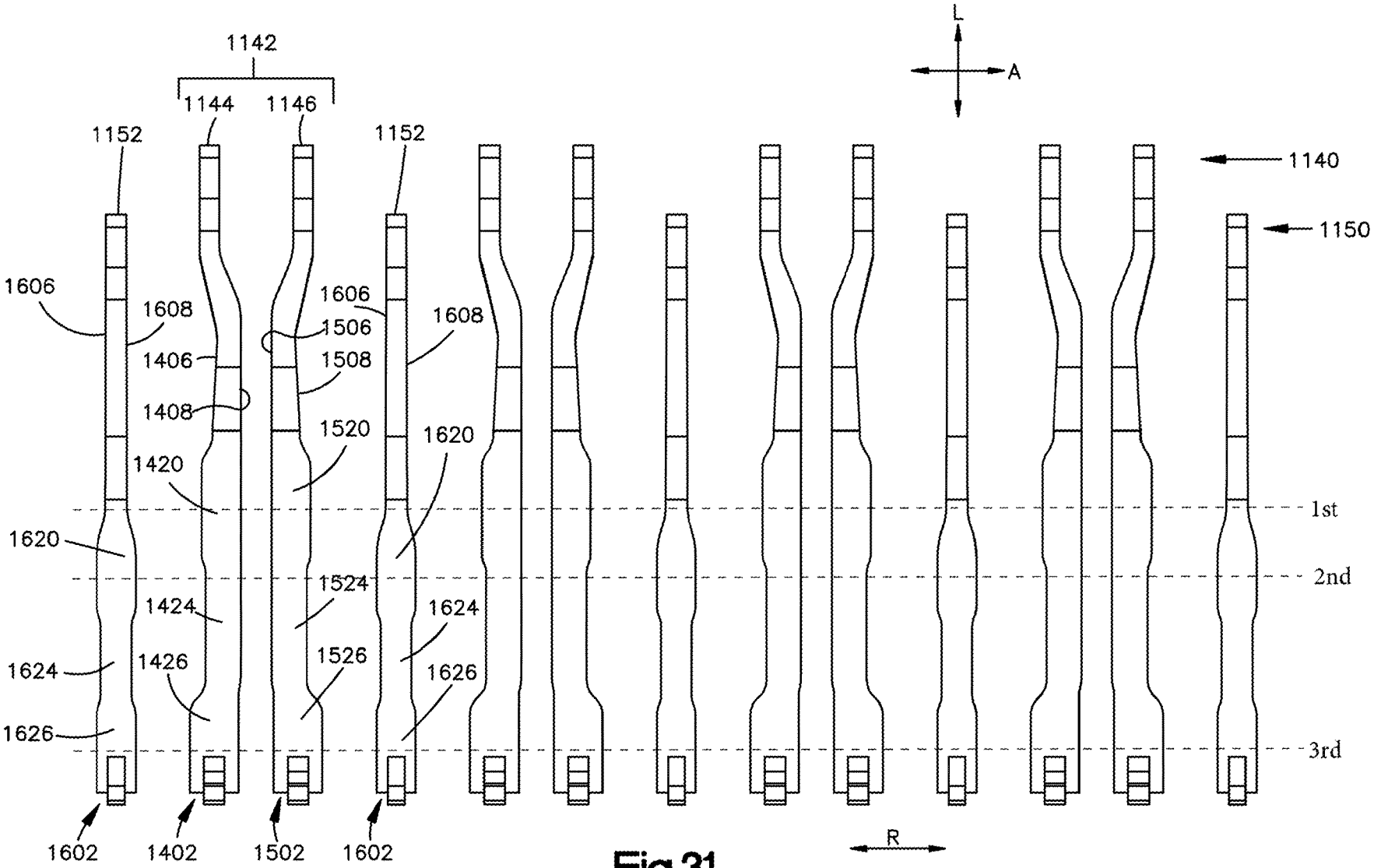
FIG. 31 shows a front plan view of the row of FIG. 30.

Turning now to FIGS. 30 and 31, embodiments of the present disclosure can include a kit having two or more of (i) at least a first electrical contact 1144 of FIGS. 21 to 23, (ii) at least a second electrical contact 1146 of FIGS. 24 to 26, (iii) at least a third electrical contact 1152 of FIGS. 27 to 29, and at least a fourth contact 1152 of FIGS. 27 to 29. For example, a kit can include at least one pair 1142 of the at least first electrical contact 1144 and the at least second electrical contact 1146. As shown, each pair 1142 of the first and second electrical contacts 1144 and 1146 can be arranged edge-to-edge such that the second edge 1408 of the first electrical contact 1144 faces the first edge 1506 of the second electrical contact 1146. At least a portion of the second edge 1408 of the first electrical contact 1144 can be substantially parallel to at least a portion of the first edge 1506 of the second electrical contact 1146. Further, at least one, up to all, of the sides 1420*b*, 1424*b*, and 1426*b* of the first electrical contact 1144 can be parallel to at least one, up to all, of the sides 1520*a*, 1524*a*, and 1526*a* of the second electrical contact 1146.

The inner edges 1408 and 1506 of the contact beams 1416 and 1516 of the first and second electrical contacts 1144 and 1146 define the inner-most points of the first and second electrical contacts 1144 and 1146 along the lateral direction A. Therefore, the contact beams 1416 and 1516 of the first and second electrical contacts 1144 and 1146 can be closer to one another than comparable electrical connectors where the anchoring regions, not the contact beams, define the inner-most points. Without being bound by theory, it is believed that the closer spacing can result in the contact beams 1416 and 1516 of the first and second electrical contacts 1144 and 1146 being more tightly coupled together than comparable contacts having inner edges that are not linear. Further, it is believed that the tighter coupling can increase the power flow of the signals in between the first and second electrical contacts 1144 and 1146 along the longitudinal direction L, can improve impedance control, and can reduce crosstalk.

The first and second electrical contacts 1144 and 1146 can be arranged such that their respective mounting ends 1402 and 1502 are aligned along the lateral direction A. In this arrangement, at least a portion of the anchoring region 1414 of the first electrical contact 1144 can be substantially aligned with at least a portion of the anchoring region 1514 of the second electrical contact 1146 along the lateral direction A. The anchoring regions 1414 and 1514 can each define an upper-most point and a lower-most point of the respective anchoring regions 1414 and 1514 along the longitudinal direction L, the upper-most points being closest to the respective mating ends 1404 and 1504 and the lower-most points being closest to the respective mounting ends 1402 and 1502. Each anchoring region can define its maximum length $L_{max,2}$ from its upper-most point to its lower-most point.

At least one of the upper-most point and lower-most point of the anchoring region 1414 can be substantially aligned with a corresponding one of the upper-most point and lower-most point of the anchoring region 1514 along the lateral direction A. For example, the upper-most point of the anchoring region 1414 can be substantially aligned with the upper-most point of the anchoring region 1514. In addition, or alternatively, the lower-most point of the anchoring region 1414 can be substantially aligned with the lower-most point of the anchoring region 1514. In addition, or alternatively, a center of the anchoring region 1414 of the first electrical contact 1144 can be substantially aligned with a center of the anchoring region 1514 of the second electrical contact 1146 along the lateral direction A. Alternatively still, a portion of the anchoring region 1414 can be aligned with a portion of the anchoring region 1514 along the lateral direction A, without the upper-most point and lower-most point of the anchoring region 1414 being aligned with the corresponding upper-most point and lower-most point of the anchoring region 1514.

At least a portion of the first portion 1420 of the first electrical contact 1144 can be substantially aligned with a portion of the first portion 1520 of the second electrical contact 1146 along the lateral direction A. The first portions 1420 and 1520 can each define an upper-most point and a lower-most point of the respective first portions 1420 and 1520 along the longitudinal direction L, the upper-most points being closest to the respective mating ends 1404 and 1504 and the lower-most points being closest to the respective mounting ends 1402 and 1502. Each first portion can be define it maximum length $L_{max,4}$ of from its upper-most point to its lower-most point. In at least some embodiments, the upper-most point of the first portion 1420 can define the upper-most point of the anchoring region 1414. Similarly, the upper-most point of the first portion 1520 can define the upper-most point of the anchoring region 1514.

At least one of the upper-most point and lower-most point of the first portion 1420 can be substantially aligned with a corresponding one of the upper-most point and lower-most point of the first portion 1520 along the lateral direction A. For example, the upper-most point of the first portion 1420 can be substantially aligned with the upper-most point of the first portion 1520. In addition, or alternatively, the lower-most point of the first portion 1420 can be substantially aligned with the lower-most point of the first portion 1520. In addition, or alternatively, a center of the first portion 1420 of the first electrical contact 1144 can be substantially aligned with a center of the first portion 1520 of the second electrical contact 1146 along the lateral direction A. Alternatively still, a portion of the first portion 1420 can be aligned with a portion of the first portion 1520 along the lateral direction A, without the upper-most point and lower-most point of the first portion 1420 being aligned with the corresponding upper-most point and lower-most point of the first portion 1520.

At least a portion of the intermediate portion 1424 of the first electrical contact 1144 can be substantially aligned with a portion of the intermediate portion 1524 of the second electrical contact 1146 along the lateral direction A. The intermediate portions 1424 and 1524 can each define upper and lower-most points of the respective intermediate portions 1424 and 1524 along the longitudinal direction L, the upper-most points being closest to the respective mating ends 1404 and 1504 and the lower-most points being closest to the respective mounting ends 1402 and 1502. Each intermediate portion can define its maximum length $L_{max,5}$ from its upper-most point to its lower-most point.

At least one of the upper-most point and lower-most point of the intermediate portion 1424 can be substantially aligned with a corresponding one of the upper-most point and lower-most point of the intermediate portion 1524 along the lateral direction A. For example, the upper-most point of the intermediate portion 1424 can be substantially aligned with the upper-most point of the intermediate portion 1524. In addition, or alternatively, the lower-most point of the intermediate portion 1424 can be substantially aligned with the lower-most point of the intermediate portion 1524. In addition, or alternatively, a center of the intermediate portion 1424 of the first electrical contact 1144 can be substantially aligned with a center of the intermediate portion 1524 of the second electrical contact 1146 along the lateral direction A. Alternatively still, a portion of the intermediate portion 1424 can be aligned with a portion of the intermediate portion 1524 along the lateral direction A, without the upper-most point and lower-most point of the intermediate portion 1424 being aligned with the corresponding upper-most point and lower-most point of the intermediate portion 1524.

At least a portion of the second portion 1426 of the first electrical contact 1144 can be substantially aligned with a portion of the second portion 1525 of the second electrical contact 1146 along the lateral direction A. The second portions 1426 and 1526 can each define upper and lower-most points of the respective second portions 1426 and 1526 along the longitudinal direction L, the upper-most points being closest to the respective mating ends 1404 and 1504 and the lower-most points being closest to the respective mounting ends 1402 and 1502. Each second portion can define its maximum length $L_{max,6}$ from its upper-most point to its lower-most point. In at least some embodiments, the lower-most point of the second portion 1426 can define the lower-most point of the anchoring region 1414. Similarly, the lower-most point of the second portion 1526 can define the lower-most point of the anchoring region 1514.

At least one of the upper-most point and lower-most point of the second portion 1426 can be substantially aligned with a corresponding one of the upper-most point and lower-most point of the second portion 1526 along the lateral direction A. For example, the upper-most point of the second portion 1426 can be substantially aligned with the upper-most point of the second portion 1526. In addition, or alternatively, the lower-most point of the second portion 1426 can be substantially aligned with the lower-most point of the second portion 1526. In addition, or alternatively, a center of the second portion 1426 of the first electrical contact 1144 can be substantially aligned with a center of the second portion 1526 of the second electrical contact 1146 along the lateral direction A. Alternatively still, a portion of the second portion 1426 can be aligned with a portion of the second portion 1526 along the lateral direction A, without the upper-most point and lower-most point of the second portion 1426 being aligned with the corresponding upper-most point and lower-most point of the second portion 1526.

The kit can also include the at least a third electrical contact 1152 of FIGS. 27 to 29. Each third electrical contact 1152 can be arranged edge-to-edge with one of the first and second electrical contacts 1144 and 1146 such that either the second edge 1608 of the third electrical contact 1152 faces the first edge 1406 of the first electrical contact 1144 or the first edge 1606 of the third electrical contact 1152 faces the second edge 1508 of the second electrical contact 1146.

Each third electrical contact 1152 can be arranged such that its mounting end 1602 is aligned with the mounting ends 1402 and 1502 of the first and second electrical contacts 1144 and 1146 along the lateral direction A. In this arrangement, at least a portion of the anchoring region 1614 of the third electrical contact 1152 can be substantially aligned with at least a portion of one or both of the anchoring region 1414 of the first electrical contact 1144 and the anchoring region 1415 of the second electrical contact 1146 along the lateral direction A. The anchoring region 1614 can define an upper-most point and a lower-most point of the anchoring region 1614 along the longitudinal direction L, the upper-most point being closest to the mating end 1604 and the lower-most point being closest to the mounting end 1602. The anchoring region 1614 can define its maximum length $L_{max,2}$ from its upper-most point to its lower-most point.

The kit can also include the at least a fourth electrical contact 1152 of FIGS. 27 to 29. Each fourth electrical contact 1152 can be arranged edge-to-edge with another one of the first and second electrical contacts 1144 and 1146 such that either the second edge 1608 of the third electrical contact 1152 faces the first edge 1406 of the first electrical contact 1144 or the first edge 1606 of the third electrical contact 1152 faces the second edge 1508 of the second electrical contact 1146. For instance, the first and second electrical contacts 1144 and 1146 can be between the third and fourth electrical contacts 1152.

Each fourth electrical contact 1152 can be arranged such that its mounting end 1602 is aligned with the mounting ends 1402 and 1502 of the first and second electrical contacts 1144 and 1146 along the lateral direction A. In this arrangement, at least a portion of the anchoring region 1614 of the fourth electrical contact 1152 can be substantially aligned with at least a portion of one or both of the anchoring region 1414 of the first electrical contact 1144 and the anchoring region 1415 of the second electrical contact 1146 along the lateral direction A. The anchoring region 1614 can define an upper-most point and a lower-most point of the anchoring region 1614 along the longitudinal direction L, the upper-most point being closest to the mating end 1604 and the lower-most point being closest to the mounting end 1602. The anchoring region 1614 can define its maximum length $L_{max,2}$ from its upper-most point to its lower-most point.

When supported by a connector housing, the center points of the first portions 1420 and 1520 of the first and second electrical contacts 1144 and 1146 can be aligned along a first line that extends substantially along the lateral direction A. Further, the center points of the first portions 1620 of the third and fourth electrical contacts 152 can be aligned along a second line that extends substantially along the lateral direction A. The second line can be offset from the first line along the longitudinal direction L. For example, the second line can be closer the mounting ends than the first line. Further, the second line can be substantially parallel to the first line. Similarly, the center points of the first 1420, 1520, and 1620 of the first to fourth electrical contacts can be aligned along a third first line that extends substantially along the lateral direction A. The third line can be offset from the first and second lines along the longitudinal direction L. For example, the second line can be between the first and third lines along the longitudinal direction. Further, the third line can be substantially parallel one or both of the first and second lines.

At least one of the upper-most point and lower-most point of the anchoring region 1614 can be substantially aligned with a corresponding one of the upper-most point and lower-most point of each of the anchoring regions 1414 and 1514 along the lateral direction A. For example, the lower-most point of the anchoring region 1614 can be substantially aligned with the lower-most point of one or both of the anchoring regions 1414 and 1514. As shown, the upper-most point of the anchoring region 1614 can be aligned with one or both of the first portions 1420 and 1426 of the first and second contacts 1144 and 1146 along the lateral direction A, between the respective upper-most and lower-most points of the first portions 1420 and 1426. Alternatively, the upper-most point of the anchoring region 1614 can be aligned with the upper most point of one or both of the first portions 1420 and 1426 along the lateral direction A, such that maximum lengths $L_{max,2}$ of the anchoring regions 1420, 1520, and 1620 are substantially equal to one another. In such a case, a center of the anchoring region 1614 of the third electrical contact 1152 can be substantially aligned with a center of the anchoring regions 1414 and 1514 of one or both of the first and second electrical contacts 1144 and 1146 along the lateral direction A.

At least a portion of the second portion 1626 of one or both of the third and fourth electrical contact 1152 can be substantially aligned with a portion of one or both of the second portions 1426 and 1526 of the first and second electrical contacts 1144 and 1146 along the lateral direction A. The second portion 1626 can define an upper-most point and a lower-most point of the first portion 1626 along the longitudinal direction L, the upper-most points being closest to the mating end 1604 and the lower-most point being closest to the mounting end 1602. The second portion 1626 can define its maximum length $L_{max,6}$ from its upper-most point to its lower-most point. In at least some embodiments, the lower-most point of the second portion 1626 can define the lower-most point of the anchoring region 1614.

At least one of the upper-most point and lower-most point of the second portion 1626 can be substantially aligned with a corresponding one of the upper-most point and lower-most point of one or both of the second portions 1426 and 1526 along the lateral direction A. For example, the lower-most point of the second portion 1426 can be substantially aligned with one or both of the lower-most points of the second portions 1426 and 1526. In addition, or alternatively, the upper-most point of the second portion 1626 can be substantially aligned with one or both of the upper-most points of the second portions 1426 and 1526. In addition, or alternatively, a center of the second portion 1626 of the third electrical contact 1152 can be substantially aligned with a center of one or both of the second portions 1426 and 1526 along the lateral direction A. Alternatively still, a portion of the second portion 1626 can be aligned with a portion of one or both of the second portions 1426 and 1526 along the lateral direction A, without one or both of the upper-most point and lower-most point of the second portion 1626 being aligned with a corresponding one of the upper-most point and lower-most point of the second portions 1426 and 1526.

At least a portion of the intermediate portion 1624 of the third electrical contact 1152 can be substantially aligned with a portion of one or both of the anchoring regions 1414 and 1514 between the mounting ends 1402 and 1502 of the anchoring regions 1414 and 1514 and their respective first portions 1420 and 1520 along the lateral direction A. The intermediate portion 1624 can define an upper-most point and a lower-most point of the respective intermediate portion 1624 along the longitudinal direction L, the upper-most point being closest to the respective mating end 1604 and the lower-most point being closest to the mounting ends 1602.

The intermediate portion 1624 can define its maximum length $L_{max,5}$ from its upper-most point to its lower-most point.

The lower-most point of the intermediate portion 1624 can be substantially aligned between the mounting end 1402 and the first portion 1420 of the anchoring region 1414, between the mounting end 1502 and the first portion 1520 of the anchoring region 1514, or both, along the lateral direction A. For example, the lower-most point of the intermediate portion 1624 can be substantially aligned with the lower-most point of one or both of the intermediate portions 1424 and 1524. The upper-most point of the intermediate portion 1624 can be substantially aligned between the second portion 1426 and the upper-most point of the first portion 1420, between the second portion 1526 and the upper-most point of the first portion 1420, or both, along the lateral direction A. For example, the upper-most point of the intermediate portion 1624 can be substantially aligned between the second portion 1426 and the lower-most point of the first portion 1420, between the second portion 1526 and the lower-most point of the first portion 1520, or both, along the lateral direction A. In at least some embodiments, the intermediate portion 1624 can have a center that is aligned between the second portion 1426 and the lower-most point of the first portion 1420, between the second portion 1526 and the lower-most point of the first portion 1520, or both, along the lateral direction A. Alternatively, the upper-most point of the intermediate portion 1624 can be substantially aligned with the lower-most point of the first portion 1420, the lower-most point of the first portion 1520, or both, along the lateral direction A.

The first portion 1620 can be staggered with respect to the first portions 1420 and 1520 of the first and second contacts 1144 and 1146 along the lateral direction A. For example, the first portion 1620 can be substantially aligned between the second portion 1426 of the first electrical contact 1144 and the upper-most point of the anchoring region 1414, between the second portion 1526 of the second electrical contact 1146 and the upper-most point of the anchoring region 1514, or both, along the lateral direction A. The first portion 1620 can define an upper-most point and a lower-most point of the respective first portion 1620 along the longitudinal direction L, the upper-most point being closest to the respective mating end 1604 and the lower-most point being closest to the mounting end 1602. The first portion 1620 can define its maximum length $L_{max,4}$ from its upper-most point to its lower-most point. In at least some embodiments, the upper-most point of the first portion 1620 can define the upper-most point of the anchoring region 1614.

The lower-most point of the first portion 1620 can be substantially aligned between the second portion 1426 and the upper-most point of the anchoring region 1414, between the second portion 1526 and the upper-most point of the anchoring region 1514, or both. For example, the lower-most point of the first portion 1620 can be substantially aligned between the second portion 1426 and the lower-most point of the first portion 1420, between the second portion 1526 and the upper-most point of the first portion 1520, or both. Alternatively, the lower-most point of the first portion 1620 can be substantially aligned with the lower-most point of one or both of the first portions 1420 and 1520.

The upper-most point of the first portion 1620 can be substantially aligned between the second portion 1426 and the upper-most point of the first portion 1420, between the second portion 1526 and the upper-most point of the first portion 1520, or both, along the lateral direction A. For example, the upper-most point of the first portion 1620 can be substantially aligned between the upper-most and lower-most points of the first portion 1420, between upper-most and lower-most points of the first portion 1520, or both, along the lateral direction A. In at least some embodiments, the first portion 1620 can have a center that is aligned between the second portion 1426 and the lower-most point of the first portion 1420, between the second portion 1526 and the upper-most point of the first portion 1520, or both, along the lateral direction. Alternatively, the upper-most point of the first portion 1620 can be substantially aligned with the upper-most point of one or both of the first portions 1420 and 1520. Thus, the center of the first portion 1620 can be substantially aligned with the center of one or both of the first portions 1420 and 1520.

Each of the first and second electrical contacts 1144 and 1146 can have a maximum length $L_{max,1}$ along the longitudinal direction L from their mounting ends 1402 and 1502 to their respective mating ends 1404 and 1504 that is greater than a maximum length $L_{max,1}$ of the third electrical contact 1152 along the longitudinal direction L from its mounting end 1602 to its mating end 1604. However, in alternative embodiments, the maximum lengths $L_{max,1}$ of the first, second, and third electrical contacts can be equal. Further, each of the anchoring regions 1414 and 1514 of the first and second electrical contacts 1144 and 1146 can have a maximum length $L_{max,2}$ that is greater than a maximum length $L_{max,2}$ of the anchoring region 1614 of the third electrical contact 1152. However, in alternative embodiments, the maximum lengths $L_{max,2}$ of the anchoring regions of the first, second, and third electrical contacts can be equal. Yet further, each of the intermediate portions 1426 and 1526 of the first and second electrical contacts 1144 and 1146 can have a maximum length $L_{max,5}$ that is greater than a maximum length $L_{max,5}$ of the intermediate portion 1626 of the third electrical contact 1152. However, in alternative embodiments, the maximum lengths $L_{max,5}$ of the intermediate portions of the first, second, and third electrical contacts can be equal. Yet still further, each of the contact beams 1416 and 1516 of the first and second electrical contacts 1144 and 1146 can have a maximum length $L_{max,3}$ that is substantially equal to a maximum length $L_{max,3}$ of the contact beam 1616 of the third electrical contact 1616. However, in alternative embodiments, the maximum lengths $L_{max,3}$ of the contact beams of the first, second, and third contacts can vary. For example, the length of each stub 1419 and 1519 can be greater than the length of the stub 1619. The maximum lengths $L_{max,4}$ of the first portions of the first, second, and third contacts can be equal as shown or can vary from one another. Similarly, the maximum lengths $L_{max,6}$ of the second portions of the first, second, and third contacts can be equal as shown or can vary from one another.

The second portion of each one of the first, second and third contacts 1144, 1146, and 1152 can be considered the lower-most enlarged portion of the contact with respect to its mounting end. Thus, the anchoring region 1414 of the first contact 1144 has a lower-most enlarged portion 1426 that is closest to the mounting end 1402, the anchoring region 1514 of the second contact 1146 has a lower-most enlarged portion 1526 that is closest to the mounting end 1502, and the anchoring region 1614 of the third contact 1152 has a lower-most enlarged portion 1626 that is closest to the mounting end 1602. The lower-most enlarged portions 1426 and 1626 of the first and third contacts 1144 and 1152 can be aligned with one another along the lateral direction A. For example, the lower-most enlarged portions 1426 and 1626 of the first and third contacts 1144 and 1152 can be fully aligned with one another along the lateral direction A. All other enlarged portions of the anchoring region of the third contact 1152 can have at least a portion that is out of alignment with all other enlarged portions of the anchoring regions of the first and second contacts 1144 and 1146. Similarly, all other enlarged portions of the anchoring regions of the second and third contacts 1144 and 1146 can have at least a portion that is out of alignment with all other enlarged portions of the anchoring region of the third contacts 1152.

Further, the lower-most enlarged portions 1526 and 1626 of the second and third contacts 1146 and 1152 can be aligned with one another along the lateral direction A. For example, the lower-most enlarged portions 1526 and 1626 of the second and third contacts 1146 and 1152 can be fully aligned with one another along the lateral direction A. All other enlarged portions of the anchoring region of the third contact 1152 can have at least a portion that is out of alignment with all other enlarged portions of the anchoring region of the second contact 1146.

Now the dimensions of the third electrical contact 1152 will be compared with the dimensions of the first and second electrical contacts 1144 and 1146. The first and second electrical contacts each have a maximum length $L_{max,1}$ from their respective mounting tails 1434 and 1534 to their respective free ends 1418 and 1518 that is greater than a maximum length $L_{max,1}$ of the third electrical contact 1152 from its mounting tail 1534 to its free end 1618. The difference in the maximum lengths $L_{max,1}$ can be attributed at least in part to a difference in the lengths $L_{max,2}$ of the anchoring regions of the first, second, and third electrical contacts 1144, 1146, and 1152. The maximum length $L_{max,2}$ of each of the anchoring regions 1414 and 1514 of the first and second electrical contacts 1144 and 1146 can be greater than the maximum length $L_{max,2}$ of the anchoring region 1614 of the third electrical contact 1152. Further, the maximum length $L_{max,5}$ of each of the intermediate portions 1426 and 1526 of the first and second electrical contacts 1144 and 1146 can be greater than the maximum length $L_{max,5}$ of the intermediate portion 1626 of the third electrical contact 1152. Yet further, the maximum lengths $L_{max,4}$ of the portions 1420, 1520, and 1620 of the first, second, and third electrical contacts 1144, 1146, and 1152 can be equal, the maximum lengths $L_{max,6}$ of the second portions 1426, 1526, and 1626 of the first, second, and third electrical contacts 1144, 1146, and 1152 can be equal, the maximum lengths of the mounting tails 1434, 1534, and 1634 of the first, second, and third electrical contacts 1144, 1146, and 1152 can be equal, and the maximum lengths $L_{max,3}$ of the contact beams 1416, 1516, and 1616 of the first, second, and third electrical contacts 1144, 1146, and 1152 can be equal. It is noted that, in alternative embodiments, one or more of these lengths may vary from the first and second electrical contacts 1144 and 1146 to the third electrical contact 1152.

The maximum widths $W_{max}$ of the first, second, and third electrical contacts 1144, 1146, and 1152 can be equal or can vary from one another. Similarly, the maximum thicknesses $T_{max}$ of the first, second, and third electrical contacts 1144, 1146, and 1152 can be equal or can vary from one another. Moreover, in alternative embodiments, one or more of the maximum lengths $L_{max,4}$, the maximum lengths $L_{max,6}$, and the maximum lengths $L_{max,3}$ of the first, second, and third electrical contacts 1144, 1146, and 1152 can be vary from one another.

In at least some embodiments, the dimensions of the electrical contact 1144 of FIGS. 21 to 23 can be as follows: the length $L_{max,1}$ can be between approximately 7 mm and approximately 16 mm, the length $L_{max,2}$ can be between approximately 3 mm and approximately 8 mm, the length $L_{max,3}$ can be between approximately 4 mm and approximately 8 mm, the length $L_{max,4}$ can be between approximately 0.5 mm and approximately 2 mm, the length $L_{max,5}$ can be between approximately 1.0 mm and 6 mm, the length $L_{max,6}$ can be between approximately 0.5 mm and approximately 2 mm, the width $W_{max,1}$ can be between approximately 0.3 mm and approximately 0.9 mm, the width $W_1$ can be between approximately 0.3 mm and approximately 0.9 mm, the width $W_2$ can be between approximately 0.2 mm and approximately 0.5 mm, the width $W_3$ can be between approximately 0.2 mm and approximately 0.5 mm, and the thickness $T_{max}$ can be between approximately 0.125 mm and approximately 0.225 mm.

In at least some embodiments, the dimensions of the electrical contact 1146 of FIGS. 24 to 26 can be as follows: the length $L_{max,1}$ can be between approximately 6 mm and approximately 12 mm, the length $L_{max,2}$ can be between approximately 2 mm and approximately 6 mm, the length $L_{max,3}$ can be between approximately 4 mm and approximately 8 mm, the length $L_{max,4}$ can be between approximately 0.5 mm and approximately 2 mm, the length $L_{max,5}$ can be between approximately 1.0 mm and 6 mm, the length $L_{max,6}$ can be between approximately 0.5 mm and approximately 2 mm, the width $W_{max,1}$ can be between approximately 0.3 mm and approximately 0.9 mm, the width $W_1$ can be between approximately 0.3 mm and approximately 0.9 mm, the width $W_2$ can be between approximately 0.2 mm and approximately 0.5 mm, the width $W_3$ can be between approximately 0.2 mm and approximately 0.5 mm, and the thickness $T_{max}$ can be between approximately 0.125 mm and approximately 0.225 mm.

Figure 32:
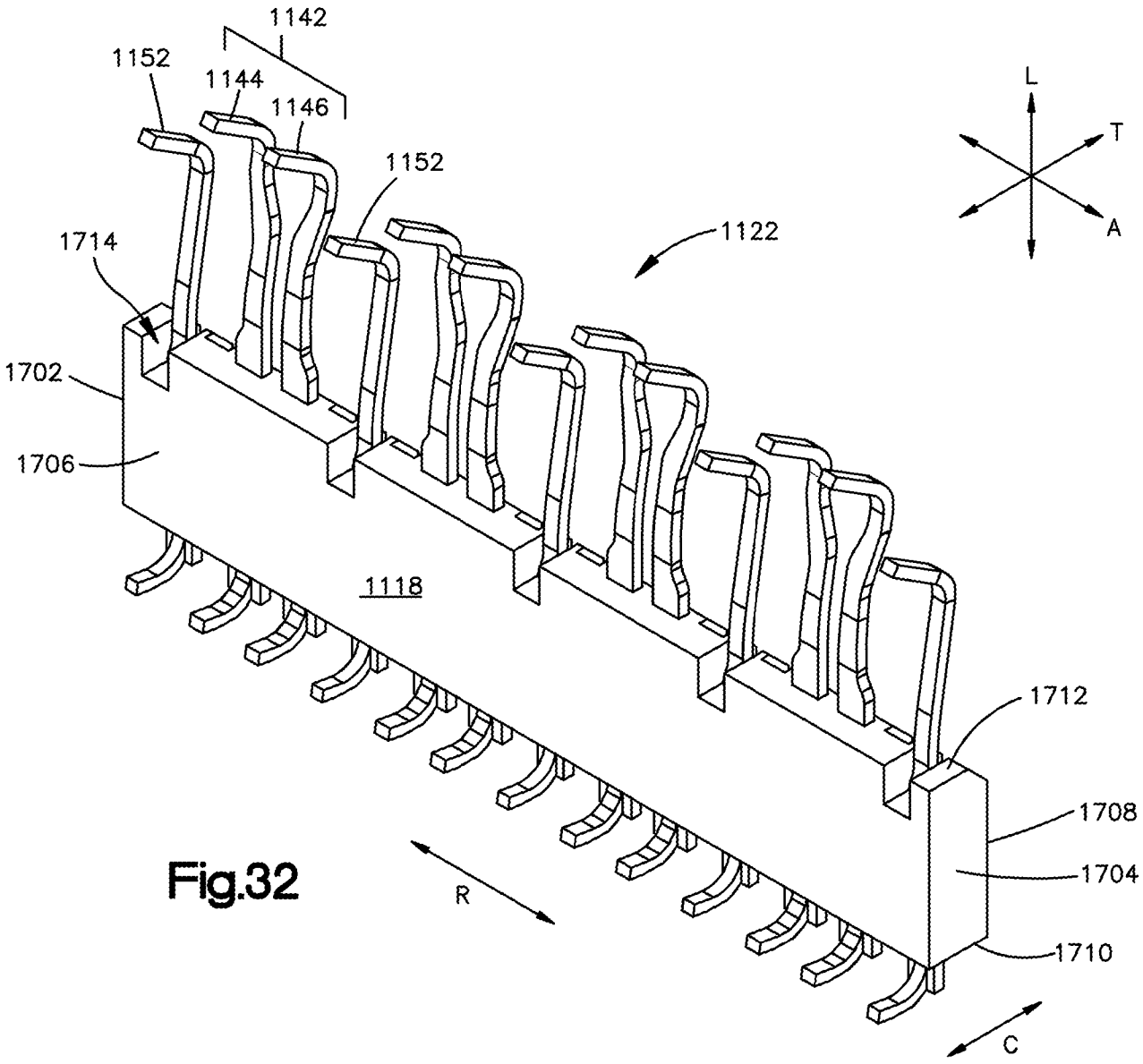
FIG. 32 shows a perspective view of an insert mold assembly of FIG. 17 according to one embodiment.
Figure 33:
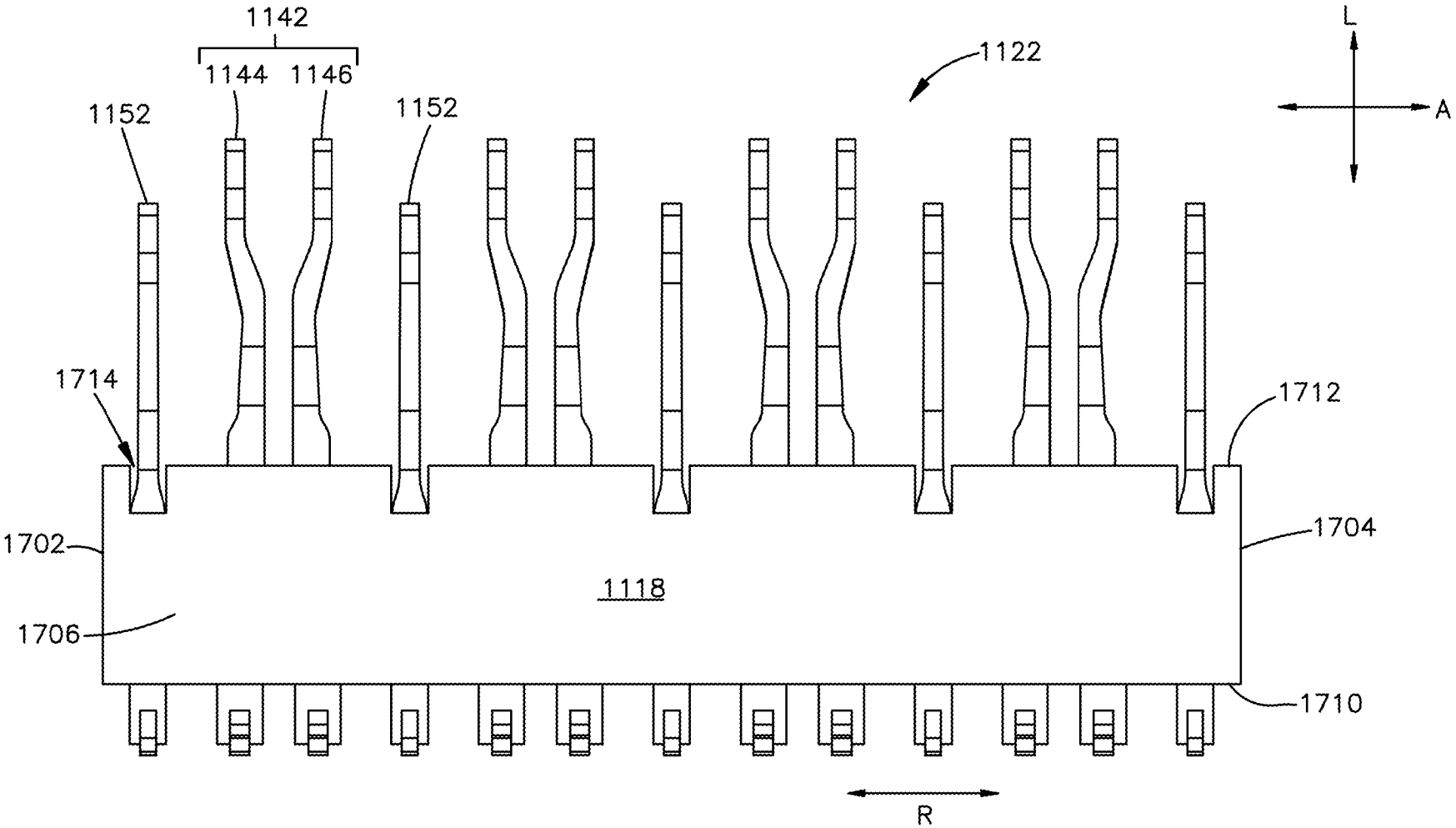
FIG. 33 shows a front plan view of the insert mold assembly of FIG. 32.

Referring now to FIGS. 32 and 33, each insert mold assembly 1122 can include an insert mold body 1118, a first set 1140 of electrical contacts supported by the insert mold body 1118, and a second set 1150 of electrical contacts supported by the insert mold body 1118. The insert mold body 1118 can include first and second lateral ends 1702 and 1704, and first and second sides 1706 and 708. The first and second ends 1702 and 1704 can be spaced opposite from one another along the lateral direction A (or row direction R). Thus, the first and second lateral ends 1702 and 1704 can face away from one another. The first and second sides 1706 and 1708 can be spaced opposite from one another along the transverse direction T (or column direction C). Thus, the first and second sides 1706 and 1708 can face away from one another. It should therefore be appreciated that each of the first and second lateral ends 1702 and 1704 can be connected between the first and second sides 1706 and 1708. Similarly, each of the first and second sides 1706 and 1708 can be connected between the first and second lateral ends 1702 and 704.

The insert mold body 1118 can also include a mounting end 1710 and a mating end 1712 that are spaced opposite from one another along the longitudinal direction L. The insert mold body 1118 can be insert molded around the electrical contacts 1120 such that the mounting ends 1402, 1502, and 1602 of the electrical contacts 1144, 1146, and 1152 extend from the mounting end 1710 of the insert mold body 1118 and the mating ends 1404, 1504, and 1604 of the electrical contacts 1144, 1146, and 1152 extend from the mating end 1712 of the insert mold body 1118.

The mounting end 1710 can be terminate between the upper-most point and lower-most point of each of the second portions 1426, 1526, and 1626 of the electrical contacts 1144, 1146, and 1152. Further, the mating end 1712 can terminate between the upper-most point and lower-most point of each of the first portions 1420, 1520, and 1620 of the electrical contacts 1144, 1146, and 1152. As described above, the first portion 1620 can be staggered with respect to the first portions 1420 and 1520 of the first and second contacts 1144 and 1146 along the lateral direction A. To accommodate this staggering, the insert mold body 1118 can define a recess 1714 for each of the contacts 1152, wherein the mating end 1712 defines the bottom of the recesses 1714. Thus, the mating end 1712 can define a saw-tooth pattern, where the bottom-most points of the saw-tooth pattern align with the first portions 1620 of the third electrical contacts 1152.

The insert mold body 1118 supports the first set 1140 of electrical contacts and the second set 1150 of electrical contacts in a row. The first set 1140 of electrical contacts in each row can include at least one pair 1142 of adjacent electrical contacts 1144 and 1146 that are configured as discussed above in relation to FIGS. 21 to 26. For instance, the first set 1140 can include a plurality of pairs 1142 of adjacent electrical contacts 1144 and 1146. The second set 1150 can include at least one, such as a plurality, of the electrical contacts 1152, each configured as discussed above in relation to FIGS. 27 to 29. The contacts of the first and second sets 1140 and 1150 can be arranged edge-to-edge along the row direction R as discussed above in relation to FIGS. 30 and 31. Four pairs 1142 of the electrical contact 1144 and 1146 and five instances of the electrical contact 1152 are shown. However, embodiments of the present disclosure can include as few as one pair 1142 and one contact 1152, or more than four pairs 1142 and more than five instances of the electrical contact 1152.

The electrical contacts of the pairs 1142 can be arranged such that the individual contacts of each pairs 1142 are adjacent one another and spaced from one another along a row direction R, which in this embodiment is aligned with the lateral direction A and is perpendicular to both the longitudinal direction L and transverse direction T. The individual contacts of each of the pairs 1142 can be immediately adjacent one another without any other electrical contact therebetween. The pairs 1142 of the electrical contacts can be arranged such that at least one of the electrical contacts 1152 of the second set 1150 is disposed between adjacent pairs 1142 of the electrical contacts along the row direction R. The adjacent pairs 1142 of the electrical contacts can be immediately adjacent one another without any other pair 1142 of the electrical contacts therebetween. Thus, the electrical contacts can be arranged along the row direction in the following pattern: first electrical contact 1144-second electrical contact 1146-third electrical contact 1152-first electrical contact 1144-second electrical contact 1146-third electrical contact 1152, which can be repeated.

In some embodiments, each first and second electrical contact 1144 and 1146 can define a signal contact, and each third electrical contact 1152 can define ground contact. Further, each pair 1142 of the signal contacts can define a differential signal pair. Thus, the electrical contacts in the arrangement of FIGS. 30 to 33 can define the following pattern along the row direction R from left to right: ground-signal-signal-ground-signal-signal, which can be repeated. As such, the signal contacts 1144 and 1146 can each have a maximum length $L_{max,1}$ along the longitudinal direction L that is greater than the maximum length $L_{max,1}$ of each of the ground contacts 1152 along the longitudinal direction L.

Without being bound by theory, it is believed that anchoring regions of electrical contacts having larger surface areas can suffer from greater drops in impedance than anchoring regions with smaller surfaces areas. However, retention of electrical contacts within connector housings can be weaker for electrical contacts having smaller anchoring regions than for electrical contacts having larger anchoring regions. Contacts 1144, 1146, and 1152 balance these competing concerns (i.e., impedance vs. retention) by (i) reducing the surface area of their respective anchoring regions at the intermediate portions to reduce the impedance drop at the anchoring regions and (ii) maintaining enlarged regions to support contact retention. As a result, each of contacts 1144, 1146, and 1152 can have an improved impedance profile over a comparable contact having an anchoring region with larger surface area, namely, the impedance of the contacts 1144, 1146, and 1152 at their respective anchoring regions do not drop as significantly as the impedance of comparable contacts at their anchoring regions.

Further, the closer spacing of the contact beams 1416 and 1516 of the signal contacts 1144 and 1146 can result in the signal contacts 1144 and 1146 being more tightly coupled together than comparable contacts having inner edges that are not linear. It is believed that the tighter coupling can increase the power flow of the signals in between the first and second electrical contacts 1144 and 1146 along the longitudinal direction L, can improve impedance control, and can reduce crosstalk. Moreover, spacing the contact beams 1416 and 1516 of the signal contacts 1144 and 1146 closer together, while maintaining the same distance from one ground contact 1152 to the next, increases the spacing between (i) the contact beams 1416 and 1516 of the signal contacts 1144 and 1146 and (ii) the contact beams 1616 of the ground contacts 1152. It is believed that increasing this spacing reduces coupling between (i) the signal contacts 1144 and 1146 and (ii) the ground contacts 1152.

As shown in FIGS. 30 to 33, a portion of the contact beams 1416 and 1516 of the first and second electrical contacts 1144 and 1146 in each pair 1142 can flare away from one another as contact beams 1416 and 1516 extend toward their respective free ends 1418 and 1518. Further, the inner stubs 1419 and 1519 of the first and second electrical contacts 1144 and 1146 in each pair 1142 can be spaced further from one another than the inner sides of the anchoring regions 1414 and 1514. Spacing the stubs 1419 and 1519 away from one another can reduce capacitive coupling between the first and second contacts 1144 and 1146, resulting in less interference between the signals conducted over the first and second contacts 1144 and 1146 than if the stubs 1419 and 1519 were spaced closer together to one another. Moreover, arranging the shorter contacts 1152 adjacent the pairs 1142 of contacts can result in lower capacitive coupling between (i) the flared stubs 1419 and 1519 and (ii) the adjacent contacts than would occur if the contacts 1152 were longer.

Without being bound by theory, it is believed that designating the shortened contacts 1152 in the rows of FIGS. 30 to 33 as ground contacts can shift common mode resonance of the contacts 1152 out in frequency to improve crosstalk. Further, it is believed that interspersing the shortened ground contacts 1152 with the elongated signal contacts 1144 and 1146 as shown in FIGS. 30 to 33 can place the beam profiles of the shortened ground contacts 1152 out of plane with those of the elongated signal contacts 1144 and 1146 so to allow signal pair cancellation on ground beam, which can result in reduced cross coupling or crosstalk. Moreover, it is believed that interspersing the shortened ground contacts 1152 with the elongated signal contacts 1144 and 1146 can reduce capacitance of the tips 1419 and 1519 of the elongated signal contacts 1144 and 1146. This in turn allows the tips 1419 and 1519 of the elongated signal contacts 1144 and

1146 to be lengthened for a mechanical advantage where longer tips can be more robust to avoid stub damage when the electrical connector 1100 is mated with the second complementary component 1300. Each of the aforementioned characteristics enables the connector 1100 to operate at faster speeds than comparable prior art connectors, such as speeds up to or exceeding 140 Gigabytes/second.

In alternative embodiments, the contacts 1144, 1146, and 1150 can define an open pin field. For instance, each of the contacts 1144, 1146, and 1152 can define either a signal contact or a ground contact. Thus, the contacts can define grounds and signals in any desired pattern along the row direction R. For instance, the electrical contacts in the arrangement of FIGS. 30 to 33 can define the following pattern along the row direction R from left to right: ground-signal-ground-signal-ground-signal, which can be repeated.

In further alternative embodiments, the electrical contacts 1144, 1146, and 1152 can be arranged along the row direction in a different pattern, such as (without limitation): electrical contact 1144-electrical contact 1146-electrical contact 1152-electrical contact 1152-electrical contact 1144-electrical contact 1146-electrical contact 1152-electrical contact 1152, which can repeat.

Referring back to the connector 1100 in FIGS. 17 to 20, the connector housing 1102 has a mounting end 1104 and a mating end 1106 that are spaced from one another. The contacts 1144, 1146, and 1152 are supported by the housing 1102 such that their respective mounting end 1402, 1502, and 1602 are disposed at the mounting end 1104 of the housing 1102 and their respective mating ends 1404, 1504, and 1604 are disposed at the mating end 1106 of the housing. Further, first and second insert mold assemblies 1122*a* and 1122*b* can be bottom loaded into the connector housing 1102 through the mounting end 1104.

The electrical connector 1100 is a vertical electrical connector, wherein the mating end 1106 is configured to mate with the second complementary electrical component 1300 along a mating direction $M_A$ that is aligned with the longitudinal direction L, and the mounting end 1104 is configured to mount to the first complementary electrical component 1200 along a mounting direction $M_O$ that is also aligned with the longitudinal direction L. Thus, in FIGS. 17 to 20, the mating direction $M_A$ and the mounting direction $M_O$ are both aligned with (i.e., parallel to) the longitudinal direction L.

In alternative embodiments, the electrical connector can be a right-angle electrical connector, where the mating end 1106 is configured to mate with the second complementary electrical component 1300 along a mating direction $M_A$, and the mounting end 1104 is configured to mount to the first complementary electrical component 1200 along a mounting direction $M_O$, perpendicular to the mating direction $M_A$. In such embodiments, the mounting direction $M_O$ can be aligned with the longitudinal direction L, and the mating direction $M_A$ can be perpendicular to the longitudinal direction L, such as the transverse direction T.

The connector housing 1102 has first and second sidewalls 1108 and 1110 that extend from the mating end 1106 to the mounting end 1104. The first and second sidewalls 1108 and 1110 can be spaced from one another along the column direction C so as to define an insertion slot 1112 therebetween that is sized and configured to receive the second complementary electrical component 1300. The insertion slot 1112 defines a plane that extends along the mating direction $M_A$ and the row direction R between the first and second rows $R_1$ and $R_2$. The connector housing 1102 can also include first and second endwalls 1114 and 1116 that are spaced from one another along the row direction R. The first and second endwalls 1114 and 1116 can extend from the mating end 1106 to the mounting end 1104 and from the first sidewall 1108 to the second sidewall 1110.

The first sidewall 1108 includes a first internal surface 1108*a*, and a first external surface 1108*b* spaced opposite from the first internal surface 1108*a* along the column direction C. Similarly, the second sidewall 1110 includes a second internal surface 1110*a*, and a second external surface 1110*b* spaced opposite from the second internal surface 1110*a* along the column direction C. The first and second internal surfaces 1108*a* and 1110*a* can face one another along the column direction C, and the first and second external surfaces 1108*b* and 1110*b* can face away from one another along the column direction C. Moreover, the first internal surface 1108*a* is spaced between the first external surface 1108*b* and the second sidewall 1110, while the second internal surface 1110*a* is spaced between the second external surface 1110*b* and the first sidewall 1108.

The first sidewall 1108 can include a first plurality of ribs 1108*c* that extend from the first internal surface 1108*a* towards the second sidewall 110. The ribs 1108*c* of the first plurality of ribs can be spaced from one another along the row direction R by a width that is greater than the width $W_2$ of the contact beams 1414, 1514, and 1614 of the electrical contacts 1144, 1146, and 1152. Each rib 1108*c* can be spaced between a different pair of immediately adjacent electrical contacts such that the edges of the immediately adjacent electrical contacts that face one another also face the rib 1108*c*.

Similarly, the second sidewall 1110 can include a second plurality of ribs 1110*c* that extend from the second internal surface 1110*a* towards the first sidewall 1108. The ribs 1110*c* of the first plurality of ribs can be spaced from one another along the row direction R by a width that is greater than the width W of the contact beams 1414, 1514, and 1614 of the electrical contacts 1144, 1146, and 1152. Each rib 1110*c* can be spaced between a different pair of immediately adjacent electrical contacts such that the edges of the immediately adjacent electrical contacts that face one another also face the rib 1110*c*.

With reference to the system 1000 of FIGS. 17 to 20, the system 1000 can include the electrical connector 1100 and at least one, or both, of (i) a first complementary electrical component 1200 and (ii) a second complementary electrical component 1300. The first complementary electrical component 1200 can be implemented as a PCB. The first complementary electrical component 1200 has opposed upper and lower surfaces 1202 and 1204 that are spaced from one another along the mounting direction $M_O$, where the upper surface 1202 is configured to couple to the mounting ends 1402, 1502, and 1602 of the electrical contacts 1144, 1146, and 1152 of the electrical connector 1100. The first complementary electrical component 1200 also has opposed first and second ends 1206 and 1208 that are spaced from one another along the column direction C, and opposed first and second sides 1210 and 1212 that are spaced from one another along the row direction R. The lower surface 1204 can also be said to be spaced from the upper surface 1202 along the mounting direction $M_O$.

The upper and lower surfaces 1202 and 1204 each extend from the first end 1206 to the second end 1208 and from the first side 1210 to the second side 1212 so as to define a planar surface having a width along the column direction C from the first end 1206 to the second end 1208, and a length from the first side 1210 to the second side 1212 along the row direction R. Further, the first complementary electrical component 1200 defines a thickness from the upper surface 1202 to the lower surface 1204 along the mounting direction $M_O$. The length and width are greater than the thickness. Thus, the first complementary electrical component 1200 is planar along the row direction R and the column direction C.

The first complementary electrical component 1200 has a dielectric substrate 1214, a first set of first conductive contact pads 1216 carried by the substrate 1214 at the upper surface 1202, and a second set of second conductive contact pads 1218 carried by the substrate 1214 at the upper surface 1202. The first and second sets of conductive contact pads are arranged in first and second rows $R_1$ and $R_2$ at the upper surface 1202 and that are spaced from one another along the column direction C.

Each first contact pad 1216 can include a first end 1216*a*, and a second end 1216*b* spaced from the first end 1216*a* along the column direction C. Further, each first contact pad 1216 can include opposed sides 1216*c* that are spaced from one another along the row direction R, and that extend from the first end 1216*a* to the second end 1216*b*. Each first contact pad 1216 can have a rectangular shape such that each first contact pad 1216 is elongate from its respective first end 1216*a* to its respective second end 1216*b*, or can have any suitable alternative shape such as a circle, square, or other polygon. Similarly, each second contact pad 1218 can include a first end 1218*a*, a second end 1218*b* spaced from the first end 1218*a* along the column direction C, and opposed sides 1218*c* that are spaced from one another along the row direction R, and that extend from the first end 1218*a* to the second end 1218*b*. Each second contact pad 1218 can have a rectangular shape such that each second contact pad 1218 is elongate from its respective first end 1218*a* to its respective second end 1218*b*, or can have any suitable alternative shape such as a circle, square, or other polygon.

The first contact pads 1216 within each row $R_1$ and $R_2$ are arranged in pairs 1220 and are positioned so as to mate with the pairs 1142 of the electrical contacts supported by the electrical connector 1100 in the corresponding rows $R_1$ and $R_2$ of the electrical connector 1100. Thus, each pair 1220 of the first contact pads 1216 aligns with a different pair 1142 of the electrical contacts along the mounting direction $M_O$ when the second complementary electrical component 1200 is mated with the electrical connector 1100. The second contact pads 1218 within each row $R_1$ and $R_2$ are positioned so as to mate with the electrical contacts 1152 supported by the electrical connector 1100 in the corresponding rows $R_1$ and $R_2$ of the electrical connector 1100. Thus, each second contact pad 1218 aligns with a different electrical contact 1152 along the mounting direction $M_O$ when the first complementary electrical component 1200 is mated with the electrical connector 1100.

The first and second sets of contact pads 1216 and 1218 can be arranged in a side-by-side manner along each row $R_1$ and $R_2$. The individual first contact pads 1216 within each pair 1220 are spaced apart from one another along the row direction R without any other contact pads therebetween. The pairs 1220 of first contact pads 1216 can be arranged such that at least one of the second contact pads 1218 is disposed between adjacent pairs 1220 of the first electrical contacts 1216 along the row direction R. The adjacent pairs 1220 of the first electrical contacts 1216 can be immediately adjacent one another without any other pair 1220 of the first electrical contacts 1216 therebetween. Thus, the electrical contacts can be arranged along the row direction R in the following pattern: second contact pad 1218-first contact pad 1216-first contact pad 1216-second contact pad 1218-first contact pad 1216-first contact pad 1216, which can be repeated.

Each first contact pad 1216 can define a signal contact pad, and each second contact pad 1218 can define a ground contact pad. Further, each pair 1220 of the first contact pads 1216 can define a differential signal pair. Thus, the contact pads in the arrangement of FIGS. 17 to 20 can define the following pattern along the row direction R from left to right: ground-signal-signal-ground-signal-signal, which can be repeated. Alternatively, each first contact pad 1216 can either a signal contact pad or a ground contact pad, and each second contact pad 1218 can define either a signal contact pad or a ground contact pad. Thus, the contact pads can define grounds and signals in any desired pattern along the row direction R. For instance, the electrical contact pads can define the following pattern along the row direction R from left to right: ground-signal-ground-signal-ground-signal, which can be repeated.

With continuing reference to the system 1000 of FIGS. 17 to 20, the second complementary electrical component 1300 can define a PCB such as an edge card. The second complementary electrical component 1300 has opposed first and second side surfaces 1302 and 1304 that are spaced from one another along the column direction C such that the first side surface 1302 mates with the electrical contacts of the first row $R_1$ of the electrical connector 1100, and the second side surface 1304 mates with the electrical contacts of the second row $R_2$ of the electrical connector 1100. The second complementary electrical component 1300 also has opposed insertion and trailing ends 1306 and 1308 that are spaced from one another along the mating direction $M_A$, and opposed first and second edges 1310 and 1312 that are spaced from one another along the row direction R. The insertion end 1306 can also be said to be spaced from the trailing end 1308 along the mating direction $M_A$.

The first and second side surfaces 1302 and 1304 each extend from the insertion end 1306 to the trailing end 1308 and from the first edge 1310 to the second edge 1312 so as to define a planar surface having a height along the mating direction $M_A$ from the insertion end 1306 to the trailing end 1308, and a width from the first edge 1310 to the second edge 1312 along the row direction R. Further, the second complementary electrical component 1300 defines a thickness from the first side surface 1302 to the second side surface 1304 along the column direction C. The height and width are greater than the thickness. Thus, the second complementary electrical component 1300 is planar along the row direction R and the mating direction $M_A$. The insertion end 1306 can also be tapered such that the thickness of the insertion end 1306 decreases in the mating direction $M_A$.

The second complementary electrical component 1300 has a dielectric substrate 1314, a first plurality of first conductive contact pads 1316 carried by the substrate 1314 at the first side surface 1302, and a second plurality of second conductive contact pads 1318 carried by the substrate 1314 at the first side surface 1302. Each first contact pad 1316 can include a trailing end 1316*a*, and a leading end 1316*b* spaced from the trailing end 1316*a* along the mating direction $M_A$. Further, each first contact pad 1316 can include opposed sides 1316*c* that are spaced from one another along the row direction R, and that extend from the trailing end 1316*a* to the leading end 1316*b*. Each first contact pad 1316 can have a substantially rectangular shape such that each first contact pad 1316 is elongate from its respective trailing end 1316*a* to its respective leading end

1316*b*, or can have any suitable alternative shape such as a circle, square, or other polygon.

Similarly, each second contact pad 1318 can include a trailing end 1318*a*, a leading end 1318*b* spaced from the trailing end 1318*a* along the mating direction $M_A$, and opposed sides 1318*c* that are spaced from one another along the row direction R, and that extend from the trailing end 1318*a* to the leading end 1318*b*. Each second contact pad 1318 can have a rectangular shape such that each second contact pad 1318 is elongate from its respective trailing end 1318*a* to its respective leading end 1318*b*, or can have any suitable alternative shape such as a circle, square, or other polygon.

The first contact pads 1316 are arranged in pairs 1320 and are positioned so as to mate with the pairs 1142 of the electrical contacts 1144 supported by the electrical connector 1100 in the first row $R_1$. Thus, each pair 1320 of the first contact pads 1316 aligns with a different pair 1142 of the electrical contacts along the column direction C when the second complementary electrical component 1300 is mated with the electrical connector 1100. The second contact pads 1318 are positioned so as to mate with the electrical contacts 1152 supported by the electrical connector 1100 in the first row $R_1$. Thus, each second contact pad 1318 aligns with a different second electrical contact 1152 along the column direction C when the second complementary electrical component 1300 is mated with the electrical connector 1100.

The second side surface 1304 can carry contact pads in a pattern that substantially mirrors that of the first side surface 1302. Thus, the second complementary electrical component 1300 can also have a first set of conductive contact pads 1316 carried by the substrate 1314 at the second side surface 1304, and a second set of conductive contact pads 1318 carried by the substrate 1314 at the second side surface 1304, where the first and second sets of contact pads 1316 and 1318 are arranged as discussed above in relation to the first side surface 1302.

The first and second pluralities of contact pads 1316 and 1318 can be arranged in a side-by-side manner along the row direction R. The individual first contact pads 1316 within each pair 1320 can be spaced apart from one another along the row direction R without any other contact pads therebetween. The pairs 1320 of first contact pads 1316 can be arranged such that at least one of the second contact pads 1318 is disposed between adjacent pairs 1320 of the first electrical contacts 1316 along the row direction R. The adjacent pairs 1320 of the first electrical contacts 1316 can be immediately adjacent one another without any other pair 1320 of the first electrical contacts 1316 therebetween. Thus, the electrical contacts can be arranged along the row direction R in the following pattern: second contact pad 1318-first contact pad 1316-first contact pad 1316-second contact pad 1318-first contact pad 1316-first contact pad 1316, which can be repeated.

Each first contact pad 1316 can define a signal contact pad, and each second contact pad 1318 can define a ground contact pad. Further, each pair 1320 of the first contact pads 1316 can define a differential signal pair. Thus, the contact pads in the arrangement of FIGS. 17 to 20 can define the following pattern along the row direction R from left to right: ground-signal-signal-ground-signal-signal, which can be repeated. Alternatively, each first contact pad 1316 can define either a signal contact pad or a ground contact pad, and each second contact pad 1318 can define either a signal contact pad or a ground contact pad. Thus, the contact pads can define grounds and signals in any desired pattern along the row direction R. For instance, the electrical contact pads can define the following pattern along the row direction R from left to right: ground-signal-ground-signal-ground-signal, which can be repeated.

It will be appreciated by those skilled in the art that changes could be made to the embodiments described above without departing from the broad inventive concept thereof. Furthermore, it should be appreciated that the structure, features, and methods as described above with respect to any of the embodiments described herein can be incorporated into any of the other embodiments described herein unless otherwise indicated. It is understood, therefore, that this invention is not limited to the particular embodiments disclosed, but it is intended to cover modifications within the spirit and scope of the present disclosure.

Unless explicitly stated otherwise, each numerical value and range in the present disclosure should be interpreted as being approximate as if the word "about" or "approximately" preceded the value of the value or range.

What is claimed is:

1. An electrical contact for an electrical connector, the electrical contact comprising:

a body having a mounting end and a mating end;

an elongate contact beam that defines the mating end and is configured to contact a complementary electrical component when the complementary electrical component is mated with the electrical connector at the mating end, the contact beam including:

first and second edges that are spaced opposite from one another along a lateral direction, and that extend between the mounting and mating ends; and first and second broadsides that are spaced opposite from one another, and that extend between the mounting and mating ends and between the first and second edges, each broadside having a width along the lateral direction, the width being greater than a thickness of each of the first and second edges along a transverse direction, perpendicular to the lateral direction; and an anchoring region that is configured to retain the electrical contact in a housing of the electrical connector, the anchoring region including:

a first portion that extends from the contact beam towards the mounting end in a first direction, and has a first portion first side that is spaced outwards from the first edge with respect to the lateral direction;

a second portion that extends from the mounting end towards the first portion, in a second direction opposite the first direction, and has a second portion first side that is spaced outwards from the first edge with respect to the lateral direction;

an intermediate portion that extends between the first portion and the second portion, and has an intermediate portion first side that is recessed inwards from each of the first portion first side and the second portion first side with respect to the lateral direction; and at least one retention feature that is configured to extend outward from the body along a perpendicular direction that is perpendicular to the lateral direction, wherein the first portion further comprises a first shoulder that tapers inward along the lateral direction as it extends in the first direction, and a second shoulder that tapers inward along the lateral direction as it extends in the second direction, the first shoulder being positioned between the at least one retention feature and the intermediate portion.

2. The electrical contact of claim 1, wherein each retention feature defines a barb having a first barb end that is attached to the body in a hinged manner, and a second barb end that is opposite the first barb end and that is free from attachment to the body.

3. The electrical contact of claim 2, wherein the at least one retention feature includes first and second barbs that are aligned with one another with respect to the lateral direction.

4. The electrical contact of claim 2, wherein the at least one retention feature includes first and second barbs, and the first barb end of the first barb is offset from the first barb end of the second barb with respect to a direction that extends from the first portion to the second portion.

5. The electrical contact of claim 1, wherein the first portion defines a width along the lateral direction from the first side to a second side of the first portion, the second portion defines a width along the lateral direction from the first side to a second side of the second portion, and the intermediate portion defines a width along the lateral direction from the first side to a second side of the intermediate portion, the widths of the first and second portions being greater than both the width of the intermediate portion and a width of the contact beam along the lateral direction.

6. The electrical contact of claim 1, wherein the contact beam has a first beam portion that extends along a central axis, and a second beam portion that extends from the first beam portion towards a free end of the contact beam along a direction that is angularly offset from the central axis with respect to the lateral direction.

7. A plurality of electrical contacts comprising at least a first electrical contact and at least a second electrical contact, each of the plurality of electrical contacts configured as recited in claim 1.

8. The plurality of electrical contacts of claim 7, wherein the intermediate portion of the first electrical contact has a length along a longitudinal direction that is greater than a length of the intermediate portion of the second electrical contact along the longitudinal direction, the longitudinal direction being perpendicular to the lateral and transverse directions.

9. The plurality of electrical contacts of claim 7, wherein the first electrical contact has a maximum length from the mounting end of the first electrical contact to the mating end of the first electrical contact that is greater than a maximum length of the second electrical contact from the mounting end of the second electrical contact to the mating end of the second electrical contact.

10. The plurality of electrical contacts of claim 7, wherein the plurality of electrical contacts comprises at least a third electrical contact that is disposed between the first and second electrical contacts without any other electrical contacts therebetween, and the intermediate portion of the third electrical contact has a length along a longitudinal direction that is greater than the length of the intermediate portion of the second electrical contact along the longitudinal direction.

11. The plurality of electrical contacts of claim 7, wherein the plurality of electrical contacts comprises at least a third electrical contact that is disposed between the first and second electrical contacts without any other electrical contacts therebetween, and the first and third electrical contacts each have a maximum length from their respective mounting end to their respective mating end that is greater than a maximum length of the second electrical contact from the mounting end of the second electrical contact to the mating end of the second electrical contact.

12. The plurality of electrical contacts of claim 10, wherein:

the contact beam of each of the first and third electrical contacts has a first beam portion that extends along a central axis, and a second beam portion that extends from the first beam portion towards a free end of the contact beam along a direction that is angularly offset from the central axis with respect to the lateral direction; and the first and third electrical contacts are mirror images of one another such that the second beam portions of the first and third electrical contacts diverge away from one another.

13. A plurality of electrical contacts, each comprising:

a body having a mounting end and a mating end;

an elongate contact beam that defines the mating end and is configured to contact a complementary electrical component, the contact beam including:

first and second edges that are spaced opposite from one another along a lateral direction, and that extend between the mounting and mating ends; and first and second broadsides that are spaced opposite from one another, and that extend between the mounting and mating ends and between the first and second edges, each broadside having a width along the lateral direction, the width being greater than a thickness of each of the first and second edges along a transverse direction, perpendicular to the lateral direction; and an anchoring region that is configured to retain the electrical contact in a housing of an electrical connector, the anchoring region including:

a first portion that extends from the contact beam towards the mounting end, and has a first portion first side that is spaced outwards from the first edge with respect to the lateral direction;

a second portion that extends from the mounting end towards the first portion, and has a second portion first side that is spaced outwards from the first edge with respect to the lateral direction; and an intermediate portion that extends between the first portion and the second portion along a longitudinal direction, perpendicular to the lateral and transverse directions, the intermediate portion having an intermediate portion first side that is recessed inwards from each of the first portion first side and second portion first side with respect to the lateral direction; and a retention feature having a first barb end that is connected to the anchoring region in a hinged manner, and a second barb end that is opposite the first barb end and is free from attachment to the anchoring region, wherein the second barb end is offset from the first barb end along the transverse direction, wherein the plurality of electrical contacts includes a first electrical contact and a second electrical contact, and the intermediate portion of the first electrical contact has a length along the longitudinal direction that is greater than a length of the intermediate portion of the second electrical contact along the longitudinal direction.

14. The plurality of electrical contacts of claim 13, wherein the first electrical contact has a maximum length from the mounting end of the first electrical contact to the mating end of the first electrical contact that is greater than a maximum length of the second electrical contact from the mounting end of the second electrical contact to the mating end of the second electrical contact.

15. The plurality of electrical contacts of claim 13, wherein the first electrical contact is a signal contact and the second electrical contact is a ground contact.

16. The plurality of electrical contacts of claim 13, wherein the plurality of electrical contacts comprises a third electrical contact, the third electrical contact being disposed between the first electrical contact and the second electrical contact without any other electrical contacts therebetween, and the intermediate portion of the third electrical contact has a length along the longitudinal direction that is greater than the length of the intermediate portion of the second electrical contact along the longitudinal direction.

17. The plurality of electrical contacts of claim 7, wherein the plurality of electrical contacts comprises a third electrical contact, the third electrical contact being disposed between the first electrical contact and the second electrical contact without any other electrical contacts therebetween, and each of the first and third electrical contacts have a maximum length that is greater than a maximum length of the second electrical contact.

18. The plurality of electrical contacts of claim 16, wherein:

the contact beam of each of the first and third electrical contacts has a first beam portion that extends along a central axis, and a second beam portion that extends from the first beam portion towards a free end of the contact beam along a direction that is angularly offset from the central axis with respect to the lateral direction; and the first and third electrical contacts are mirror images of one another such that the second beam portions of the first and third electrical contacts diverge away from one another.

19. The plurality of electrical contacts of claim 10, wherein the first and third electrical contacts are signal contacts and the second electrical contact is a ground contact.

20. The plurality of electrical contacts of claim 19, wherein the plurality of electrical contacts comprises a second ground contact adjacent the ground contact without any other electrical contacts therebetween such that the plurality of electrical contacts are arranged as signal-signal-ground-ground.

21. A plurality of electrical contacts, each comprising:

a body having a mounting end and a mating end;

an elongate contact beam that defines the mating end and is configured to contact a complementary electrical component, the contact beam including:

first and second edges that are spaced opposite from one another along a lateral direction, and that extend between the mounting and mating ends; and first and second broadsides that are spaced opposite from one another, and that extend between the mounting and mating ends and between the first and second edges, each broadside having a width along the lateral direction, the width being greater than a thickness of each of the first and second edges along a transverse direction, perpendicular to the lateral direction; and an anchoring region that is configured to retain the electrical contact in a housing of an electrical connector, the anchoring region including:

a first portion that extends from the contact beam towards the mounting end, and has a first portion first side that is spaced outwards from the first edge with respect to the lateral direction;

a second portion that extends from the mounting end towards the first portion, and has a second portion first side that is spaced outwards from the first edge with respect to the lateral direction; and an intermediate portion that extends between the first portion and the second portion along a longitudinal direction, perpendicular to the lateral and transverse directions, the intermediate portion having an intermediate portion first side that is recessed inwards from each of the first portion first side and the second portion first side with respect to the lateral direction, wherein the plurality of electrical contacts includes a first signal contact, a second signal contact, and a ground contact, the first and second signal contacts each having a length along a longitudinal direction, perpendicular to the lateral and transverse directions, that is greater than a length of the ground contact along the longitudinal direction.

22. The electrical contact of claim 1, wherein the first portion has at least one upper shoulder and at least one lower shoulder.

23. The electrical contact of claim 1, wherein the at least one retention feature that extends outward from the body along the transverse direction.

24. The electrical contact of claim 1, wherein the at least one retention feature includes a retention feature first side that is aligned with the first portion first side with respect to the lateral direction.

* * * * *